US009383119B2

(12) United States Patent
Kida et al.

(10) Patent No.: US 9,383,119 B2
(45) Date of Patent: Jul. 5, 2016

(54) HEATER

(71) Applicant: NGK INSULATORS, LTD., Nagoya (JP)

(72) Inventors: Masahiro Kida, Nagoya (JP); Kenkichi Nagai, Nagoya (JP); Kenshin Kitoh, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 224 days.

(21) Appl. No.: 13/928,794

(22) Filed: Jun. 27, 2013

(65) Prior Publication Data

US 2013/0287378 A1 Oct. 31, 2013

Related U.S. Application Data

(63) Continuation of application No. PCT/JP2013/051293, filed on Jan. 23, 2013.

(30) Foreign Application Priority Data

Mar. 22, 2012 (JP) ..... 2012-065656

(51) Int. Cl.
*A47J 31/00* (2006.01)
*F24H 9/02* (2006.01)
(Continued)

(52) U.S. Cl.
CPC ..... *F24H 9/02* (2013.01); *F01M 5/001* (2013.01); *H05B 3/141* (2013.01); *H05B 3/42* (2013.01); *H05B 2203/024* (2013.01); *H05B 2214/03* (2013.01)

(58) Field of Classification Search
USPC ..... 392/465
See application file for complete search history.

(56) References Cited

U.S. PATENT DOCUMENTS 3,265,865 A * 8/1966 Hager, Jr. ..... 219/549
3,903,341 A * 9/1975 Gerhold ..... B01D 53/9454 156/89.22

(Continued)

FOREIGN PATENT DOCUMENTS

GB 1427676 * 3/1973 ..... H05B 3/14
JP 63-012607 U 1/1988

(Continued)

OTHER PUBLICATIONS

International Search Report and Written Opinion dated Feb. 19, 2013.

(Continued)

*Primary Examiner* — Dana Ross
*Assistant Examiner* — Renee L Miller
(74) *Attorney, Agent, or Firm* — Burr & Brown, PLLC

(57) ABSTRACT

The heater includes a heater main body, a housing storing the heater main body therein, and a coating material arranged in at least a part between the heater main body and the housing and covering at least a part of the heater main body. The coating material is a material containing at least one of ceramic and glass, the heater main body has a cylindrical honeycomb structural portion having partition walls separating and forming a plurality of cells and a pair of electrode portions disposed on a side face of the honeycomb structural portion, the housing contains the heater main body so as to cover the side face side of the heater main body, and the partition walls of the honeycomb structural portion is of a material containing ceramic as the main component and produces heat by energization.

16 Claims, 20 Drawing Sheets

(51) Int. Cl.

| | |
|---|---|
| ***H05B 3/14*** | (2006.01) |
| ***H05B 3/42*** | (2006.01) |
| ***F01M 5/00*** | (2006.01) |

(56) References Cited

U.S. PATENT DOCUMENTS

| | | | | | |
|---|---|---|---|---|---|
| 3,927,300 | A * | 12/1975 | Wada et al. | 392/502 |
| 3,956,614 | A * | 5/1976 | Hervert | 219/541 |
| 3,982,100 | A * | 9/1976 | Hervert | 219/553 |
| 3,995,143 | A * | 11/1976 | Hervert | H05B 3/146 219/205 |
| 4,177,778 | A * | 12/1979 | Naitou et al. | 123/549 |
| 4,275,259 | A * | 6/1981 | Yamamoto et al. | 136/209 |
| 4,505,107 | A * | 3/1985 | Yamaguchi | F01N 3/027 55/283 |
| 5,063,029 | A * | 11/1991 | Mizuno et al. | 422/175 |
| 5,229,079 | A * | 7/1993 | Harada et al. | 422/174 |
| 5,232,882 | A | 8/1993 | Yoshimoto et al. | |
| 5,318,757 | A * | 6/1994 | Abe et al. | 422/174 |
| 5,370,943 | A * | 12/1994 | Bruck et al. | 428/593 |
| 5,399,841 | A * | 3/1995 | Abe et al. | 219/552 |
| 5,433,926 | A * | 7/1995 | Swars | 422/174 |
| RE35,134 | E * | 12/1995 | Mizuno et al. | 422/175 |
| 5,474,746 | A * | 12/1995 | Maus et al. | 422/174 |
| 5,514,347 | A * | 5/1996 | Ohashi et al. | 422/174 |
| 5,533,167 | A * | 7/1996 | Kondo et al. | 392/485 |
| 5,651,088 | A * | 7/1997 | Abe et al. | 392/494 |
| 5,670,746 | A * | 9/1997 | Hashimoto et al. | 174/651 |
| 6,097,011 | A | 8/2000 | Gadkaree et al. | |
| 6,166,358 | A * | 12/2000 | Abe | B01D 53/9454 219/552 |
| 7,012,226 | B1 * | 3/2006 | George | 219/544 |
| 7,261,865 | B2 * | 8/2007 | Bruck | B01D 53/885 219/552 |
| 7,722,828 | B2 * | 5/2010 | Zuberi | F01N 13/10 422/177 |
| 7,727,613 | B2 * | 6/2010 | Suwabe et al. | 428/116 |
| 7,919,734 | B2 * | 4/2011 | Sakurai et al. | 219/553 |
| 2002/0021989 | A1 * | 2/2002 | Abe | F01N 3/2013 422/174 |
| 2003/0206833 | A1 * | 11/2003 | Obee et al. | 422/121 |
| 2007/0133964 | A1 * | 6/2007 | Natsuhara et al. | 392/497 |
| 2010/0147676 | A1 * | 6/2010 | Goudy, Jr. | 204/164 |
| 2011/0206896 | A1 * | 8/2011 | Humphrey et al. | 428/117 |
| 2011/0233190 | A1 * | 9/2011 | Kukino et al. | 219/542 |
| 2011/0250097 | A1 * | 10/2011 | Ido et al. | 422/177 |
| 2011/0311761 | A1 * | 12/2011 | Boulet et al. | 428/107 |
| 2012/0076698 | A1 * | 3/2012 | Ishihara | 422/174 |
| 2013/0036719 | A1 | 2/2013 | Noguchi et al. | |

FOREIGN PATENT DOCUMENTS

| | | | |
|---|---|---|---|
| JP | 63-016114 | A1 | 1/1988 |
| JP | 63-31218 | U | 2/1988 |
| JP | 63-31219 | U | 2/1988 |
| JP | 05-115796 | A1 | 5/1993 |
| JP | 11-217270 | A1 | 8/1999 |
| JP | 2000-106263 | A1 | 4/2000 |
| JP | 2001-035637 | A1 | 2/2001 |
| JP | 2003-074789 | A1 | 3/2003 |
| JP | 2011-099405 | A1 | 5/2011 |
| JP | 2011-246340 | A1 | 12/2011 |
| WO | 2011/105567 | A1 | 9/2011 |

OTHER PUBLICATIONS

Article 19 Amendment dated Apr. 8, 2013.

Chinese Office Action (Application No. 201380000441.5) dated Jan. 7, 2015 (with English translation).

International Search Report (Application No. PCT/JP2013/051293) dated Feb. 9, 2013 (in English).

International Preliminary Report on Patentability (Application No. PCT/JP2013/051293) dated Sep. 23, 2014 (in English).

Extended European Search Report (Application No. 13731654.3) dated Mar. 20, 2015.

* cited by examiner

HEATER

BACKGROUND OF THE INVENTION

1. Field of the Invention

The present invention relates to a heater. In more detail, the present invention relates to a heater usable for heating a lubricating fluid such as engine oil and a transmission fluid.

2. Description of Related Art

There are machines operating with parts grinding against each other. For example, in an internal combustion engine such as an engine, many parts grind against each other during a process where a piston moves up and down in a cylinder. When parts grind against each other in such a manner, abrasion or heat generation may be caused in the parts, and it may cause a defect in the machine.

Therefore, there is used a lubricating fluid in order to suppress abrasion and heat generation by reducing friction when parts grind against each other. For example, in order to suppress abrasion of parts and heat generation in an engine, engine oil is used as a lubricating fluid. Thus, in order to operate a machine which operates with parts grinding each other, a lubricating fluid is indispensable. However, in the case that such a lubricating fluid is at low temperature, the lubricating fluid has high viscosity. As a result, there arises a problem of impossible sufficient reduction of the friction. In addition, when the viscosity of the lubricating fluid becomes high, there arises a problem of impossible supply to an intended position.

In order to cope with the problems, the lubricating fluid is heated by a heater. This enables to appropriately lower the viscosity of the lubricating fluid and to reduce the friction well by the lubricating fluid. However, when the lubricating fluid is excessively heated, a disadvantage of causing deterioration of the lubricating fluid is occurred. Therefore, there have been proposed various heaters having a mechanism of not heating the lubricating fluid excessively and the like (e.g., Patent Documents 1 to 3).

PRIOR ART DOCUMENT

Patent Document

Patent Document 1: JP-A-2003-74789
Patent Document 2: JP-A-63-16114
Patent Document 3: JP-U-63-12607

SUMMARY OF THE INVENTION

Problems to be Solved by the Invention

However, in a conventional heater, it is difficult to quickly raise the temperature of the lubricating fluid while effectively keeping the mechanism of not heating the lubricating fluid excessively. For example, in the Patent Document 1, there is described a lubricant oil antifreeze structure, where a heater is stored in a shell to indirectly heat the lubricant oil. In the antifreeze structure described in the Patent Document 1, since the lubricant oil is indirectly heated, deterioration of the lubricant oil can be inhibited. However, in the antifreeze structure described in the Patent Document 1, since the heater is stored in a shell, quick temperature rise of the lubricant oil is considered to be difficult.

In addition, in the Patent Document 2, there is described an engine oil heating apparatus provided with a heat release fin which does not generate heat by itself. In the Patent Document 3, there is described an oil heater provided with a heat release member which does not generate heat by itself. By providing a heater with a heat release member or the like as in the Patent Documents 2 and 3, the heat transfer area (In other word, heat exchange area) of the heater can be increased. However, since the heat release fin and the heat release member attached to the heater do not generate heat by themselves, quick temperature rise of the lubricant oil is considered to be difficult.

In order to intentionally realize quick temperature rise even in such a state, the size of the heater has to be increased. However, in automobiles and the like, there is a spatial restriction inside a vehicle, and it is difficult to use a large-sized heater as a heating apparatus for the engine. Therefore, there has been desired development of a small-sized heater capable of quick temperature rise.

In such a heater, it is necessary to take a measure of insulation from a pipe where the lubricant oil flows and the like. That is, in such a heater, since an electric current is applied in order to generate heat in the heater, it is necessary to take a measure lest the electric current should pass through the pipe and the like. Upon disposing a heater in the pipe where the lubricant oil flows, it is necessary to take an adiabatic measure lest the heat generated by the heater should escape outside.

The present invention has been made in view of the aforementioned problem and provides a small-sized heater capable of quick temperature rise of the lubricating fluid such as engine oil and a transmission fluid.

Means to Solve the Problems

In order to solve the aforementioned problem, the present invention provides the following heater.

According to a first aspect of the resent invention, a heater comprising: a heater main body, a housing storing the heater main body therein, and a coating material arranged in at least a part between the heater main body and the housing and covering at least a part of the heater main body is provided; wherein the coating material is a material containing at least one of ceramic and glass, the heater main body has a cylindrical honeycomb structural portion having partition walls separating and forming a plurality of cells extending from one end face to the other end face and functioning as passages for a lubricating fluid and a pair of electrode portions disposed on a side face of the honeycomb structural portion, the housing has an inflow port from which the lubricating fluid flows in and the outflow port from which the lubricating fluid having passed through the cells formed in the heater main body flows out and contains the heater main body so as to cover the side face side of the heater main body, and the partition walls of the honeycomb structural portion are of a material containing ceramic as the main component and generate heat by energization.

According to a second aspect of the present invention, the heater according to the first aspect is provided, wherein the coating material is disposed at least between the heater main body and the housing on the one end face side of the heater main body and between the heater main body and the housing on the other end face side of the heater main body.

According to a third aspect of the present invention, the heater according to the second aspect is provided, wherein the coating material is a material where the material containing at least one of ceramic and glass is coated on at least a part of the surface of the heater main body.

According to a fourth aspect of the present invention, the heater according to any one of the first to third aspects is provided, where the partition walls contain as a main component one kind selected from the group consisting of SiC, metal-impregnated SiC, metal composite SiC, and metal composite $Si_3N_4$.

According to a fifth aspect of the present invention, the heater according to any one of the first to fourth aspects is provided, where a part of the pair of electrode portions passes through the housing and is extended to the outside of the housing, and the coating material is disposed at least between the pair of electrode portions and the housing in the portion where the pair of electrode portions pass through the housing.

According to a sixth aspect of the present invention, the heater according to any one of the first to fifth aspects is provided, where the coating material is disposed between the heater main body and the housing so as to cover at least the entire region of the pair of electrode portions disposed on the heater main body.

According to a seventh aspect of the present invention, the heater according to any one of the first to sixth aspects is provided, wherein each of the pair of electrode portions is composed of an electrode substrate disposed on the side face of the honeycomb structural portion and a rod-shaped electrode portion disposed so as to be connected to the electrode substrate.

According to an eighth aspect of the present invention, the heater according to any one of the first to seventh aspects is provided, wherein the material for the housing is metal or resin.

According to a ninth aspect of the present invention, the heater according to any one of the first to eighth aspects is provided, wherein an adiabatic material is disposed between the heater main body and the housing inside the housing.

According to a tenth aspect of the present invention, the heater according to any one of the first to ninth aspects is provided, wherein the specific resistance of the coating material is $10^6$ Ω·cm or more.

Effect of the Invention

A heater of the present invention is provided with a heater main body, a housing storing the heater main body therein, and a coating material covering at least a part of the heater main body. In a heater of the present invention, the coating material is a material containing at least one of ceramic and glass. In addition, the heater main body has a cylindrical honeycomb structural portion having partition walls separating and forming a plurality of cells extending from one end face to the other end face and functioning as passages for a lubricating fluid and a pair of electrode portions disposed on a side face of the honeycomb structural portion. The housing has an inflow port from which the lubricating fluid flows in and the outflow port from which the lubricating fluid having passed through the cells formed in the heater main body flows out. The housing stores the heater main body so as to cover the side face side of the heater main body. In a heater of the present invention, the partition walls of the honeycomb structural portion are of a material containing ceramic as the main component and produce heat by energization.

According to a heater of the present invention, temperature of the lubricating fluid can quickly be raised without excessively heating the lubricating fluid. In addition, even in the case that the size of the heater is small, the temperature of the lubricating fluid can quickly be raised.

Further, since a coating material is arranged so as to cover at least a part of the heater main body in at least a part between the heater main body and the housing, electric insulation between the heater main body and the housing can be obtained. In addition, the coating material functions also as a sealing layer between the heater main body and the housing. This enables to improve sealability between the heater main body and the housing. For example, by disposing the coating material, it plays a role of inhibiting the lubricating fluid as the target to be heated from leaking into the gap between the heater main body and the housing. Further, the aforementioned coating material functions also as an adiabatic layer of the heater main body. This enables to improve adiabaticity of the heater. For example, by disposing the aforementioned coating material, heat release to outside the housing carl be inhibited when heat is generated in the heater main body.

DETAILED DESCRIPTION OF THE INVENTION

Hereinbelow, embodiments of the present invention will be described with referring to drawings. The present invention is not limited to the following embodiments, and changes, modifications, and improvements may be added as long as they do not deviate from the scope of the present invention.

(1) Heater:

One embodiment of a heater of the present invention is the heater 100 as shown in FIGS. 1 to 5. The heater 100 of the present embodiment is provided with a heater main body 50, a housing 51 storing the heater main body 50 therein, and a coating material 52 disposed in at least a part between the heater main body 50 and housing 51 to cover at least a part of the heater main body 50. In the heater 100 of the present embodiment, the coating material 52 is of a material containing at least one of ceramic and glass.

Figure 1:
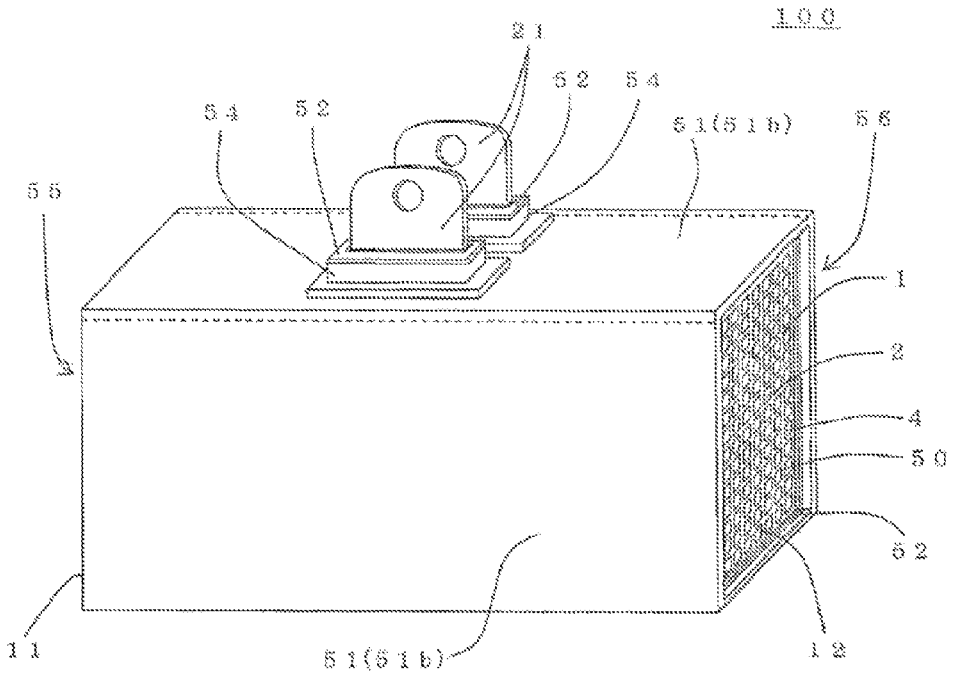
FIG. 1 is a perspective view schematically showing an embodiment of a heater of the present invention.
Figure 2:
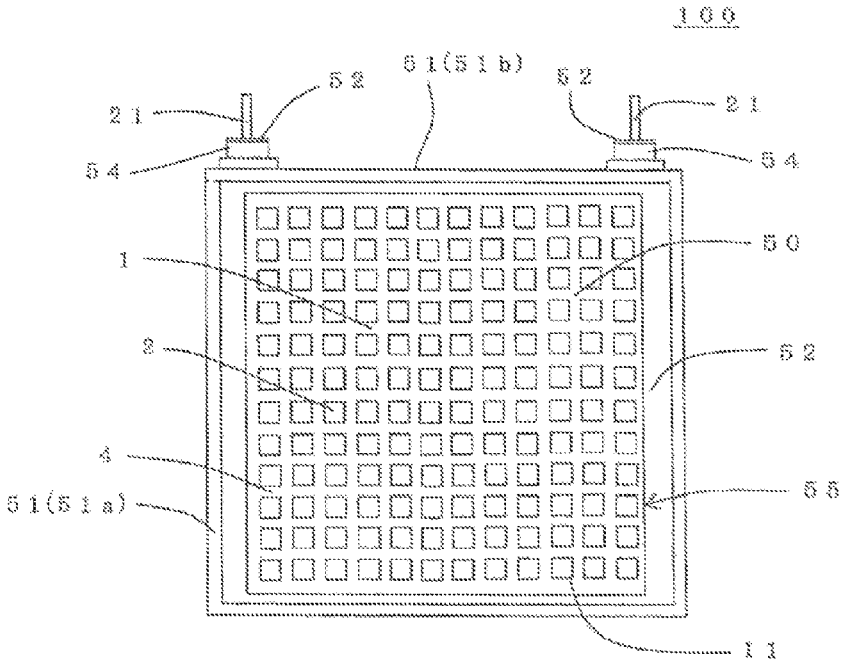
FIG. 2 is a plan view schematically showing an end face of the heater shown in FIG. 1.
Figure 3:
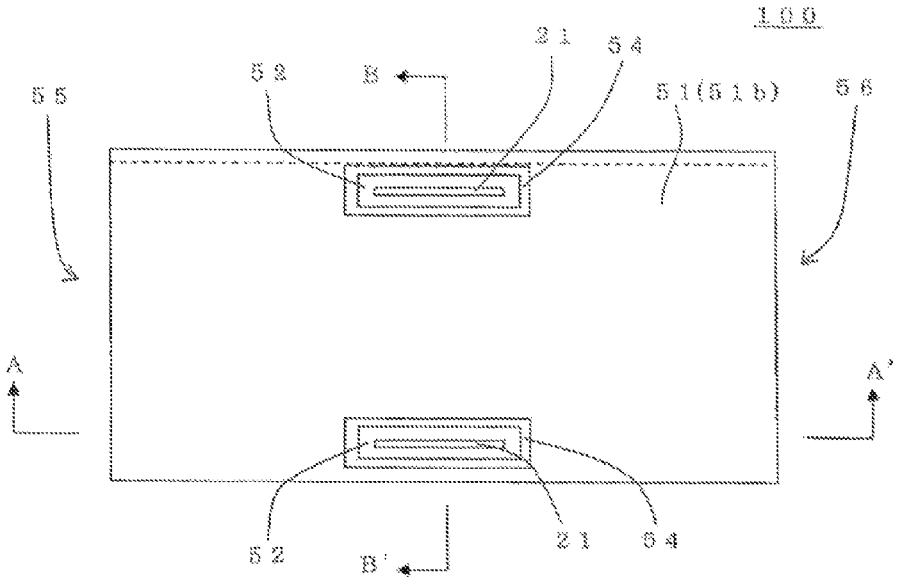
FIG. 3 is a plan view schematically showing a top face of the heater shown in FIG. 1.
Figure 4:
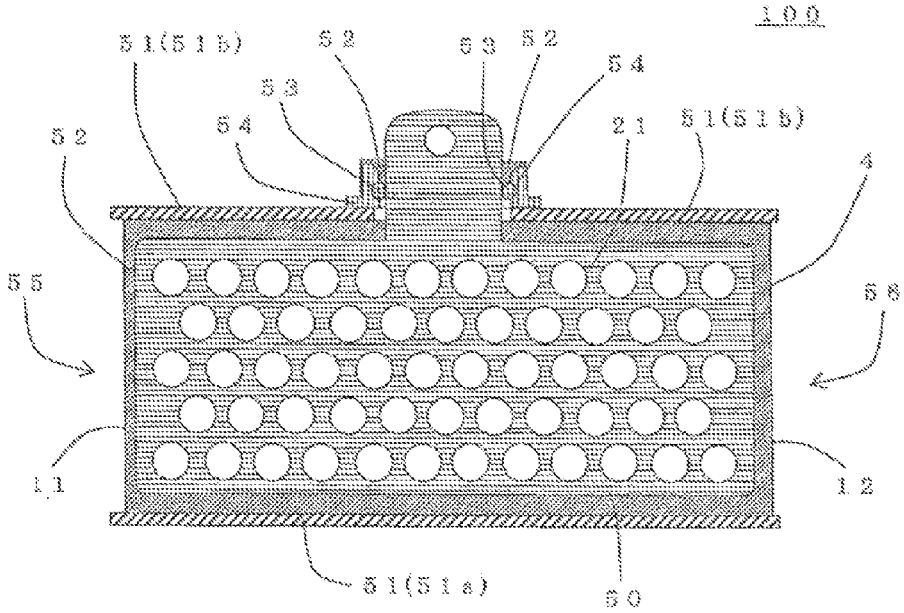
FIG. 4 is a cross-sectional view schematically showing the A-A' cross section of FIG. 3.
Figure 5:
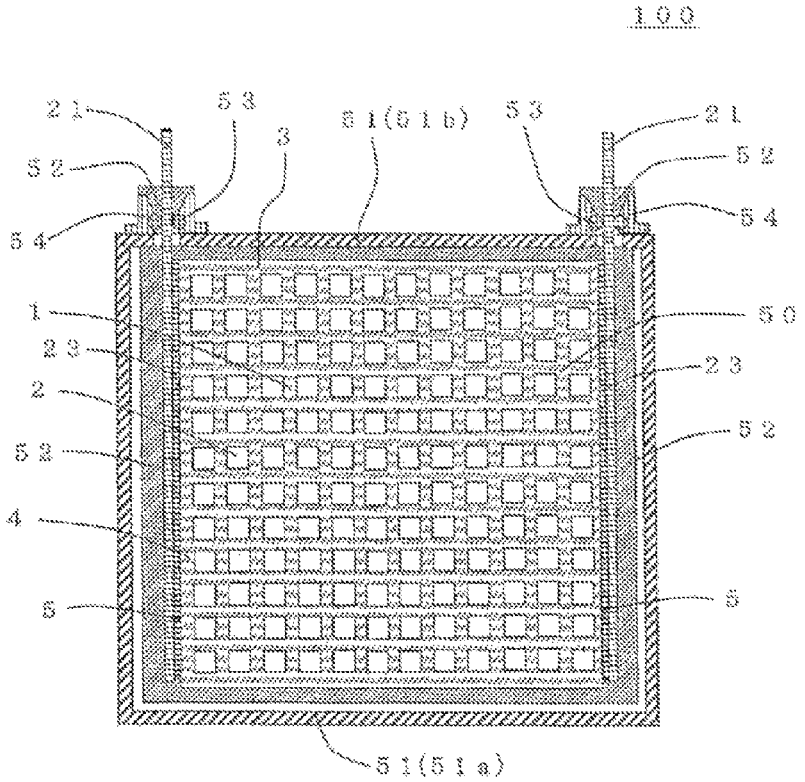
FIG. 5 is a cross-sectional view schematically showing the B-B' cross section of FIG. 3.

Here, FIG. 1 is a perspective view schematically showing an embodiment of a heater of the present invention. FIG. 2 is a plan view schematically showing an end face of the heater shown in FIG. 1. FIG. 3 is a plan view schematically showing a top face of the heater shown in FIG. 1. FIG. 4 is a cross-sectional view schematically showing the A-A' cross section of FIG. 3. FIG. 5 is a cross-sectional view schematically showing the B-B' cross section of FIG. 3.

Figure 6:
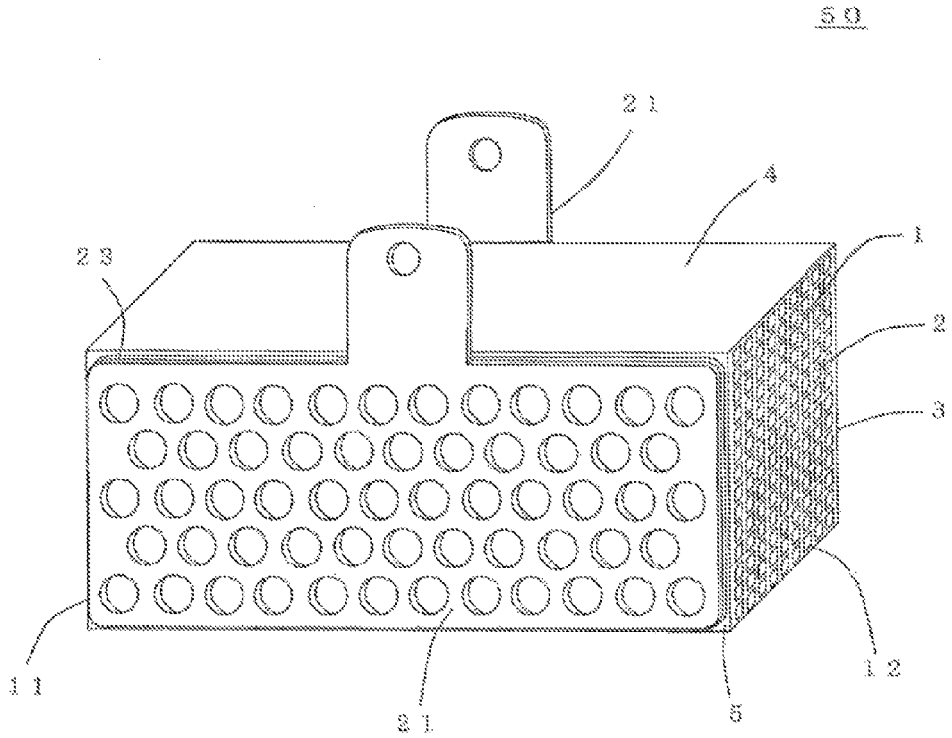
FIG. 6 is a perspective view schematically showing a heater main body of the heater shown in FIG. 1.
Figure 7:
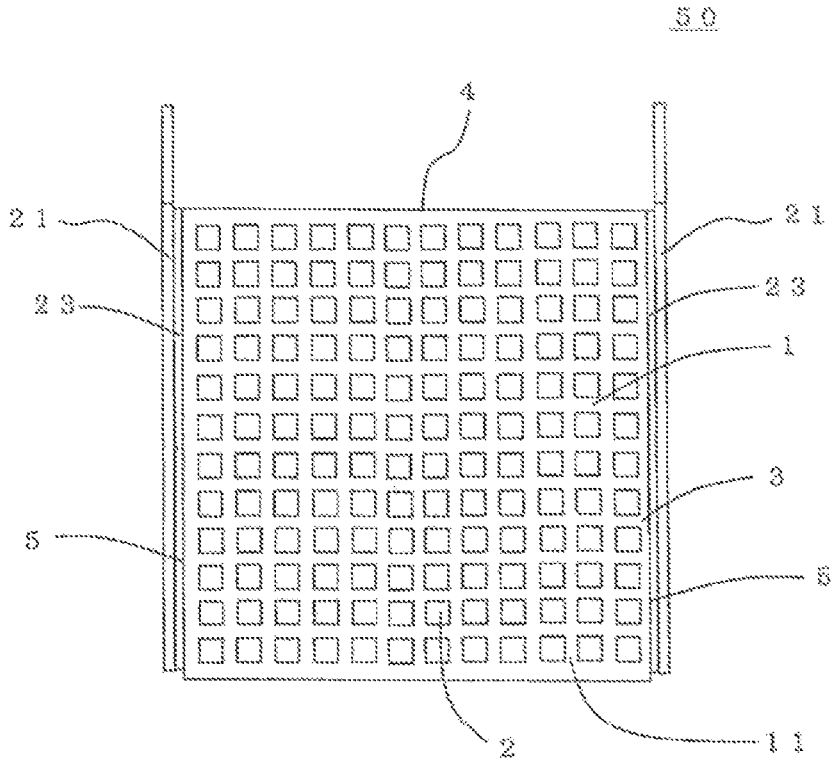
FIG. 7 is a plan view schematically showing an end face of the heater main body shown in FIG. 6.

The heater main body 50 of the heater 100 of the present embodiment is like that shown in FIGS. 6 and 7. Here, FIG. 6 is a perspective view schematically showing the heater main body of the heater shown in FIG. 1. FIG. 7 is a plan view schematically showing an end face of the heater main body shown in FIG. 6.

As shown in FIGS. 6 and 7, the heater main body 50 has a cylindrical honeycomb structural portion 4 and a pair of electrode portions 21. The cylindrical honeycomb structural portion 4 has partition walls 1 separating and forming a plurality of cells 2 extending over from one end face 11 to the other end face 12 and serving as passages for the lubricating fluid. A pair of electrode portions 21 are disposed on the side faces 5 of the honeycomb structural portion 4. The partition walls 1 of the honeycomb structural portion 4 are made of a material containing ceramic as the main component. The partition walls 1 generate heat by energization. That is, in the heater 100 of the present embodiment, the partition walls 1 of the honeycomb structural portion 4 function as a heating element for heating a lubricating fluid.

In addition, as shown in FIGS. 1 to 5, a housing 51 of the heater 100 of the present embodiment stores the heater main body 50 therein in such a manner that the side face side of the heater main body 50 is covered. The housing 51 has an inflow port 55 where the lubricating fluid flows in and the outflow port 56 from which the lubricating fluid having passed through the cells 2 formed in the heater main body 50 flows out and contains the heater main body. The housing 51 of the heater 100 of the present embodiment is constituted of the housing main body 51*a* having an opening portion on one face and lid portion 51*b* for covering the opening portion of the housing main body 51*a*. By disposing the heater main body 50 inside the housing main body 51*a* and then disposing the lid portion 51*b* on the housing main body 51*a*, the heater main body 50 is stored in the housing 51.

According to such a heater 100 of the present embodiment, temperature of the lubricating fluid can be raised quickly without excessively heating the lubricating fluid. In addition, even in the case that the heater 100 has a small size, temperature of the lubricating fluid can be raised quickly. That is, as described above, in the heater 100 of the present embodiment, the partition walls 1 themselves generate heat by energization. Therefore, during the process where the lubricating fluid passes through the cells 2, the lubricating fluid can be heated continuously by the partition walls 1.

For example, in a heater where the partition walls of the honeycomb structural portion do not generate heat by themselves and where the honeycomb structural portion is heated by another heat source, good heating of the lubricating fluid is difficult. That is, in a process of heating the lubricating fluid by a heater, heat exchange is performed between the lubricating fluid passing through the cells and the partition walls. In the heater where the partition walls do not generate heat by themselves, heating of the partition walls by another heat source cannot keep up, and quick temperature rise of the lubricating fluid is difficult. In addition, in a heater where the partition walls do not generate heat by themselves, increasing heat transferred to the partition walls by increasing the size of another heat source can be considered. However, in such a method, the size of the entire heater is increased. In an automobile and the like, there is a spatial restriction in the vehicle, and it is difficult to use a large-sized heater as a heating apparatus for an engine.

Since the honeycomb structural portion 4 has a honeycomb structure having partition walls 1 separating and forming a plurality of cells 2, the contact area with the lubricating fluid can be made large. Therefore, the lubricating fluid passing through the cells 2 can be heated in a good manner, and temperature of the lubricating fluid can be raised quickly. That is, in a heater 100 of the present embodiment, the lubricating fluid flowing into the heater is separated into small portions, and the lubricating fluid separated into small portions flows through each cell 2. When the lubricating fluid is thus separated into small portions, the contact area of the partition walls 1 with the lubricating fluid becomes large. According to this, the amount of heat transfer due to the contact of the lubricating fluid with the partition walls 1 increases. Further, when the amount of heat transfer between the partition walls 1 and the lubricating fluid increases, the heat transfer amount becomes larger than the amount of heat dissipating by the thermal diffusion in the lubricating fluid. Therefore, the temperature of the lubricating fluid is more quickly be raised.

In addition, in the heater 100 of the present embodiment, even in the case of reducing the heat generation amount per unit area of the partition walls 1, the temperature of the lubricating fluid can securely be raised. This is because the heater 100 of the present embodiment can heat the lubricating fluid continuously in the passages constituted of the cells 2. When the heat generation amount per unit area of the partition walls 1 is reduced, it is possible to inhibit the lubricating fluid from being heated excessively. Therefore, in the heater 100 of the present embodiment, the temperature of the lubricating fluid can be raised quickly without excessively heating the lubricating fluid. In addition, since the lubricating fluid is not heated excessively, deterioration of the lubricating fluid can effectively be inhibited.

Further, in the heater 100 of the present embodiment, a coating material 52 is disposed in at least a part between the heater main body 50 and the housing 51. In the heater 100 of the present embodiment, the coating material 52 is made of a material containing at least one of ceramic and glass. Therefore, electrical insulation between the heater main body 50 and the housing 51 can be obtained. In addition, the aforementioned coating material 52 functions also as a sealing layer of the heater main body 50 and the housing 51. This enables to improve sealability between the heater main body 50 and the housing 51. For example, by disposing the aforementioned coating material 52, it plays a role of inhibiting the lubricating fluid, which is a target of heating, from leaking into the gap between the heater main body 50 and the housing 51. Further, the aforementioned coating material 52 functions also as an adiabatic layer of the heater main body 50. This enables to improve adiabaticity of the heater 100. For example, by disposing the aforementioned coating material 52, when the heater main body 50 generates heat, heat release to the outside of the housing 51 can be inhibited.

In the present specification, the "lubricating fluid" means a collective term of fluids used for lubrication of mechanical parts. Examples of the fluids used for lubrication of mechanical parts include engine oil, transmission fluid, gear oil, differential oil, brake fluid, and power steering fluid.

The heater of the present embodiment can be used as, for example, a heater for heating a lubricating fluid such as engine oil and transmission fluid for an automobile. Generally, in the case of driving an automobile in winter or in cold climates, the aforementioned lubricating fluid tends to have low temperature. When the lubricating fluid is in a low temperature state, the viscosity becomes high. As a result, regarding the engine and the transmission, operation time increases with the friction caused in the parts remaining large. When the engine and the transmission are operated in such a state, deterioration in gasoline mileage is caused.

When the heater of the present embodiment is used, the temperature of the engine oil and the transmission fluid can be raised quickly. This enables to shorten the time of keeping the engine oil and transmission fluid at low temperature. As a result, gasoline mileage of the automobile can be improved.

In addition, generally, the transmission fluid contributes to deterioration of gasoline mileage more than the engine oil. In a conventional heater, a large-sized heater has to be used in order to sufficiently heat a transmission fluid. In the heater of the present embodiment, also in the case of downsizing the heater, the transmission fluid can be heated sufficiently. This enables to further improve gasoline mileage of an automobile. Thus, a heater of the present embodiment exhibits the effect sufficiently in the case that the space for mounting the heater is limited like an automobile.

Hereinbelow, the heater of the present embodiment will be described in more detail with respect to each constituent.

(1-1) Heater Main Body:

As shown in FIGS. 6 and 7, the heater main body has a cylindrical honeycomb structural portion 4 and a pair of electrode portions 21. The cylindrical honeycomb structural portion 4 has the partition walls 1 separating and forming a plurality of cells 2 functioning as passages for the lubricating fluid and extending over from one end portion 11 to the other end portion 12. In the heater main body, a pair of electrode portions 21 are arranged on the side face 5 of the honeycomb structural portion 4.

The honeycomb structural portion 4 may further have an outer peripheral wall 3 disposed in the outermost periphery so as to surround the partition walls 1. FIGS. 6 and 7 show an example of a case that the honeycomb structural portion 4 further has the outer peripheral wall 3. The pair of electrode portions 21 are disposed on the side face 5 of the honeycomb structural portion 4 constituted of the outer peripheral wall 3. The partition walls 1 and the outer peripheral wall 3 may be made of the same material or different materials.

The partition walls 1 are made of a material containing ceramic as the main component. Here, in the present specification, "containing ceramic as the main component" means containing ceramic at 50 mass % or more. That is, the partition walls made of a material containing ceramic as the main component means the partition walls containing ceramic at 50 mass % or more. As the "ceramic which generates heat by energization" usable for the honeycomb structural portion of the present embodiment, there can be mentioned SiC, metal-impregnated SiC, metal composite SiC, metal composite $Si_3N_4$, and the like.

In the heater of the present embodiment, the specific resistance of the partition walls is preferably 0.01 to 50 Ω·cm. In the heater of the present embodiment, the specific resistance of the partition walls is more preferably 0.03 to 10 Ω·cm, particularly preferably 0.07 to 5 Ω·cm. By specifying the specific resistance of the partition walls to the aforementioned numerical range, there can be obtained a heater capable of quickly raising temperature of the lubricating fluid such as engine oil and transmission fluid. In addition, it can sufficiently cope with downsizing of the honeycomb structural portion.

In the aforementioned SiC, recrystallized SiC and reaction-sintered SiC are included. The recrystallized SiC can be manufactured, for example, as follows. In the first place, a raw material containing a SiC powder, an organic binder, and "water or an organic solvent." is mixed together and kneaded to prepare a kneaded material. Next, the kneaded material is formed to produce a formed body. Next, the formed body is fired at 1600 to 2300° C. in an inert gas atmosphere to obtain a fired body. It is "recrystallized SiC". The fired body becomes mainly porous. The specific resistance of the recrystallized SiC can be changed by changing the raw material, the particle diameter, the impurity amount, and the like. For example, by dissolving an impurity in SiC, the specific resistance can be changed. Specifically, by firing in a nitrogen atmosphere, nitrogen is dissolved in SiC to be able to lower the specific resistance of recrystallized SiC.

The reaction-sintered SiC is SiC generated by the use of a reaction between raw materials. As the reaction-sintered SiC, there can be mentioned porous reaction-sintered SiC and dense reaction-sintered SiC. The porous reaction-sintered SiC is manufactured, for example, as follows. In the first place, a silicon nitride powder, a carbonaceous substance, silicon carbide, and a graphite powder are mixed together and kneaded to prepare a kneaded material. Incidentally, the carbonaceous substance is a substance reducing silicon nitride. As the carbonaceous substance, there may be mentioned solid carbon powders of carbon black, acetylene black, or the like and resins of phenol, furan, polyimide, or the like. Next, the kneaded material is formed to produce a formed body. Next, the formed body is subjected to primary firing in a non-oxidizing atmosphere to obtain a primary fired body. Next, by heating the primary fired body in the oxidizing atmosphere for decarburization, remaining graphite is removed. Next, in the non-oxidizing atmosphere, the "decarburized primary fired body" is subjected to secondary firing at 1600 to 2500°

C. to obtain a secondary fired body. The body obtained in such a manner is "porous reaction-sintered SiC".

The dense reaction-sintered SiC is manufactured, for example, as follows. In the first place, a SiC powder and a graphite powder are mixed together and kneaded to prepare a kneaded material. Next, the kneaded material is formed to produce a formed body. Then, the formed body is impregnated with "melted silicon (Si)". This causes reaction of carbon constituting graphite with the silicon used for impregnation to generate SiC. As described above, by "impregnating" the formed body with "melted silicon (Si)", the pores easily disappear. That is, the pores are easily filled. Therefore, a dense formed body can be obtained. The body obtained in such a manner is "dense reaction-sintered SiC".

As the aforementioned "metal-impregnated SiC", there can be mentioned Si-impregnated SiC, SiC impregnated with metal Si and another kind of metal, and the like. Examples of the aforementioned "another kind of metal" include Al, Ni, Cu, Ag, Be, Mg, and Ti. In the case that the partition walls are made of a material containing the aforementioned "metal-impregnated SiC" as the main component, the partition walls are excellent in thermal resistance, thermal shock resistance, oxidation resistance, and corrosion resistance. The "corrosion resistance" means resistance against corrosion action caused by acid or alkali.

As the metal-impregnated SiC, for example, there can be mentioned a porous body mainly containing SiC particles and impregnated with a melted metal. Therefore, metal-impregnated SiC forms a dense body having a relatively small number of pores.

The "Si-impregnated SiC" is a concept for collectively referring to sintered bodies containing metal Si and SiC as constituent components. The metal Si means metal silicon. In the Si-impregnated SiC, coagulations of metal Si surround the surfaces of the SiC particles. By this, the Si-impregnated SiC has a structure where a plurality of SiC particles are bonded to one another by means of metal Si.

The "SiC impregnated with metal Si and another kind of metal" is a concept for collectively referring to sintered bodies containing metal Si, another kind of metal, and SiC as the constituent components. In SiC impregnated with metal Si and another kind of metal, metal Si coagulations and coagulations of another kind of metal surround the surfaces of the SiC particles. By this, the SiC impregnated with metal Si and another kind of metal has a structure where a plurality of SiC particles are bonded to one another by means of metal Si and another kind of metal.

When the partition walls are made of a material containing metal-impregnated SiC as the main component, by adjusting the amount of the metal with which the SiC is impregnated, the specific resistance of the partition walls can be adjusted. When the partition walls are made of a material containing metal-impregnated SiC as the main component, generally, as the amount of the metal with which the SiC is impregnated increases, the specific resistance of the partition walls decreases.

As the aforementioned "metal composite SiC", there can be mentioned Si composite SiC, SiC where metal Si and another kind of metal are subjected to combined sintering, and the like. Examples of the aforementioned "another kind of metal" include Al, Ni, Cu, Ag, Be, Mg, and Ti.

As the metal composite Sic, there can be mentioned SiC obtained by subjecting SiC particles and a metal powder to mix sintering. When SiC particles and a metal powder are mix-sintered, sintering proceeds at the contact point where the SiC particle and the metal powder are brought into contact with each other. Therefore, the metal composite SiC forms a porous body having relatively many pores formed therein. In the metal composite SiC, the pores of the porous body are formed while having a structure where SiC particles are connected to one another by means of a metal phase made of a metal powder. For example, the Si composite SiC has a structure where SiC particles are connected to one another by means of metal Si while forming pores in a form where a metal Si phase is connected to the surface of the SiC particle. Also in SiC where metal Si and another kind of metal are subjected to combined sintering, the same structure as that of the aforementioned metal composite SiC is employed.

When the partition walls are made of a material containing metal composite SiC as the main component, by adjusting the amount of metal to be compounded and the components, the specific resistance of the partition walls can be adjusted. When the partition walls are made of a material containing metal composite SiC as the main component, generally, as the amount of metal to be compounded increases, the specific resistance of the partition walls decreases.

In the heater of the present embodiment, the amount of heat generation per unit surface area of the partition walls depends on the size of the honeycomb structural portion, specific resistance of the partition walls, thickness of the partition walls, and the cell density. For example, in the case that the size of the honeycomb structural portion is limited, by adjusting the thickness of the partition walls and the cell density, the amount of heat generation per unit surface area of the partition walls can be adjusted. This enables to obtain a heater which does not heat a lubricating fluid excessively. In addition, in the case that there is enough space for disposing a heater, the amount of heat generation of a heater can be adjusted by adjusting the size of the honeycomb structural portion. The size of the honeycomb structural portion means the length in the cell extension direction of the honeycomb structural portion and the size of a cross section perpendicular to the cell extension direction of the honeycomb structural portion. Hereinbelow, the "length in the cell extension direction of the honeycomb structural portion" may be referred to simply as the "length of the honeycomb structural portion". In addition, the "size of a cross section perpendicular to the cell extension direction of the honeycomb structural portion" may be referred to simply as the "size of a cross section of the honeycomb structural portion".

For example, when the length of the honeycomb structural portion can be increased, the distance of heating a lubricating fluid can be increased. This enables to heat a lubricating fluid in a good manner. In addition, in the case that a lubricating fluid can be heated sufficiently by increasing the length of the honeycomb structural portion, the specific resistance of the partition walls may be reduced relatively.

On the other hand, in the case that the length of the honeycomb structural portion or the size of the cross section is restricted, it is preferable to adjust the specific resistance of the partition walls, thickness of the partition walls, cell density, and the like to adjust the amount of heat generation per unit surface area of the partition walls.

For example, by adjusting the porosity of the partition walls, the specific resistance of the partition walls can be adjusted. Generally, as the porosity of the partition walls decreases, the specific resistance of the partition walls decreases.

In addition, depending on the main component of the partition walls, the preferable range of the porosity of the partition walls is different. For example, when metal composite SiC is the main component, the porosity of the partition walls is preferably 30 to 90%. In addition, when metal composite SiC is the main component, many open pores are present in the partition walls, and the pores become large. In the partition walls containing metal composite SiC as the main component, many communicating pores communicating between adjacent cells are present. Therefore, by the communicating pores, a lubricating fluid can pass through the inside of the partition walls. Therefore, the contact area between the partition walls and the lubricating fluid is increased. Subsequently, a heater provided with a honeycomb structural portion having partition walls containing metal composite SiC as the main component has improved heating efficiency (i.e., heat exchange efficiency). Incidentally, the heating efficiency can be expressed by the "conversion efficiency" described later. On the other hand, for example, when metal-impregnated SiC is employed as the main component, the porosity of the partition walls is preferably 0 to 10%. In addition, when a metal-impregnated SiC is employed as the main component, pores of the partition walls become small, and open pores are reduced. Therefore, a lubricating fluid hardly enters the partition walls containing metal-impregnated SiC as the main component. Therefore, the lubricating fluid which stays in the pores of the partition walls and stops flowing is reduced. From the above, in the case of the partition walls containing metal-impregnated SiC as the main component, deterioration due to a superheated lubricating fluid can be inhibited. In addition, since there is no pore communicating the cells with one another, the lubricating fluid does not pass through the inside of the partition walls. Therefore, the lubricating fluid can be allowed to pass only through the cells.

In addition, the specific resistance of the partition walls can be adjusted also by the kind and purity (amount of impurities) of the SiC used as the material for the partition walls. As the kind of the SiC, there can be mentioned α-SiC, β-SiC, and the like. It is also possible to adjust the specific resistance of the partition walls by adjusting the mixture fraction of α-SiC or β-SiC.

In addition, also by the amount of impurities in metal contained in the material for the partition walls, the specific resistance of the partition walls is changed. As the metal contained in the material used as the main component, an alloy may be used. In addition, the aforementioned metal can be alloyed when the honeycomb structural portion is manufactured. By such a method, the specific resistance of the partition walls can be changed.

In a heater of the present embodiment, the thickness of the partition walls is preferably 0.1 to 0.51 mm. In addition, the cell density of the honeycomb structural portion is preferably 15 to 280 cells/cm$^2$. By the use of a honeycomb structural portion constituted in such a manner, the temperature of the lubricating fluid can be raised quickly without excessively heating the lubricating fluid. In the heater of the present embodiment, it is more preferable that the thickness of the partition walls is 0.1 to 0.51 mm and that the cell density of the honeycomb structural portion is 15 to 280 cells/cm$^2$.

In addition, in the heater of the present embodiment, it is furthermore preferable that the thickness of the partition walls is 0.25 to 0.51 mm and that the cell density is 15 to 62 cells/cm$^2$. It is particularly preferable that the thickness of the partition walls is 0.30 to 0.38 mm and that the cell density is 23 to 54 cells/cm$^2$. By the use of a honeycomb structural portion constituted in such a manner, the pressure loss at the time that the lubricating fluid passes through the cells can be reduced.

It is preferable that the heater main body has an insulation layer having a dielectric breakdown strength of 10 to 1000 V/μm on the surfaces of the partition walls of the honeycomb structural portion. The dielectric breakdown strength of the insulation layer is more preferably 100 to 1000 V/μm. The lubricating fluid sometimes contains a metal abrasion powder generated from parts and/or water. In particular, though most of the metal abrasion powder is removed by an oil filter or the like, a residue remains in the lubricating fluid without being removed. Therefore, by the use of the heater for a long period of time, the residue of the metal abrasion powder without being removed adheres to the partition walls or deposits, which may cause clogging. In such a case, the heater may cause short circuit. When the heater has an electrical insulation layer (hereinbelow sometimes referred to simply as "insulation properties") having a dielectric breakdown strength of 10 to 1000 V/μm on the surfaces of the partition walls of the honeycomb structural portion, there can be inhibited the short circuit of the heater due to clogging by adhesion/deposition of the metal abrasion powder contained in the lubricating fluid to/on the partition walls.

As the aforementioned insulation layer, there can be mentioned an oxidized membrane formed by the oxidation of a ceramic component contained in the partition walls. Such an oxidized membrane can be formed by a treatment at high temperature in an oxidation atmosphere.

The insulation layer may be a ceramic coat layer, $SiO_2$ based glass coat layer, or a coat layer of a mixture of ceramic and "$SiO_2$ based glass".

As the ceramic coat layer, there can be mentioned a layer containing an oxide such as $Al_2O_3$, MgO, $ZrO_2$, $TiO_2$, or $CeO_2$ as the main component or a nitride as the main component. Between the "layer containing an oxide as the main component" and the "layer containing a nitride as the main component", the "layer containing an oxide as the main component" has higher stability in the atmosphere. On the other hand, the "layer containing a nitride as the main component" is more excellent in thermal conductivity. As the $SiO_2$ based glass coat layer, there can be mentioned a layer containing $SiO_2$ as the main component. As the coat layer of a mixture of ceramic and $SiO_2$ based glass, there can be mentioned a layer containing a mixture of $SiO_2$ and a "component such as $Al_2O_3$, MgO, $ZrO_2$, $TiO_2$, or $CeO_2$" as the main component. Incidentally, the constituent of the insulation layer can suitably be selected according to the required value of voltage resistance.

For forming a ceramic coat layer, a $SiO_2$ based glass coat layer, or a coat layer of a mixture of ceramic and $SiO_2$ based glass, a wet method or a dry method may be employed.

As a wet method, there may be mentioned a method where a honeycomb sintered body is immersed in one of slurry for forming an insulation layer, colloid for forming an insulation layer, and solution for forming an insulation layer, and a surplus is removed, followed by drying and then firing.

For example, in the case of forming an "insulation layer containing an oxide as the main component", as the slurry for forming an insulation layer and the colloid for forming an insulation layer, there may be employed slurry/colloid containing a metal source of Al, Mg, Si, Zr, Ti, Ce, or the like, or an oxide thereof. The "insulation layer containing an oxide as the main component" means an insulation layer containing $Al_2O_3$, MgO, $SiO_2$, $ZrO_2$, $TiO_2$, $CeO_2$, or the like as the main component. In addition, as the solution for forming an insulation layer, there may be employed a metal alkoxide solution of $Al(OC_3H_7)_3$, $Si(OC_2H_5)_4$, or the like. The sintering temperature in the wet method can appropriately be determined according to the main component. The sintering temperature in the wet method is preferably 1100 to 1200° C. in the case of, for example, an insulation layer containing $SiO_2$ as the main component. In addition, in the case of an insulation layer containing $Al_2O_3$ as the main component, the temperature is preferably 1300 to 1400° C.

In the case that the "insulation layer containing a nitride as the main component" is formed, a honeycomb formed body is immersed in one of slurry for forming an insulation layer, colloid for forming an insulation layer, and solution for forming an insulation layer, and then a surplus is removed, followed by drying. Then, nitridation is performed in a reduction atmosphere containing nitrogen or ammonia. Thus, an insulation layer containing a nitride as the main component can be formed. As the nitride, there can be mentioned AlN, $Si_3N_4$, or the like, which has high thermal conductivity while having insulation properties.

As a dry method, there can be mentioned an electrostatic spray method or the like. Forming of an insulation layer by an electrostatic spray method can be performed, for example, as follows. A voltage is applied to a powder of an insulating substance (insulating particles) or "slurry containing insulating particles" to charge it negatively (or positively). Then, to the positively (or negatively) charged honeycomb structural portion, charged "insulating particles or slurry containing insulating particles" are/is sprayed. Thus, an insulation layer is formed.

The thickness of the insulation layer can appropriately be determined according to the desired voltage resistance. When the insulation layer is thick, thermal resistance is large for heating the lubricating fluid though the insulation properties become high. This is because the thermal conductivity of the insulation layer tends to be lower than that of the partition walls. Further, the pressure loss of the heater becomes large. Therefore, the insulation layer is preferably thin in the range where the insulation properties can be secured. Specifically, it is preferable that the insulation layer is thinner than the partition wall. More specifically, though it depends on the dielectric breakdown strength of each material, the thickness of the insulation layer is preferably 10 μm or less, more preferably 5 μm or less, particularly preferably 3 μm or less. When the thickness of the insulation layer has an aforementioned value, increase in pressure loss of the honeycomb structural portion can be inhibited while keeping the thermal resistance low. Thickness of the insulation layer means the average thickness of the insulation layer. The thickness of the insulation layer is a value measured by observation with an optical microscope or an electron microscope by the use of a cross section sample. Here, the "cross section sample" means a sample obtained by cutting out a part of the heater main body and having a cross-sectional face perpendicular to the wall face of the partition wall. For example, in order to form an oxidized membrane having an aforementioned thickness in the case that the insulation layer is an oxidized membrane, the firing temperature is preferably 1200 to 1400° C. Forming of the oxidation membrane by firing in a water vapor atmosphere is also a preferable method. Further, by adjusting the firing time, thickness of the oxidized membrane can be adjusted. The longer the firing time is, the thicker the oxidized membrane becomes.

Further, in the heater of the present embodiment, an oxidized membrane is formed on the surfaces of the partition walls by the generation of $SiO_2$ due to oxidation of SiC. When an oxidized membrane is formed on the surfaces of the partition walls, a high temperature treatment is performed in an oxidation atmosphere like air. In order that the surfaces of the partition walls have insulation properties like the honeycomb structural portion with which the heater of the present embodiment is provided, an oxidized membrane can be formed on the surfaces of the partition wall, for example, by performing a thermal treatment at 1200 to 1400° C. in the atmosphere.

There is no particular limitation on the shape of the honeycomb structural portion, and there may be employed, for example, a cylindrical shape having circular end faces (circular cylindrical shape), a cylindrical shape having oval end faces, and a cylindrical shape having polygonal end faces. As the polygonal shape, there may be mentioned a quadrangle, a pentagon, a hexagon, a heptagon, an octagon, and the like. FIGS. 1 to 7 show an example where the shape of the honeycomb structural portion 4 is a cylindrical shape having quadrangular end faces.

The shape of the cells 2 in a cross section perpendicular to the cell 2 extension direction is preferably a quadrangle, a hexagon, an octagon, or a combination thereof. The shape of the cells 2 in the aforementioned cross section may be circular.

The outer peripheral wall is a wall constituting the side face of the honeycomb structural portion. The outer peripheral wall may be formed together with the partition walls in the process of producing the honeycomb structural portion. For example, the partition walls and the outer peripheral wall may be produced by extrusion at once. Needless to say, it is not necessary to form the outer peripheral wall upon extrusion. For example, the outer peripheral wall may be formed by applying a ceramic material on the outer peripheral portion of the partition walls separating and forming the cells.

The outer peripheral wall 3 is preferably made of a material containing ceramic as the main component. The outer peripheral wall 3 may be made of the same material as that for the partition walls 1 or a material different from that for the partition walls 1. As the material for the outer peripheral wall, there may be mentioned, for example, SiC, metal-impregnated SiC, metal composite SiC, and metal composite $Si_3N_4$.

It is more preferable that the outer peripheral wall of the honeycomb structural portion is thick. Thick outer peripheral wall means that the outer peripheral wall is thicker than the partition wall. When the outer peripheral wall is thick, strength of the outer peripheral wall as a structural body increases. Therefore, durability against the thermal stress upon connecting electrode portions can be improved. As a result, it becomes easy to inhibit crack generation in the outer peripheral wall. In addition, when the outer peripheral wall is thick, the thermal capacity of the outer peripheral wall increases. Therefore, temperature rise of the outer peripheral wall upon energization can be reduced. Here, the outer peripheral wall is easily superheated because of the small contact area with a lubricating fluid such as engine oil. Therefore, as described above, it is preferable to reduce temperature rise of the outer peripheral wall upon energization. In addition, in the case that resin is used in at least a part of the housing of the heater, the resin may be deteriorated and cause damage due to local superheating of the heater. Therefore, by increasing the thickness of the outer peripheral wall of the honeycomb structural portion, damage due to deterioration of the resin can be inhibited.

The thickness of the outer peripheral wall is preferably 0.3 to 5 mm, more preferably 0.5 to 3 mm, though it depends on the porosity of the outer peripheral wall.

In addition, it is more preferable that the outer peripheral wall of the honeycomb structural portion is dense. When the outer peripheral wall is dense, it can inhibit the lubricating fluid from passing through the inside of the outer peripheral wall and leaking outside the heater main body. When the heater is stored in the housing, a sealing material may be disposed in the outer periphery of the heater main body in order to inhibit the lubricating fluid from leaking out to the inside of the housing. By making the outer peripheral wall dense, the aforementioned sealing material becomes unnecessary because the lubricating fluid can be inhibited from leaking outside the heater as described above. In addition, as described above, it is general that a conventional heater is constituted lest the lubricating fluid should leak outside the heater main body. However, in the heater of the present embodiment, the lubricating fluid may be positively allowed to flow between the housing and the heater main body. That is, the lubricating fluid may be heated by the use of the outside face of the outer peripheral wall of the honeycomb structural portion by positively allowing the lubricating fluid to flow on the outside of the heater main body.

The "dense outer peripheral wall" is preferably densified by impregnation with, for example, metal. In addition, the "dense outer peripheral wall" may be formed of dense "$Al_2O_3$, MgO, $SiO_2$, $Si_3N_4$, AlN, or BN" or a composite of these.

A honeycomb structural portion having such a "dense outer peripheral wall" can be manufactured, for example, by coextruding a "material for constituting the partition walls" and a "material for constituting the outer peripheral wall" whose kind is different from that of the "material for constituting the partition walls".

In addition, the honeycomb structural portion having the "outer peripheral wall densified by impregnation of metal" is preferably formed by impregnating a dried honeycomb formed body or a fired honeycomb sintered body with metal. Incidentally, as the metal used for the impregnation, Si is preferable. In order to impregnate the aforementioned dried honeycomb formed body or fired honeycomb sintered body with metal, there is a method of impregnation with metal by adjusting the amount of metal for the impregnation (e.g., Si impregnation amount) so that only the outer peripheral wall is impregnated. Alternatively, there are a method of coating an impregnation inhibitor material on both the end faces of the dried honeycomb formed body or fired honeycomb sintered body and a method of mounting a plate-shaped jig on both the end faces. By these methods, the outer peripheral wall can preferentially be impregnated with metal. As the impregnation inhibitor material, for example, an oxide type, in particular, $Al_2O_3$ or the like can be mentioned.

The pair of electrodes 21 are electrodes for energizing the partition walls 1 of the honeycomb structural portion 4. One electrode portion 21 and the other electrode portion 21 of the pair of electrode portions 21 are disposed on the side faces 5 of the honeycomb structural portion 4 in such a manner that they hold the honeycomb structural portion 4 between them from the sides. By applying a voltage between the pair of electrode portions 21, the partition walls 1 are energized, and the honeycomb structural portion 4 generates heat.

Examples of the material for the pair of electrode portions 21 include stainless steel, copper, nickel, aluminum, molybdenum, tungsten, rhodium, cobalt, chrome, niobium, tantalum, gold, silver, platinum, palladium, and alloys of these metals. The pair of electrode portions 21 may be formed by the use of a composite material such as Cu/W composite material, Cu/Mo composite material, Ag/W composite material, SiC/Al composite material, or C/Cu composite material. The "Cu/W composite material" means a composite material of copper and tungsten. The "Cu/Mo composite material" means a composite material of copper and molybdenum. The "Ag/W composite material" means a composite material of silver and tungsten. The "SiC/Al composite material" means a composite material of SiC and aluminum. The "C/Cu composite material" means a composite material of carbon and copper.

At this time, it is desirable that the material for the electrode portions has low electrical resistance and low thermal expansion coefficient and that the thermal expansion coefficient is close to that of the ceramic of the honeycomb structural portion. The reason why low electrical resistance is desirable is because high electrical resistance may cause a problem by the electrode portions' own heat generation upon energization. In addition, the reason why low thermal expansion coefficient is desirable is as follows. When the thermal expansion coefficient of the electrode material is higher than that of the ceramic, thermal stress generated upon connecting the electrode portions becomes large, and a problem may be caused by interfacial peeling or crack generation on the ceramic side.

The material for the electrode portions can appropriately be selected in consideration of the balance among crack generation to the ceramic due to thermal stress, interfacial peeling of the electrode, electrode portions' own heat generation, costs, and the like. For example, regarding aluminum, the electrode portions may easily peel off due to thermal stress since the thermal expansion coefficient is high though the electrical resistance is low. Regarding stainless steel, a problem may be raised in point of electrode portions' own heat generation since the electrical resistance is relatively high. Regarding noble metal materials such as gold, silver, platinum, palladium, and rhodium, a problem of material cost may be raised though, particularly, gold and silver have low electrical resistance. In an electrode portion formed by the use of the aforementioned composite material, the thermal expansion coefficient is lower than the other pure metals such as aluminum in addition to low electrical resistance, and the thermal expansion coefficient is close to that of the ceramic constituting the honeycomb structural portion. Therefore, an effect of reducing thermal stress upon a heat cycle can be expected. Similar effects can be obtained also in the material having low thermal expansion coefficient in comparison with the other metals, such as molybdenum and tungsten.

It is preferable that each of the pair of electrode portions 21 is formed into a strip shape extending in the cell 2 extension direction of the honeycomb structural portion 4. In addition, in a cross section perpendicular to the cell 2 extension direction, it is preferable that one electrode portion 21 is disposed opposite to the other electrode portion 21 across the center of the honeycomb structural portion 4. FIGS. 1 to 7 show an example of a case where a pair of electrode portions 21 are disposed on two side faces 5 facing each other of the honeycomb structural portion 4 formed into a cylindrical shape having quadrangular end faces. This constitution enables to inhibit a bias of a temperature distribution of the honeycomb structural portion 4 at the time of applying a voltage between the pair of electrode portions 21.

In addition, in the shape of the electrode portions, it is preferable that "the area of the bond portion of the electrode portion is smaller than the area of the shape surrounding the outer periphery of the electrode portion". In the heater of the present embodiment, the shape of the electrode portions may be a shape where "the corner portions of a rectangle are formed into a curved shape". Such a shape of the electrode portions is a shape by which thermal stress is reduced. Therefore, it inhibits "crack generation in the honeycomb structural portion and peeling of the electrode portion from the honeycomb structural portion after connecting the electrode portions to the honeycomb structural portion". Further, even under the circumstances of the use where heating and cooling are repeated, peeling of the electrode portion from the honeycomb structural portion and crack generation in the honeycomb structural portion can be inhibited.

For example, in FIG. 4, the shape of the electrode portions 21 is a shape where the corner portions of the rectangle are formed into a curved shape. Further, in FIG. 4, the shape of the electrode portions 21 is a shape of a plate where a plurality of holes are formed. By allowing the electrode portions 21 to have a "shape where the corner portions of the rectangle are formed into a curved shape" and a "shape of a plate where a plurality of holes are formed", thermal stress of the electrode portions 21 is reduced. Incidentally, the shape of the electrode portions 21 is not limited to the aforementioned shape. For example, there may be employed a shape which satisfies only one of the "shape where the corner portions of the rectangle are formed into a curved shape" and the "shape of a plate where a plurality of holes are formed".

The pair of electrode portions 21 may have a terminal portion for securing the electrical connection to the power source and the like. For example, the aforementioned "terminal portion" may be formed on a part of the pair of electrode portions 21. As such an electrode portion, there may be mentioned one having the "main body of the electrode portion" and the "protruding portion extended from the main body of the electrode portion". The main body of the electrode portion serves as the portion actually disposed on a side face of the honeycomb structural portion.

In each of the pair of electrode portions 21, a part of the electrode portion 21 passes through the housing 51 and is extendedly disposed up to outside of the housing 51. It is preferable that a part of each of the pair of electrode portions 21 extendedly disposed up to the outside of the housing 51 serves as the aforementioned protruding portion. Such constitution enables to easily energize the partition walls 1 of the heater main body 50 stored in the housing 51.

Upon manufacturing the heater main body having a pair of electrode portions disposed on two side faces of the honeycomb structural portion, it is preferable that plate-shaped or membrane-shaped electrode portions are manufactured separately from the honeycomb structural portion and that the electrode portions are connected to two side faces of the honeycomb structural portion. As a method for connecting the pair of electrode portions to the side faces of the honeycomb structural portion, there can be mentioned, for example, a method where a conductive bonding material is disposed on the side faces of the honeycomb structural portion to bond the electrode portions to the side faces of the honeycomb structural portion by the conductive bonding material. In a heater main body used for the heater of the present embodiment, it is preferable that the aforementioned conductive bonding material is fired at 60 to 200° C. to form a conductive bond portion.

This means that, when the conductive bonding material is fired at 60 to 200° C., the pair of electrode portions 21 are bonded to the honeycomb structural portion 4 by means of the conductive bonding material (conductive bond portion 23 after firing). In the present specification, "firing" an object to be fired (e.g., conductive bonding material) means that a part of the object to be fired is melted by heating to bond constituents of the object to be fired to each other, thereby making the object to be fired a fired object (e.g., conductive bond portion). When the conductive bonding material is fired to become a conductive bond portion, which is a fired object, the honeycomb structural portion and the electrode portions are bonded to each other by means of the conductive bond portion.

Here, a conductive paste containing "polyamide resin, fatty acid amine, and silver flake" is defined as conductive paste A. In addition, a conductive paste containing "silver compound, silicate solution, and water" is defined as conductive paste B. In addition, a conductive paste containing a "nickel powder and silicate solution" is defined as conductive paste C. Here, the nickel powder is preferably contained by 30 to 60 mass % with respect to the entire conductive paste C. In addition, a conductive paste containing "aluminum oxide, graphite, and silicate solution" is defined as conductive paste D. In this case, the conductive bonding material is preferably one kind selected from a group consisting of the conductive paste A, conductive paste B, conductive paste C, and conductive paste D. Therefore, it is preferable that the conductive bond portion 23 is obtained by firing at least one kind selected from a group consisting of the conductive paste A, conductive paste B, conductive paste C, and conductive paste D. By making the aforementioned material for the conductive bond portion 23, the heater main body of the heater of the present embodiment has good heat generation performance by energization. Further, the heater main body of the heater of the present embodiment has low bonding temperature in comparison with general brazing. That is, the bonding temperature is 200° C. or less. Therefore, since the thermal stress is reduced, crack generation in the honeycomb structural portion can be inhibited when the electrode portions are bonded to the honeycomb structural portion containing ceramic as the main component. Furthermore, in the heater main body of the heater of the present embodiment, peeling of the electrode portion from the honeycomb structural portion can be inhibited.

The conductive bond portion for bonding the pair of electrode portions to the honeycomb structural portion may contain metal and be formed by thermal spraying, cold spraying, or plating. Such conductive bond portions exhibit a function as "electrodes" together with the pair of electrode portions. In addition, such conductive bond portions are preferable in that they can be formed as layers having low electrical resistance directly on the surfaces of the honeycomb structural portion. This enables to apply a large current to the heater main body.

As a material for the conductive bond portion, a material similar to that for the electrode portions described above can be mentioned. It is desirable that the material for the conductive bond portion has low electrical resistance and low thermal expansion coefficient and that the thermal expansion coefficient is close to that of the ceramic of the honeycomb structural portion like the aforementioned electrode portions. When the electrical resistance is high, a problem may be caused due to the conductive bond portions' own heat generation upon energization. When the thermal expansion coefficient is high with respect to the ceramic, peeling may be caused at the interface between the conductive bond portion and the honeycomb structural portion, or a crack may be generated in the honeycomb structural portion.

Examples of the thermal spraying method include plasma spraying method, high velocity oxygen fuel thermal spraying method (HVOF method), arc spraying method, and flame spraying method.

As a specific forming method of a conductive bond portion by thermal spraying, there can be mentioned the following method. In the first place, two side faces for disposing the electrode portions (electrode portion disposition faces) among the side faces of the honeycomb structural portion are subjected to sandblasting. By the sandblasting, the aforementioned electrode portion disposition faces are surface-roughened, and oxidized membrane layers are removed from the electrode portion disposition faces. Next, on the side surfaces other than the aforementioned electrode portion disposition faces, protection covers are disposed so as to cover the side faces. Then, on the electrode portion disposition faces, a powder raw material melted by heating is sprayed. Thus, membranes to become conductive bond portions can be formed on the electrode portion disposition faces. Examples of the powder raw material include pure nickel, nickel alloy, pure aluminum, aluminum alloy, pure copper, copper alloy, pure molybdenum, and pure tungsten. The temperature for melting the powder raw material by heating depends on the aforementioned spray methods, and it is preferable to appropriately set the temperature.

According to such a thermal spraying method, the conductive bond portion is hardly densified completely. That is, according to the thermal spraying method, there can be manufactured a conductive bond portion having a plurality of pores therein. Since such a conductive bond portion has low Young's modulus due to formation of the pores, a function of relaxing the thermal stress is improved.

As a forming method of a conductive bond portion by a cold spraying method, specifically the following method can be mentioned. In the first place, in the same manner as in the aforementioned thermal spraying method, the electrode portion disposition faces are subjected to sandblasting, and protection covers are disposed so as to cover the side faces other than the aforementioned electrode portion disposition faces. Next, a powder raw material is crashed into the electrode portion disposition faces at a very high speed by the use of gas such as nitrogen gas, argon gas, or air having a temperature of about 200 to 600° C. as carrier gas. Thus, by crashing the powder raw material into the aforementioned electrode portion disposition faces at a very high speed, the powder raw material causes plastic deformation while maintaining the solid phase state. Thus, membranes derived from the aforementioned powder raw material can be formed on the aforementioned electrode portion disposition faces. The temperature of the carrier gas is set to be lower than the melting point or softening point of the powder raw material.

A material usable as the powder raw material in the cold spraying method is mainly a soft metal which easily causes plastic deformation in comparison with the powder raw material usable in the aforementioned thermal spraying. In the cold spraying method, since the melting temperature of the powder raw material is low in comparison with the thermal spraying method, thermal alteration or oxidation of the powder raw material is easily caused. Therefore, it has an advantage of having material characteristics close to those of a bulk (solid mass).

Examples of the powder raw material include pure nickel, pure aluminum, and pure copper.

As a forming method of a conductive bond portion by plating, specifically the following method can be mentioned. In the same manner as in the aforementioned thermal spraying, the aforementioned electrode portion disposition faces are subjected to sandblasting, and protection covers are disposed so as to cover the side faces other than the aforementioned electrode portion disposition faces. Next, the aforementioned electrode portion disposition faces are subjected to plating. Thus, membranes serving as conductive bond portions can be formed on the aforementioned electrode portion disposition faces.

Examples of the plating method include a non-electrolytic plating method, electrolytic plating method, and a method of a combination thereof. Incidentally, in the non-electrolytic plating method, formation of a thick conductive bond portion tends to be difficult. Therefore, after a lower layer (i.e., first layer of a conductive bond portion) is formed by the non-electrolytic plating method, an upper layer (i.e., second layer of a conductive bond portion) can be formed on the lower layer by the electrolytic plating method. By combining the non-electrolytic plating method and the electrolytic plating method in such a manner, a thick conductive bond portion can be formed.

Examples of the plating material used for the plating method include pure nickel and pure copper.

Incidentally, the conductive bond portion can be formed by combining methods such as thermal spraying, cold spraying, and plating. For example, after the aforementioned lower layer is formed by the non-electrolytic plating method, the aforementioned upper layer can be formed by the cold spraying method on the lower layer. The lower layer and the upper layer form the conductive bond portion. By combining a plurality of methods in such a manner, a thick conductive bond portion can be formed. In each of the aforementioned methods, the sandblasting and the operation of disposing the protection cover may be employed appropriately.

Figure 15:
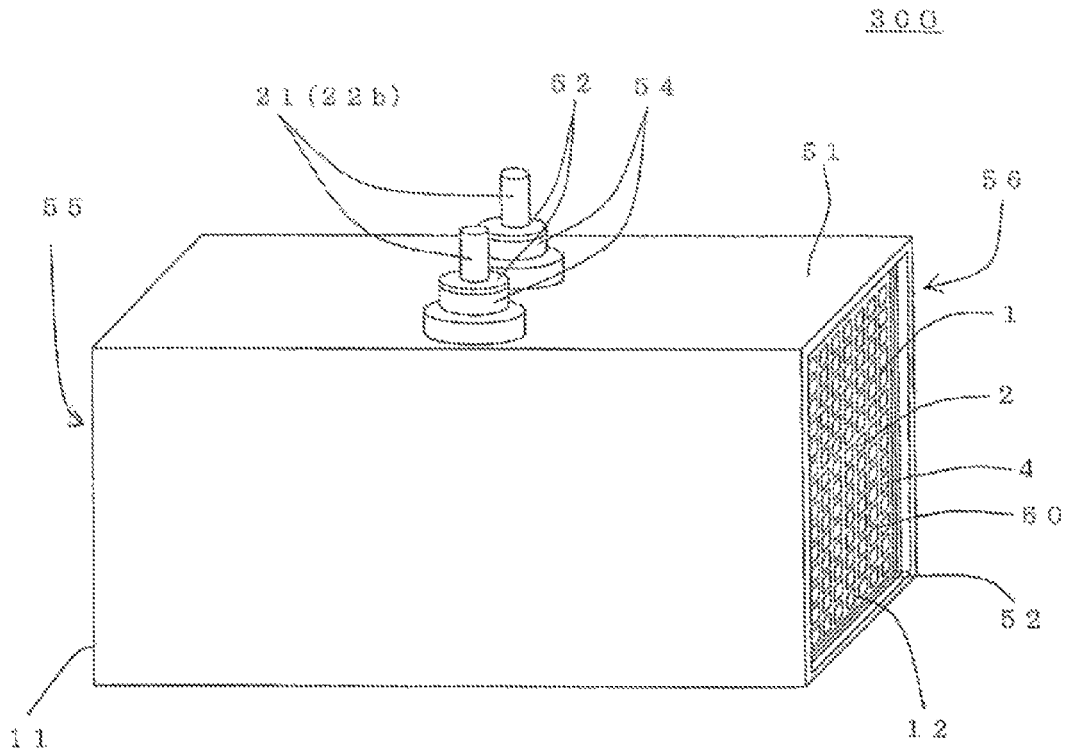
FIG. 15 is a perspective view schematically showing another embodiment of a heater of the present invention.
Figure 16:
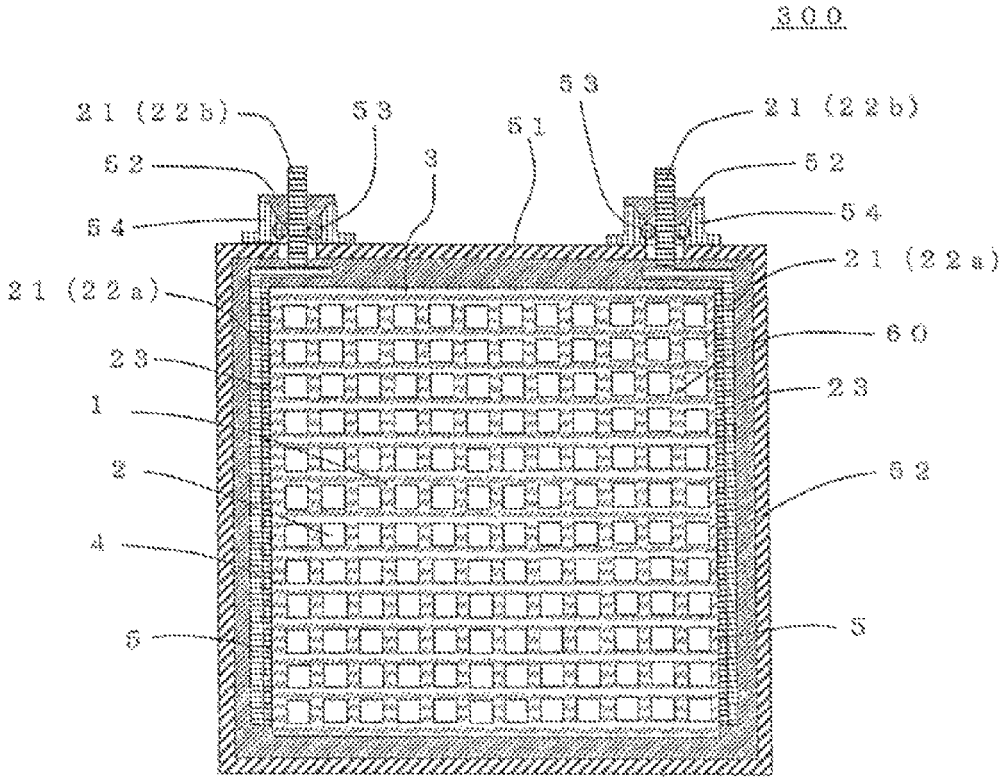
FIG. 16 is a cross-sectional view schematically showing a cross section perpendicular to the flow direction of a lubricating fluid flowing inside the heater main body of the heater shown in FIG. 15.
Figure 17:
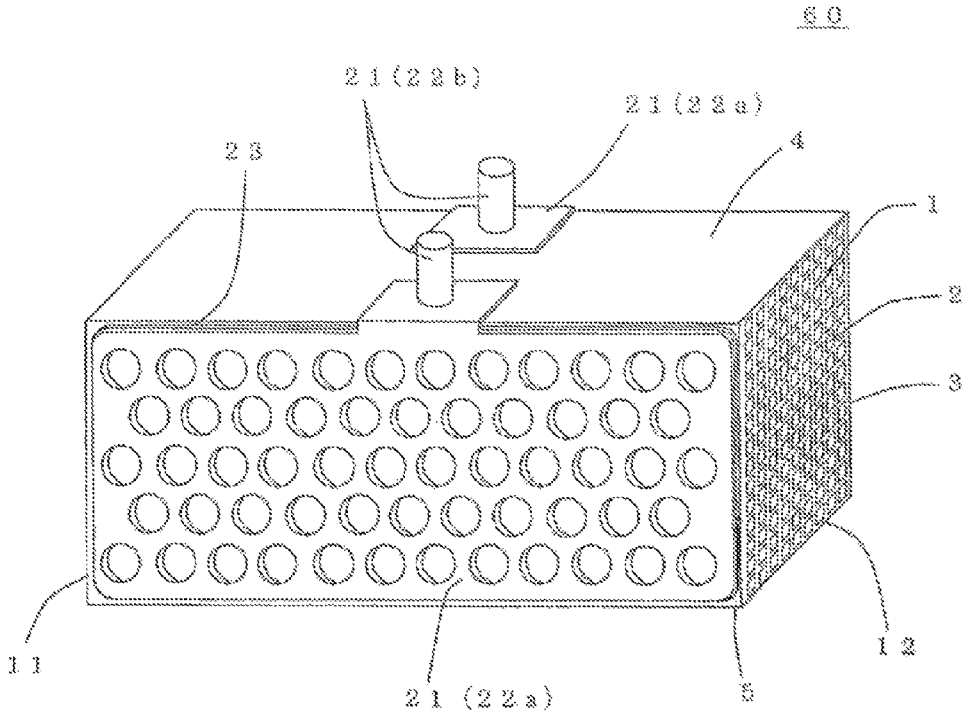
FIG. 17 is a perspective view schematically showing a heater main body of the heater shown in FIG. 15.

Next, another embodiment of a heater of the present invention will be described. As another embodiment of a heater of the present invention, a heater 300 as shown in FIGS. 15 and 16 can be mentioned. In the heater 300, the constitution of the pair of electrodes 21 of the heater main body 60 is different from that of the pair of electrode portions described above. That is, as shown in FIG. 17, each of the pair of electrode portions 21 is composed of an electrode substrate 22*a* disposed on a side face of the honeycomb structural portion 4 and a rod-shaped electrode portion 22*b* disposed so as to connected to the electrode substrate 22*a*. It is preferable that the electrode substrate 22*a* is bonded to the side face 5 of the honeycomb structural portion 4 by means of a conductive bond portion 23 and that a part of the electrode substrate is bent along the side face having no electrode portion 21 disposed thereon of the honeycomb structural portion 4. It is preferable that the bent portion of each of the pair of electrode portions 21 is not brought into contact with the honeycomb structural portion 4.

In the heater 300 of the present embodiment as shown in FIGS. 15 and 16, a rod-shaped electrode portion 22*b* passes through the housing 51 to form a terminal portion with a power source or the like. It is preferable to dispose members having sealability such as O rings 53 at the positions where the rod-shaped electrode portions 22*b* pass through the housing 51. Such constitution enables to enhance sealability (pressure resistance) at the position where the rod-shaped electrode portions 22*b* pass through the housing 51. In addition, by providing the rod-shaped electrode portions having a diameter as shown in FIGS. 15 to 17, there is an effect of inhibiting the electrode portions' own heat generation in the case of applying a large current.

Here, FIG. 15 is a perspective view schematically showing another embodiment of a heater of the present invention. FIG. 16 is a cross-sectional view schematically showing a cross section perpendicular to the flow direction of a lubricating fluid flowing inside the heater main body of the heater shown in FIG. 15. FIG. 17 is a perspective view schematically showing the heater main body of the heater shown in FIG. 15. In FIGS. 15 to 17, regarding the same constituents as those shown in FIGS. 1 and 6, the same numerals are put, and the descriptions will be omitted.

(1-2) Housing:

As shown in FIGS. 1 to 5, the housing 51 is a cornered body storing the heater main body 50 so as to cover the side face side of the heater main body 50. The housing 51 has an inflow port 55 from which the lubricating fluid flows in and the outflow port 56 from which the lubricating fluid having passed through the cells 2 formed in the heater main body 50 flows out. The inflow port 55 and the outflow port 56 are connected to the pipes and the like where the lubricating fluid flows to allow the lubricating fluid to flow into the heater 100.

There is no particular limitation on the material for the housing. For example, the material for the housing is preferably metal or resin. Forming of the housing by metal enables to obtain a housing excellent in mechanical strength and thermal resistance. In addition, forming of the joint portion with the pipe where the lubricating fluid flows is easy. Further, a metal material is advantageously capable of processing into a cornered body by welding or the like. Therefore, use of a metal material generally enables to manufacture a housing excellent in reliability at the time of using the heater. On the other hand, it is also possible to use a resin material, whose practical use has recently been proceeding, from the viewpoint of weight saving of a vehicle. Forming of a housing by resin enables to obtain electrical insulation between the heater main body and the housing. In the heater of the present embodiment, a coating material covering at least a part of the heater main body is disposed in at least a part between the heater main body and the housing. Therefore, the electrical insulation between the heater main body and the housing is realized by the aforementioned coating material. As described above, forming of the housing by resin enables the insulation between the heater main body and the housing to be securer. In addition, since a resin material generally has low thermal conduction in comparison with a metal material, there is an adiabatic effect for trapping heat for heating the heater into the inside of the cornered body.

As the metal for forming the housing, there may be mentioned ferric alloy such as stainless steel (SUS), aluminum alloy, magnesium alloy, copper alloy, and the like. It is preferable that the housing has low thermal conductivity in point of inhibiting thermal loss when the heater generates heat. Therefore, for example, as a metal forming the housing, there is suitably used stainless steel, which has low thermal conductivity, which is widely used, and which is capable of processing to have a cornered body. In addition, when weight saving is required, aluminum alloy, magnesium alloy, or the like can suitably be used.

As a resin forming the housing, preferable is a resin having heat resistance by which deformation due to a heated lubricating fluid is inhibited. Specifically, there can be mentioned resins such as ethylene-propylene-diene monomer copolymer (EPDM), ethylene-propylene copolymer, polyimide, polyamide-imide, silicone, fluorine elastomer, epoxy resin, phenol resin, melamine resin, urea resin, unsaturated polyester resin, alkyd resin, polyurethane, thermosetting polyimide, polyethylene (PE), polypropylene (PP), polyvinyl chloride (PVC), polyvinylidene chloride, polystyrene (PS), polyvinyl acetate, polytetrafluoroethylene, acrylonitrile-butadiene-styrene (ABS) resin, acrylonitrile-styrene (AS) resin, acrylic resin, polyamide, nylon, polyacetal, polycarbonate, modified polyphenylene ether, polybutylene terephthalate (PBT), polyethylene terephthalate (PET), cyclic polyolefin, polyphenylene sulfide (PPS), polytetrafluoroethylene, polysulfone, polyether sulfone, amorphous polyacrylate, liquid crystalline polymer, polyether ether ketone, thermoplastic polyimide, thermoplastic polyurethane (TPU), methyl methacrylate styrene (MS), polymethylmethacrylate (PMMA), and polydimethylsiloxane (PDMS). In addition, as a resin for forming the housing, there may be used a resin compound material obtained by adding glass fibers and the like to the aforementioned resin. By using a resin composite material, there is an effect of reducing the thermal stress (in other words, improvement in durability) due to improvement in heat resistance and reduced thermal expansion. As the reinforcement fiber, a glass fiber or the like can be used. When insulation is required, a fiber having insulation properties is suitable. Because of this, in the case of raising output of the heater, it is preferable to use a resin composite material having improved thermal resistance as the resin for forming the housing.

The inflow port and the outflow port of the housing are inlet and outlet of the flow passages for the lubricating fluid to flow in or out. The inflow port and the outflow port of the housing may be constituted to be able to be directly connected to the pipe where the lubricating fluid flows. A connection mechanism with the aforementioned pipe may further be connected to the inflow port and the outflow port of the housing. For example, as the aforementioned "connection mechanism with the pipe", a pipe joint (referred to also as a flange fitting") can be mentioned. In addition, the "connection mechanism with the pipe" may further have a wide pipe portion which have a gradually increasing diameter toward the inlet port, a narrow pipe portion which have a gradually decreasing diameter from the outflow port, or the like.

There is no particular limitation on the size of the housing. However, it should be a size capable of storing a heater main body. In addition, when the heater main body is stored, the size of the housing is preferably a size having a gap to some extent between the housing and the heater main body. The coating material is disposed in the gap. In addition, an adiabatic material may further be disposed between the housing and the heater main body. By disposing an adiabatic material, it is possible to have an adiabatic structure which inhibits generated heat of the heater from escaping to the inside and outside of the cornered body. Incidentally, as the adiabatic material, an inorganic fiber type adiabatic material is suitable from the viewpoint of also thermal resistance upon heating the heater. As the adiabatic material, there can be used a fiber mat, sheet, blanket, or the like, of a ceramic fiber, an alumina fiber, a silica fiber, glass wool, rock wool, or the like. It is preferable that the "adiabatic material" disposed between the housing and the heater main body is made of, for example, the aforementioned fiber or the like and is a cotton-shaped (mat-shaped) material formed so that internal pores are positively left. Therefore, it is possible to greatly reduce the thermal conductivity in comparison with the metal and resin, which are other materials. Since such an adiabatic material has little sealability against a lubricating fluid, it is disposed further outside the coating material covering a part of the heater main body. Therefore, the "adiabatic material" used for the heater of the present embodiment is a constituent element which is different from the aforementioned "coating material". That is, the "adiabatic material" referred to here does not include a "coating material" used for a heater of the present embodiment. Further, even in the case that a coating material is not disposed in all the portions of the gap (i.e., the case that a coating material is disposed only in a part of the gap), the gap functions as an air layer to serve as an adiabatic layer for the heater main body.

For example, as shown in FIG. 5, in the heater 100 of the present embodiment, a coating material 52 made of a material containing at least one of ceramic and glass is disposed on the outer periphery side of the heater main body 50, and a gap may be formed between the coating material 52 and the housing 51.

Figure 10:
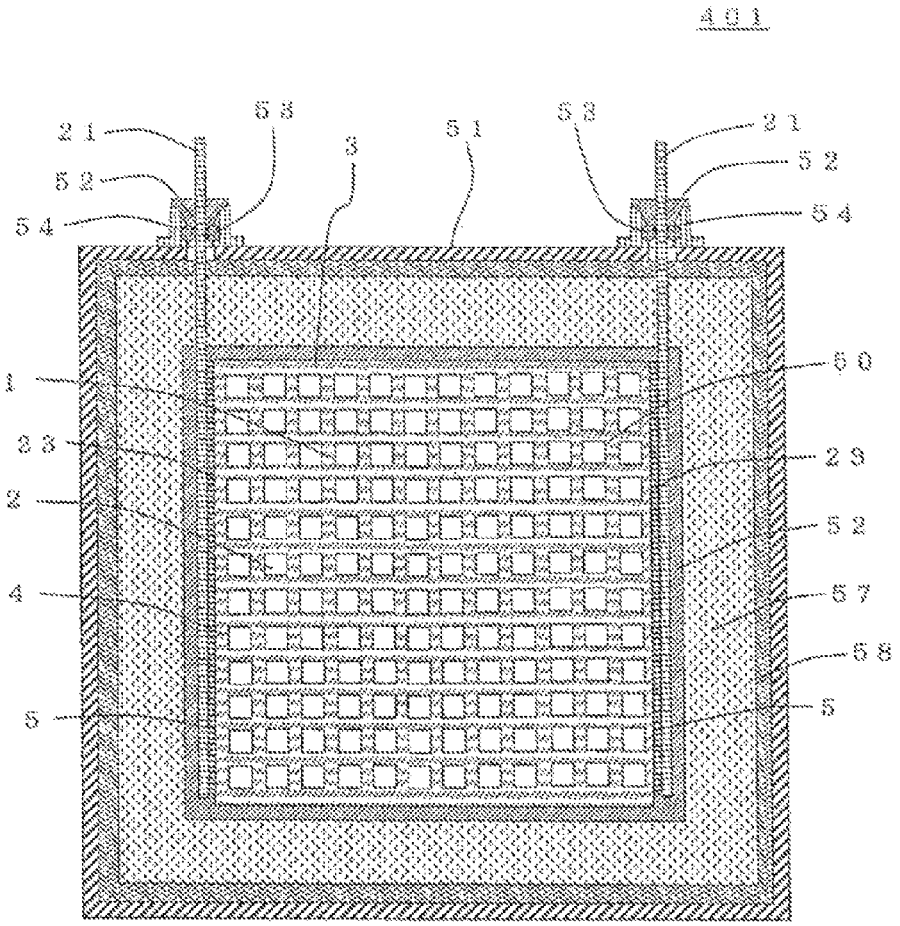
FIG. 10 is a cross-sectional view schematically showing still another embodiment of a heater of the present invention.

In the heater of the present embodiment, between the heater main body and the housing, a coating material, an adiabatic material, and a resin material may be disposed in the state of being laminated in this order. That is, as the heater 401 shown in FIG. 10, it may have a structure where a coating material 52 is disposed between the heater main body 50 and the housing 51 so as to cover a part of the heater main body 50, where an adiabatic material 57 is disposed on the outside thereof, and where the resin material 58 is disposed outside the adiabatic material 57. As the resin material 58 disposed on the outside of the adiabatic material 57, a silicone based resin, a fluorine based resin, or the like may be employed. Incidentally, it is possible to appropriately change the selection of the resin material by attaching a high value to insulation properties, adiabaticity, and thermal resistance. When the heat resistance is required, it is also possible to use a resin composite material where a glass fiber or the like is added. FIG. 10 is a cross sectional view schematically showing still another embodiment of a heater of the present invention. The cross section shown in FIG. 10 is a cross section perpendicular to the flow direction of the lubricating fluid passing through the heater main body. In FIG. 10, regarding elements constituted similarly to elements shown in FIG. 5, the same numerals are given, and the descriptions will be omitted.

In addition, in the heater of the present embodiment, it may have a structure where a coating material made of a material containing at least one of ceramic and glass is disposed between the heater main body and the housing, and where an adiabatic material is disposed on the outside thereof. That is, as the heaters 402A, 402B shown in FIGS. 11 and 12, between the heater main body 50 (heater main body 60 in FIG. 12) and the housing 51, a coating material 52 and an adiabatic material 57 may be disposed in a laminated state.

As described above, in the heater of the present embodiment, the structure inside the housing and the like may appropriately be changed according to the situation and configuration where the heater is used. However, it is necessary that the coating material 52 made of a material containing at least one of the ceramic and glass is disposed so as to cover a part of the surface of the heater main body.

Figure 11:
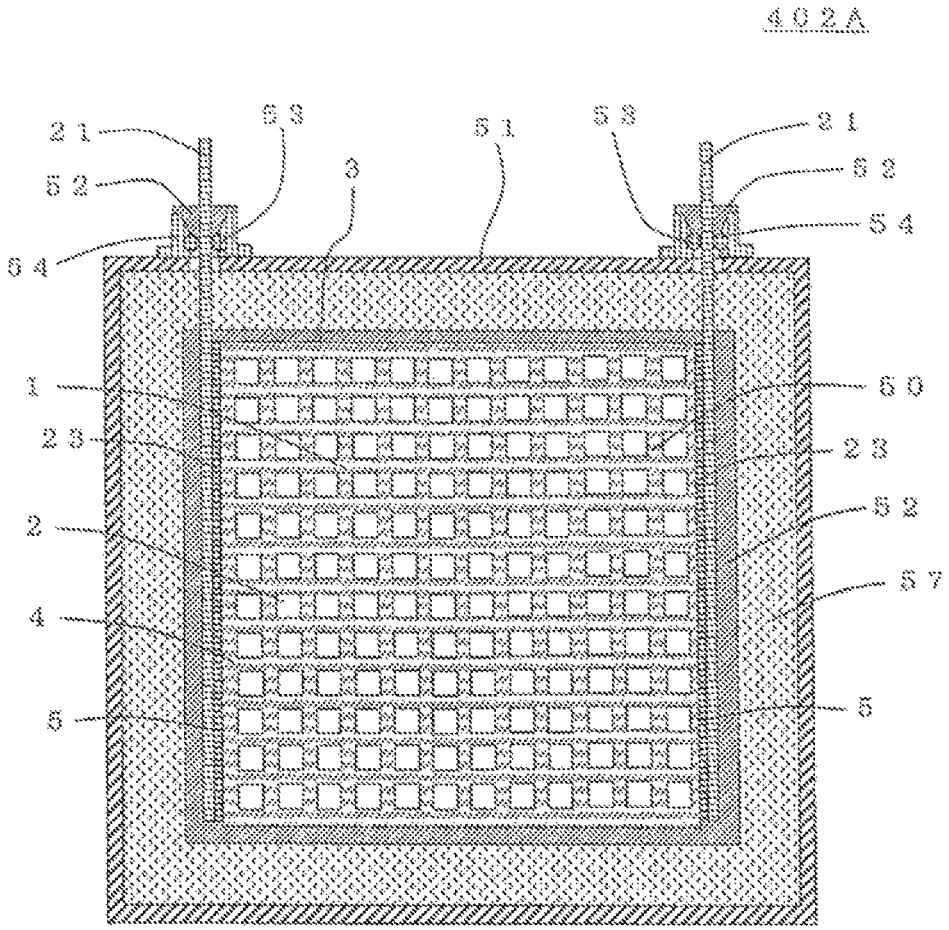
FIG. 11 is a cross-sectional view schematically showing still another embodiment of a heater of the present invention.
Figure 12:
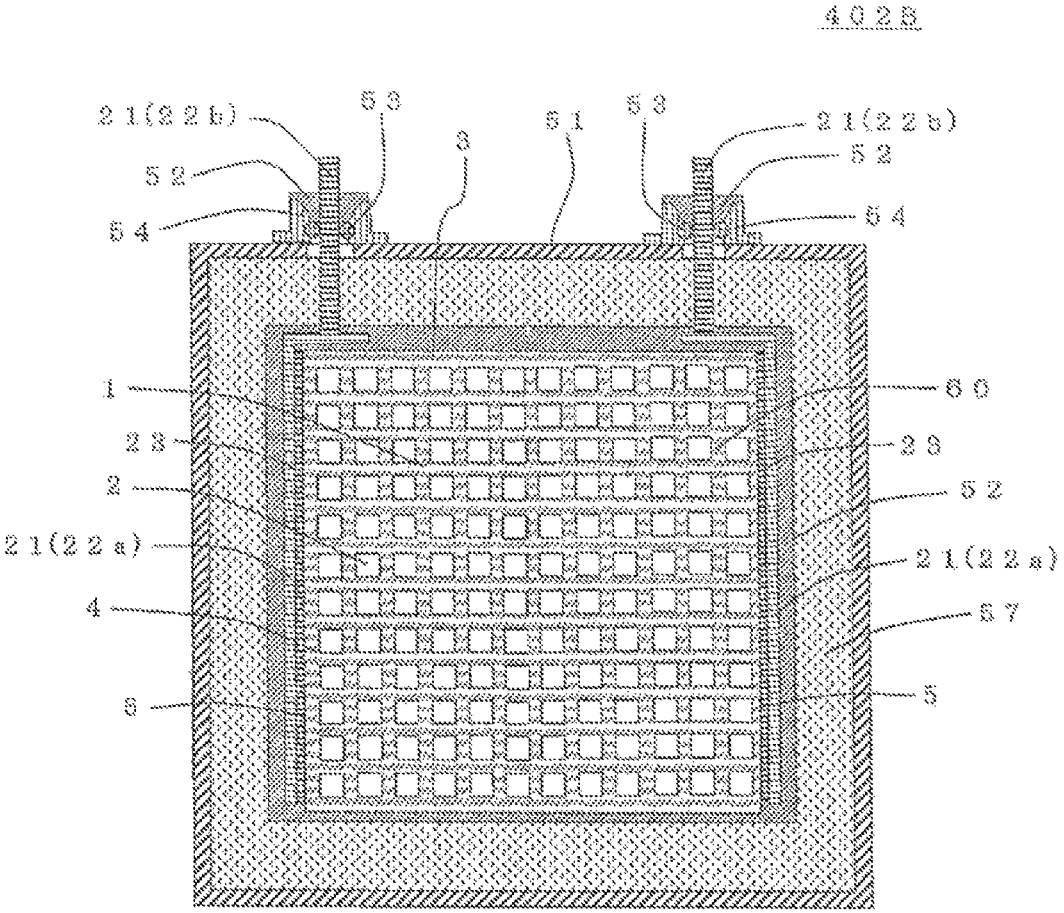
FIG. 12 is a cross-sectional view schematically showing still another embodiment of a heater of the present invention.

FIGS. 11 and 12 are cross-sectional views schematically showing still other embodiments of a heater of the present invention. The cross sections shown in FIGS. 11 and 12 are cross sections perpendicular to the flow direction of a lubricating fluid flowing inside the heater main body. In FIG. 11, regarding elements constituted similarly to elements shown in FIG. 5, the same numerals are given, and the descriptions will be omitted. In FIG. 12, regarding elements constituted similarly to elements shown in FIG. 16, the same numerals are given, and the descriptions will be omitted.

As the heater 100 of the present embodiment of FIGS. 1 to 5, the housing 51 has electrode leading portions 54 for leading the pair of electrode portions 21 of the heater main body 50 stored in the housing 51 to the outside. The tip side portions of the pair of electrode portions 21 are exposed to the outside from the electrode leading portions 54 to make electrical connection to the pair of electrode portions 21 possible.

On the electrode leading portions 54, O rings 53 are disposed at the positions where the pair of electrode portions 21 pass through the housing 51. By the O ring 53, pressure resistance (sealability) at the positions where the electrode portions 21 pass through the housing 51 is secured. The pressure resistance referred to here means performance of inhibiting a lubricating fluid from leaking out to the outside of the housing when the lubricating fluid flows inside the housing. In the heater of the present embodiment, pressure resistance as described above is necessary lest a problem should be caused upon operating the heater.

Figure 13:
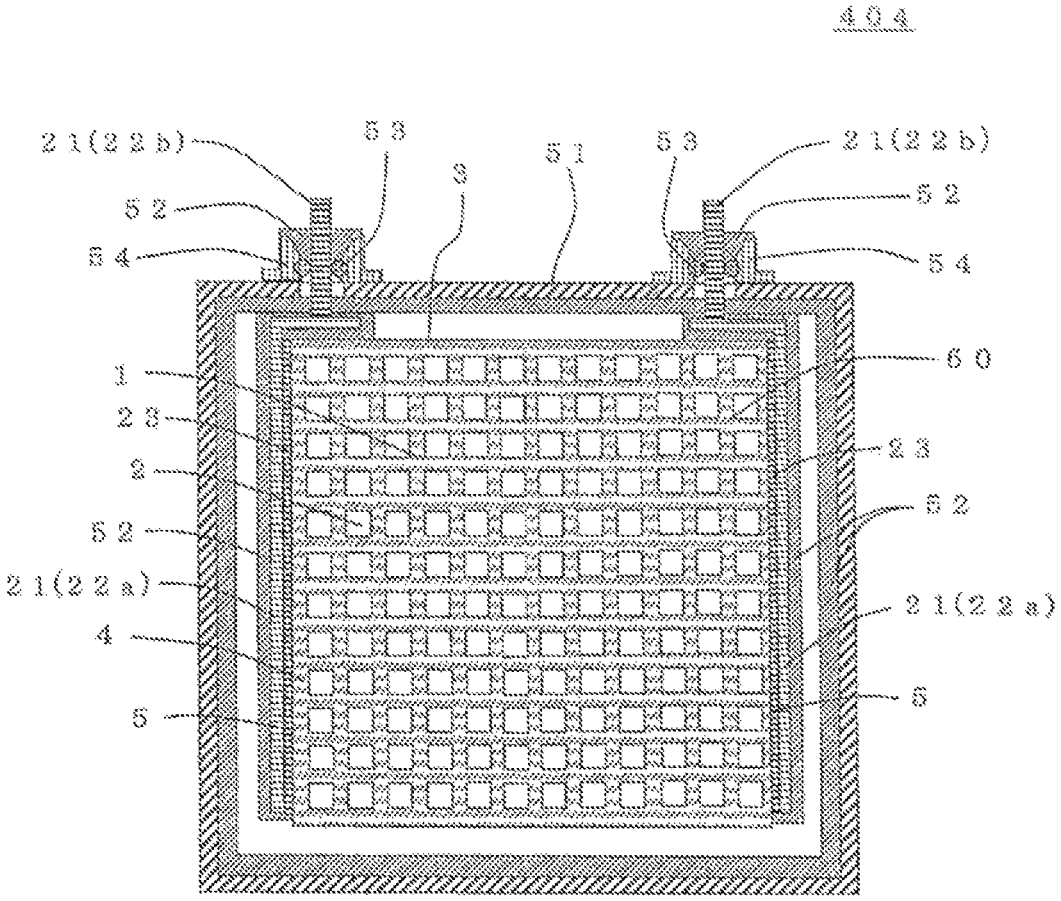
FIG. 13 is a cross-sectional view schematically showing still another embodiment of a heater of the present invention.

In the heater of the present embodiment, a lubricating fluid may be allowed to flow positively outside the heater main body. For example, the heater 404 shown in FIG. 13 is a heater constituted in such a manner that a lubricating fluid flows also between the heater main body 60 and the housing 51. This constitution enables to heat the lubricating fluid by the use of the face outside the outer peripheral wall 3 of the honeycomb structural portion 4. By effectively using the heat generated in the outer peripheral wall 3 in this manner, the heating efficiency of the heater 404 can be improved. Of course, in the heater 404 shown in FIG. 13, a lubricating fluid flows also inside the cells 2 of the honeycomb structural portion 4, and the lubricating fluid can be heated also inside the cells 2.

In the heater 404 shown in FIG. 13, it is preferable to dispose at least a coating material 52 on the surfaces of the pair of electrode portions 21 of the heater main body 60 to secure the insulation properties of the pair of electrode portions 21. That is, though the lubricating fluid may positively be brought into contact with the outer peripheral wall 3 of the honeycomb structural portion 4, it is preferable that the lubricating fluid is not brought into contact with the pair of electrode portions 21. Insulation against the pair of electrode portions 21 can be performed by the coating material 52 as described above. In addition, in the case that the housing 51 is made of metal such as SUS, it is preferable that a coating material 52 is disposed also on the inside face of the housing 51 to secure the insulation properties of the housing 51. On the inside face of the housing 51, for example, a resin material may be disposed in place of the coating material. For example, in place of disposing the coating material 52 on the inside face of the housing 51, a resin material may be coated. Since the inside face of the housing 51 is not brought into direct contact with the heater main body 60, the face coated with a resin material as described above can have sufficient thermal resistance. Further, the inside face coated with the resin material has good insulation properties. FIG. 13 is a cross-sectional view schematically showing still another embodiment of a heater of the present invention. The cross section shown in FIG. 13 is a cross section perpendicular to the flow direction of the lubricating fluid flowing inside the heater main body. In FIG. 13, regarding elements constituted similarly to elements shown in FIG. 16, the same numerals are given, and the descriptions will be omitted.

Figure 14:
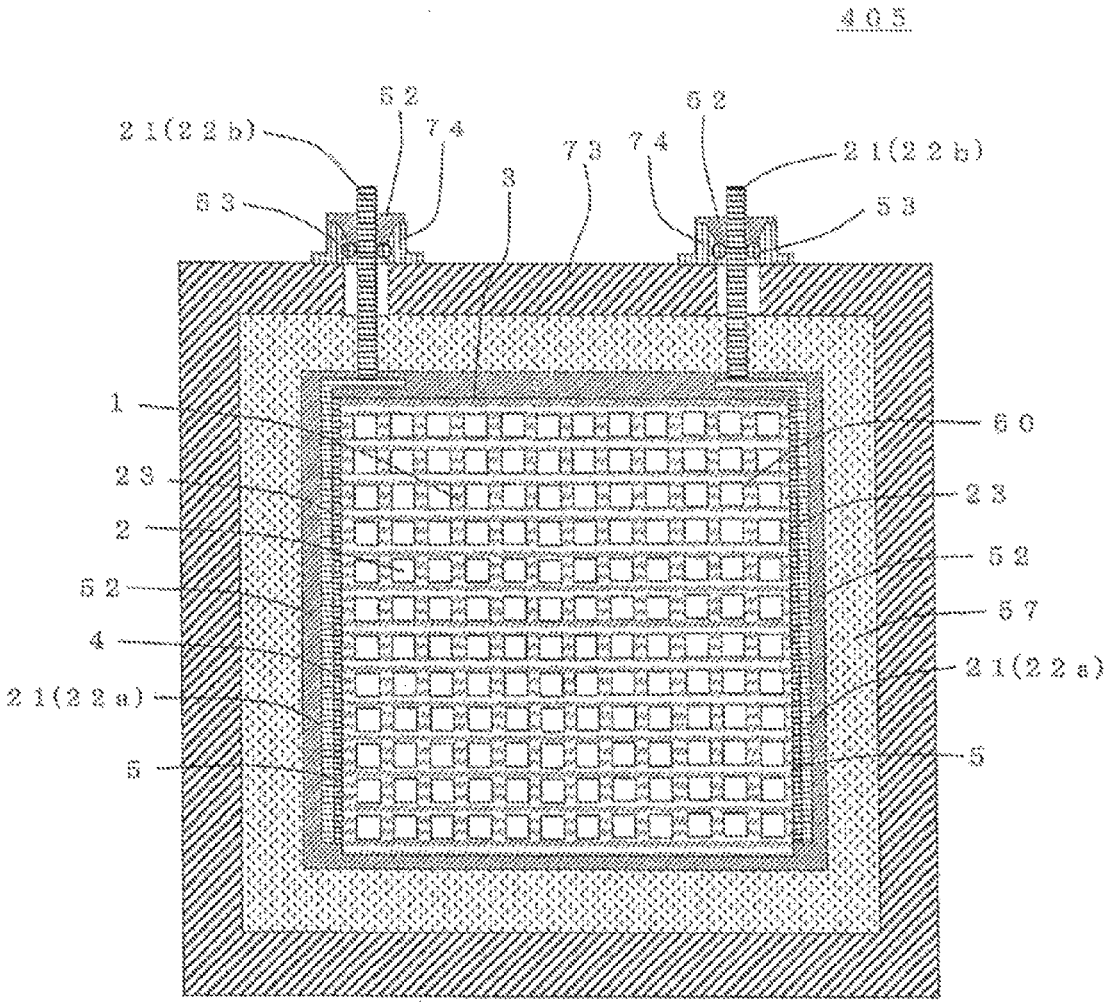
FIG. 14 is a cross-sectional view schematically showing still another embodiment of a heater of the present invention.

In the heater 405 shown in FIG. 14, the housing 73 is made of resin. The housing 73 can be formed by the use of epoxy resin, fluorine resin, and the like. In the heater 405 shown in FIG. 14, an adiabatic material 57 is filled between the housing 73 and the coating material 52. The housing 73 has electrode leading portions 74 at the positions where the pair of electrode portions 21 are extended from the housing 73. On the electrode leading portions 74, O rings 53 are disposed at the positions where the pair of electrode portions 21 pass. FIG. 14 is a cross-sectional view schematically showing still another embodiment of a heater of the present invention. The cross section shown in FIG. 14 is a cross section perpendicular to the flow direction of the lubricating fluid flowing inside the heater main body. In FIG. 14, regarding elements constituted similarly to elements shown in FIG. 16, the same numerals are given, and the descriptions will be omitted.

(1-3) Coating Material:

The coating material is disposed in at least a part between the heater main body and the housing. The coating material used for the heater of the present embodiment is made of a material containing at least one of ceramic and glass. The coating material is disposed so as to cover at least a part of the heater main body. The coating material functions as an insulation layer, an adiabatic layer, a sealing layer, and the like between the housing and the heater main body in the heater of the present embodiment. Therefore, it is preferable that the coating material has electrical insulation. In addition, it is preferable that the coating material has lubricating fluid non-permeability lest the lubricating fluid pass through the coating material. Therefore, it is more preferable that the coating material made of a material containing at least one of ceramic and glass is made of dense ceramic and/or glass lest the lubricating fluid should pass therethrough.

As the ceramic constituting the coating material, there can be mentioned, for example, ceramic of a $SiO_2$ base, $Al_2O_3$ base, $SiO_2$—$Al_2O_3$ base, $SiO_2$—$ZrO_2$ base, $SiO_2$—$Al_2O_3$—$ZrO_2$ base, and the like.

As the glass constituting the coating material, there can be mentioned, for example, glass of an unleaded $B_2O_3$—$Bi_2O_3$ base, $B_2O_3$—ZnO—$Bi_2C_3$ base, $B_2O_3$—ZnO base, $V_2O_5$—$P_2O_5$ base, SnO—$P_2O_5$ base, SnO—ZnO—$P_2O_5$ base, $SiO_2$—$B_2O_3$—$Bi_2O_3$, $SiO_2$—$Bi_2O_3$—$Na_2O$ base, and the like.

As shown in FIGS. 1 to 5, it is preferable that the coating material 52 is disposed between the heater main body 50 and the housing 51. In addition, it is preferable that the coating material 52 is disposed between the heater main body 50 and housing 51 on the other end face side of the heater main body 50. This constitution enables to furthermore improve insulation properties and adiabaticity of the heater main body 50. In addition, sealability against the lubricating fluid on one end face side and the other end face side of the heater main body 50 can be improved. That is, by disposing the coating material 52 in such a manner, leakage of the lubricating fluid to be heated between the heater main body 50 and the housing 51 is inhibited.

In addition, the coating material may be a material obtained by coating a material containing at least one of ceramic and glass on at least a part of the surface of the heater main body. This constitution enables to form a coating material by, for example, a thin membrane having a thickness of 10 to 500 μm. In the case that such a thin membrane-shaped coating material is disposed, a gap may be formed between the coating material and the housing. In the gap, as described above, an adiabatic material may further be disposed. In addition, the gap between the coating material and the housing may be an air layer. Further, a lubricating fluid may be able to flow through the gap between the coating material and the housing.

In the heater of the present embodiment, since the coating material is made of a material containing at least ceramic and glass, it has excellent thermal resistance. Therefore, it can be used suitably as a heater having high output with the heat generation temperature of the heater main body momentarily rising up to 250° C. or more, for example, about 300 to 400° C. That is, it can be used also as a heater having a temperature range of heat generated in the heater main body from ordinary temperature to about 250° C., and it can be used also as a heater having high heat generation temperature. Incidentally, inside the heater, a lubricating fluid for heating flows and receives heat from the heater main body. In other words, the lubricating fluid takes heat from the heater main body. Therefore, the lubricating fluid functions also as a kind of cooling agent for the heater. As a result, even when the heater main body generates heat to have high temperature, the actual temperature at the resin material present outside the heater main body tends to be low. From the above, the heater can be used for various purposes.

In addition, as shown in FIGS. 1 to 5, it is preferable that the coating material 52 is disposed between the pair of electrode portions 21 and the housing 51 at least at the positions where the pair of electrode portions 21 pass through the housing. This constitution enables to inhibit leakage of the lubricating fluid from the portion where a part of each of the pair of electrode portions 21 passes through the housing 51. As described above, at the positions where they pass through the housing 51, it is more preferable to dispose the O rings 53 in that the pressure resistance is secured.

Figure 8:
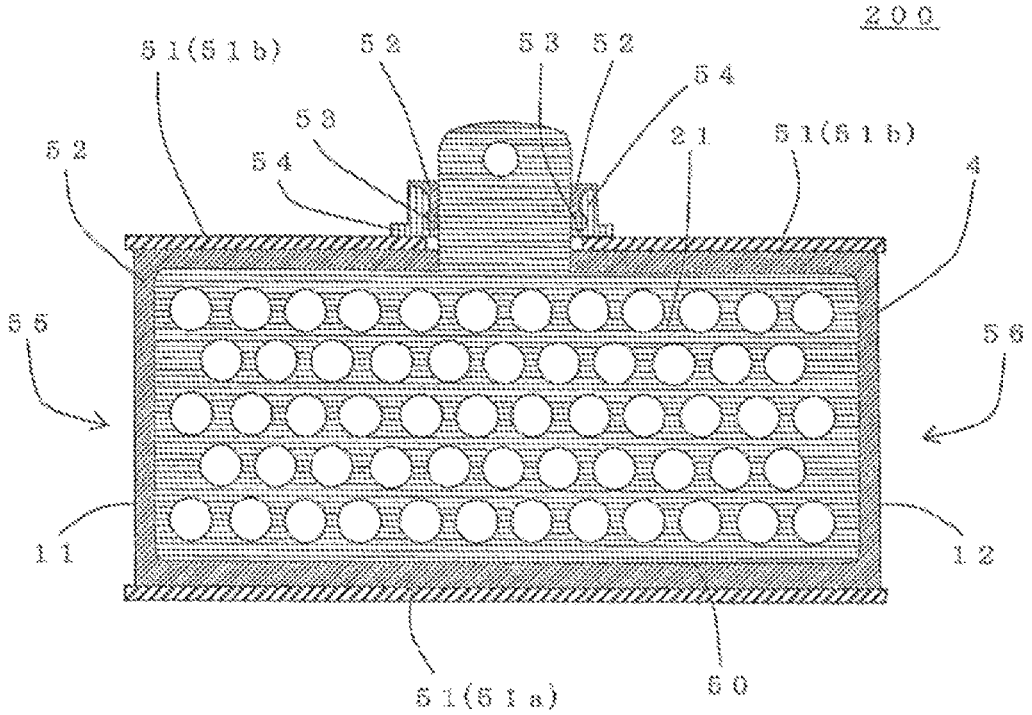
FIG. 8 is a cross-sectional view schematically showing still another embodiment of a heater of the present invention.
Figure 9:
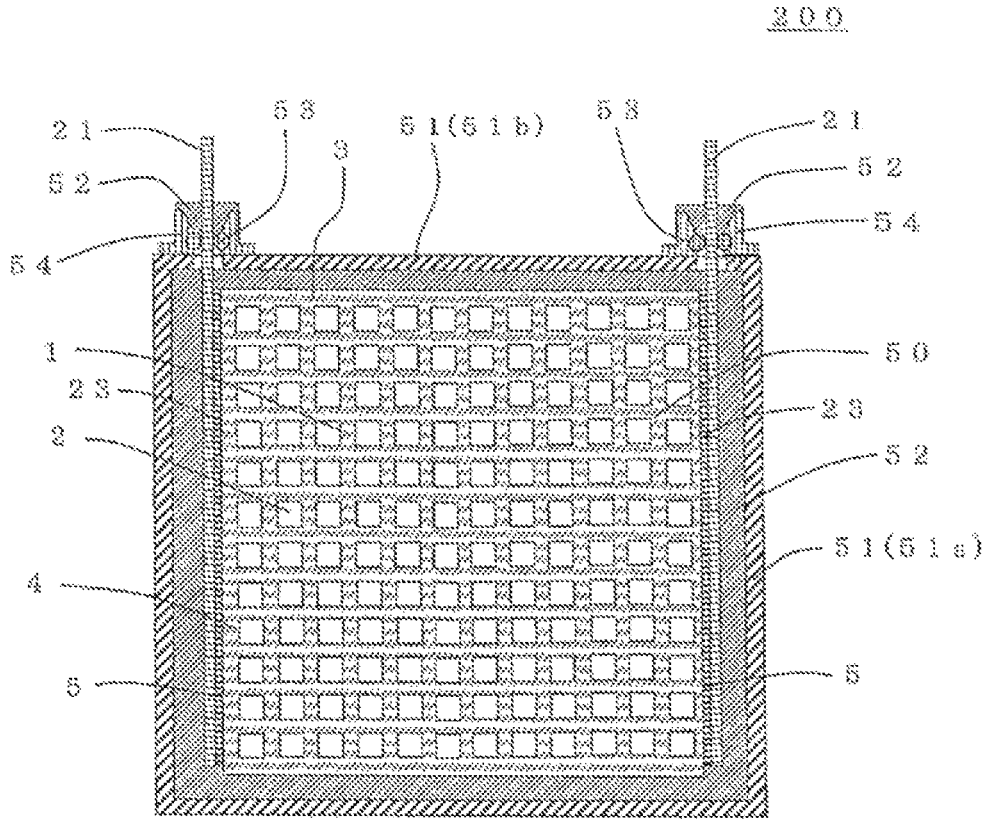
FIG. 9 is a cross-sectional view schematically showing still another embodiment of a heater of the present invention.

In the heater of the present embodiment, it is preferable that the coating material is disposed so as to cover at least the entire region of the pair of electrode portions disposed on the heater main body. This constitution enables to secure insulation properties of the heater main body. In addition, as the heater 200 shown in FIGS. 8 and 9, the coating material 52 may be disposed between the heater main body 50 and the housing 51 so as to cover the entire region on the side face side of the heater main body 50. Here, FIGS. 8 and 9 are cross-sectional views schematically showing still another embodiment of a heater of the present invention. FIG. 8 is a cross section of a heater cut along the same position as the cross section shown in FIG. 4. FIG. 9 is a cross section of a heater cut along the same position as the cross section shown in FIG. 5. In FIGS. 8 and 9, regarding elements constituted similarly to elements of the heater shown in FIGS. 1 to 5, the same numerals are given, and the descriptions will be omitted.

Thus, by disposing the coating material 52 to cover the entire region on the side face side of the heater main body 50, the insulation properties, adiabaticity, and sealability can be improved.

As shown in FIGS. 1 to 5, when the coating material 52 is disposed at a specific position, the coating material 52 formed into a predetermined shape is appropriately disposed between the heater main body 50 and the housing 51. On the other hand, as shown in FIGS. 8 and 9, the coating material 52 disposed so as to cover the entire region of the side face side of the heater main body 50 can be formed by, for example, coating a material containing at least one of ceramic and glass on the side face of the heater main body 50. Also, the coating material disposed so as to cover the entire region of the pair of electrode portions can be formed by, for example, coating a material containing at least one of ceramic and glass on the region where the pair of electrode portions are disposed on the side faces of the heater main body.

As described above, as a method for forming a coating material by coating, for example, there may be mentioned the following method. In the first place, as the first coating material manufacturing method, a method for forming a coating material using an inorganic heat resistant adhesive containing ceramic as the main component will be described. As the inorganic heat resistant adhesive, there can be employed, for example, inorganic heat resistant adhesives containing, as the main component, ceramic of $SiO_2$ base, $Al_2O_3$ base, $SiO_2$—$Al_2O_3$ base, $SiO_2$—$ZrO_2$ base, $SiO_2$—$Al_2O_3$—$ZrO_2$ base, or the like. Such an inorganic heat resistant adhesive is coated on the side faces of the heater main body.

Next, the inorganic heat resistant adhesive coated above is fired at 150 to 300° C. in the atmosphere. Thus, a coating material of ceramic can be formed. However, by the aforementioned firing, the coating material may easily become porous. Therefore, it is more preferable that the coating material thus obtained is subjected to a ceramic pore sealing material treatment lest it should have pores in the coating material. The coating material subjected to the ceramic pore sealing material treatment has more excellent sealability. The ceramic pore sealing material treatment can be performed by applying a ceramic pore sealing material on the surface of the coating material obtained by firing and then firing it at 200 to 350° C. in the atmosphere. As the ceramic pore sealing material, there can be mentioned, for example, an inorganic pore sealing material containing an inorganic material of silicate base, sodium silicate, base, or the like as the main component.

In addition, as the second coating material manufacturing method, there can be mentioned a method where coating is performed with the aforementioned ceramic pore sealing material as the coating material. That is, the ceramic pore sealing material is coated on the side face of the heater main body. Next, the ceramic pore sealing material coated is fired at 200 to 350° C. in the atmosphere. Thus, a coating material made of ceramic can be formed. By using the ceramic pore sealing material, while coating the outer periphery of the heater main body, the pores in the partition walls of the heater main body close to the outer peripheral portion can be plugged. The thickness of the coating material obtained by the first and second coating material manufacturing methods described above is, for example, 10 to 500 μm.

Next, as the third coating material manufacturing method, a method where the coating material is formed by the use of low-melting-point glass will be described. Specifically, a paste of low-melting-point glass is coated on the side faces of the heater main body. As the paste of the low-melting-point glass, a paste used for bonding/sealing electronic components can be used. For example, there can be mentioned a paste of low-melting-point glass of an unleaded $B_2O_3$—$Bi_2O_3$ base, $B_2O_3$—ZnO—$Bi_2O_3$ base, $B_2O_3$—ZnO base, $V_2O_5$—$P_2O_5$ base, SnO—$P_2O_5$ base, SnO—ZnO—$P_2O_5$ base, $SiO_2$—$B_2O_3$—$Bi_2O_3$ base, $SiO_2$—$Bi_2O_3$—$Na_2$—O base, or the like. Incidentally, as a leaded type, there can be mentioned a $SiO_2$—$B_2O_3$—PbO based paste or the like. However, it is not preferable in that it contains lead as a component. In addition, since it is adjusted in such a manner that the thermal expansion coefficient becomes close to that of the ceramic constituting the honeycomb structural portion, there may be employed a low-melting-point glass where a filler such as eucryptite ($Li_2O$—$Al_2O_3$—$SiO_2$ base) having lower thermal expansion coefficient is added. Such a paste of low-melting-point glass is coated on the side faces of the heater main body. Next, the low-melting-point glass coated is fired at 400 to 600° C. in the atmosphere. Thus, a coating material made of low-melting-point glass can be formed.

Next, as the fourth coating material manufacturing method, a method where the coating material is formed by the use of a $SiO_2$ composite material will be described. Specifically, slurry containing $SiO_2$ is prepared, and a plate-shaped filler is added to the slurry. As the plate-shaped filler, there can be mentioned mica, glass flake, talc, kaolin, clay, sericite, and the like. The slurry where the plate-shaped filler has been added is coated on the side face of the heater main body. Next, the slurry coated is fired at 400 to 600° C. in the air. Thus, the coating material made of $SiO_2$ can be formed. Incidentally, though it is possible to perform coating by the use of only slurry containing $SiO_2$ particles, by adding the aforementioned plate-shaped filler, the coating material obtained is densified. This enables to form a coating material excellent in sealability. By the aforementioned third and fourth coating material manufacturing method, the thickness of the coating material is, for example, 10 to 500 μm.

Since the coating material used for the heater of the present embodiment is made of a material containing at least one of ceramic and glass, it is excellent in thermal resistance. As the coating material, a material which can be used in the temperature range of 200° C. or more is preferable, and a material which can be used in the temperature range of 250° C. or more is more preferable. It is preferable to select coating material according to the necessary heat resistance depending on the specification of the heater.

In order to allow the coating material to effectively function as an insulating layer, the specific resistance of the coating material is preferably $10^8$ Ω·cm. The specific resistance of the coating material is preferably $10^8$ Ω·cm or more, particularly preferably $10^{10}$ Ω·cm or more.

(2) Still Another Embodiment of Heater:

Next, still another embodiment of a heater of the present invention will be described. As still another embodiment of a heater of the present invention, there can be mentioned a heater provided with various kinds of a vibration-absorbing structure as described below. A heater of the present invention is mounted in the periphery of an engine of an automobile or the like and can be used so as to heat a lubricating fluid such as engine oil and a transmission fluid. At this time, by the vibrations of the engine, acceleration is generated. Therefore, by a heater provided with a vibration-absorbing structure as described below, the impact due to vibrations is relaxed to be able to obtain a heater excellent in durability.

As the first vibration-absorbing structure, there can be mentioned a structure where an O ring or a packing made of resin, rubber, or the like, is disposed at the position where the electrode portion of the heater main body passes through the housing. For example, by allowing the O-ring 53 shown in FIGS. 4 and 5 to be a resin or rubber O ring 53, the first vibration-absorbing structure can be obtained.

In addition, as the second vibration-absorbing structure, there can be mentioned a structure where a buffer member is disposed in each portion of the heater. As the buffer member, a member made of resin, rubber, or the like can be mentioned. As the position for disposing the buffer member, a portion between the heater main body and the housing, a portion where the electrode portions pass through the housing, or the like can be mentioned.

In addition, as the third vibration-absorbing structure, there can be mentioned a structure where a stretchable vibration-absorbing portion is provided on a part of a pair of electrode portions of the heater main body. As the stretchable vibration-absorbing portion, an accordion-shaped portion stretchable in a predetermined direction can be mentioned. In the heater of the present embodiment, since the heater main body is fixed to the portion where a pair of electrode portions pass through the housing, strong vibration may be applied to the pair of electrode portions. Therefore, by the pair of electrode portions provided with such a stretchable vibration-absorbing portion, the vibrations applied to the heater main body can be absorbed in a good manner.

Figure 18:
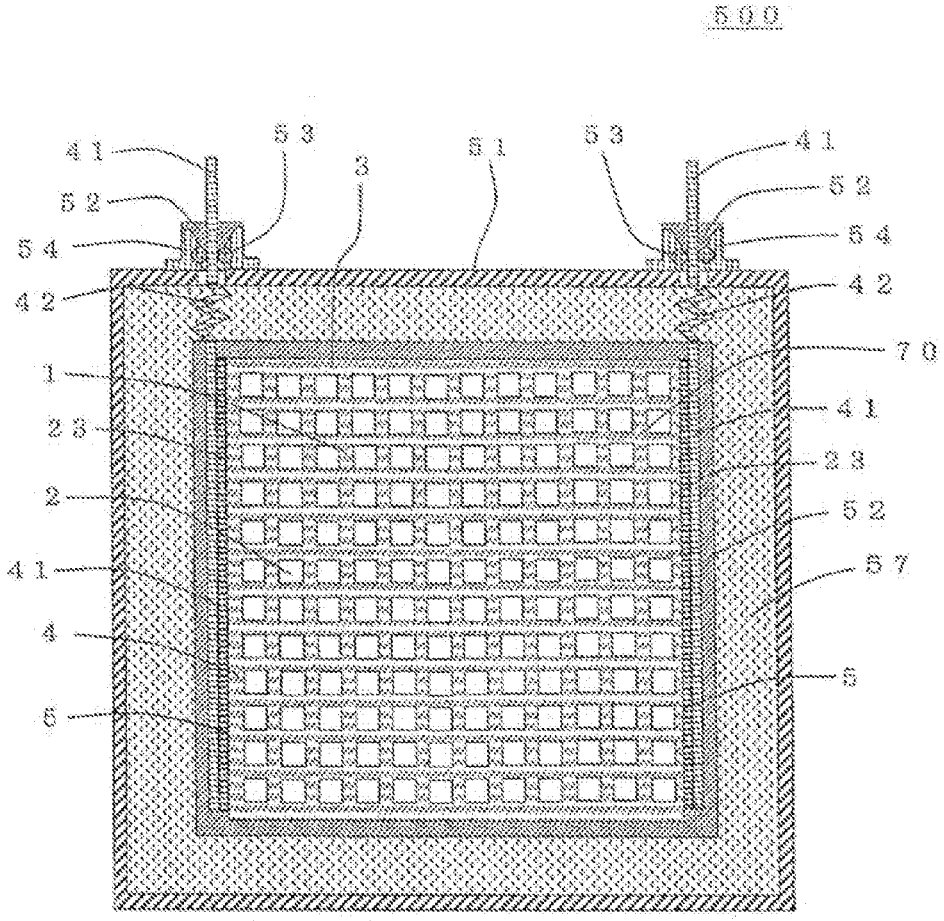
FIG. 18 is a cross-sectional view schematically showing still another embodiment of a heater of the present invention.

For example, as a heater provided with the third vibration-absorbing structure, there can be mentioned the heater 500 shown in FIG. 18. In the heater 500 shown in FIG. 18, there is shown an example where a part of each of the pair of electrode portions 41 is provided with an accordion-shaped vibration-absorbing portion 42. It is preferable that accordion-shaped vibration-absorbing portions 42 of the pair of electrode portions 41 are located inside the housing 51. This enables to absorb the vibrations applied to the heater main body 70 stored in the housing 51 in a good manner. FIG. 18 is a cross-sectional view schematically showing still another embodiment of a heater of the present invention. The cross section shown in FIG. 18 is a cross section perpendicular to the flow direction of the lubricating fluid flowing inside the heater main body. In FIG. 18, regarding elements constituted similarly to elements shown in FIG. 5, the same numerals are given, and the descriptions will be omitted.

As the fourth vibration-absorbing structure, there can be mentioned a structure employing the following connection method in an electrical connection method with respect to a pair of electrode portions of the heater main body. As an electrical connection method with respect to the pair of electrode portions, for example, there can be mentioned a method where the pair of electrode portions are connected to a cable for electrical connection in the housing and where the cable for electrical connection is pulled out to the outside of the housing to perform the electrical connection. As another connection method, for example, in the housing for storing the heater main body, a connector insertion port for inserting a connector for electrical connection is formed. Then, the connector for electrical connection is inserted from the connector insertion port of the housing to perform electrical connection to a pair of electrode portions of the heater main body stored in and fixed to the housing. In this connection method, a pair of electrode portions are stored in the housing together with the honeycomb structural portion. That is, since a pair of electrode portions are not constituted in such a manner that they pass through the housing to be extended to the outside, vibrations applied to the housing are hardly transferred to the heater main body.

Figure 19:
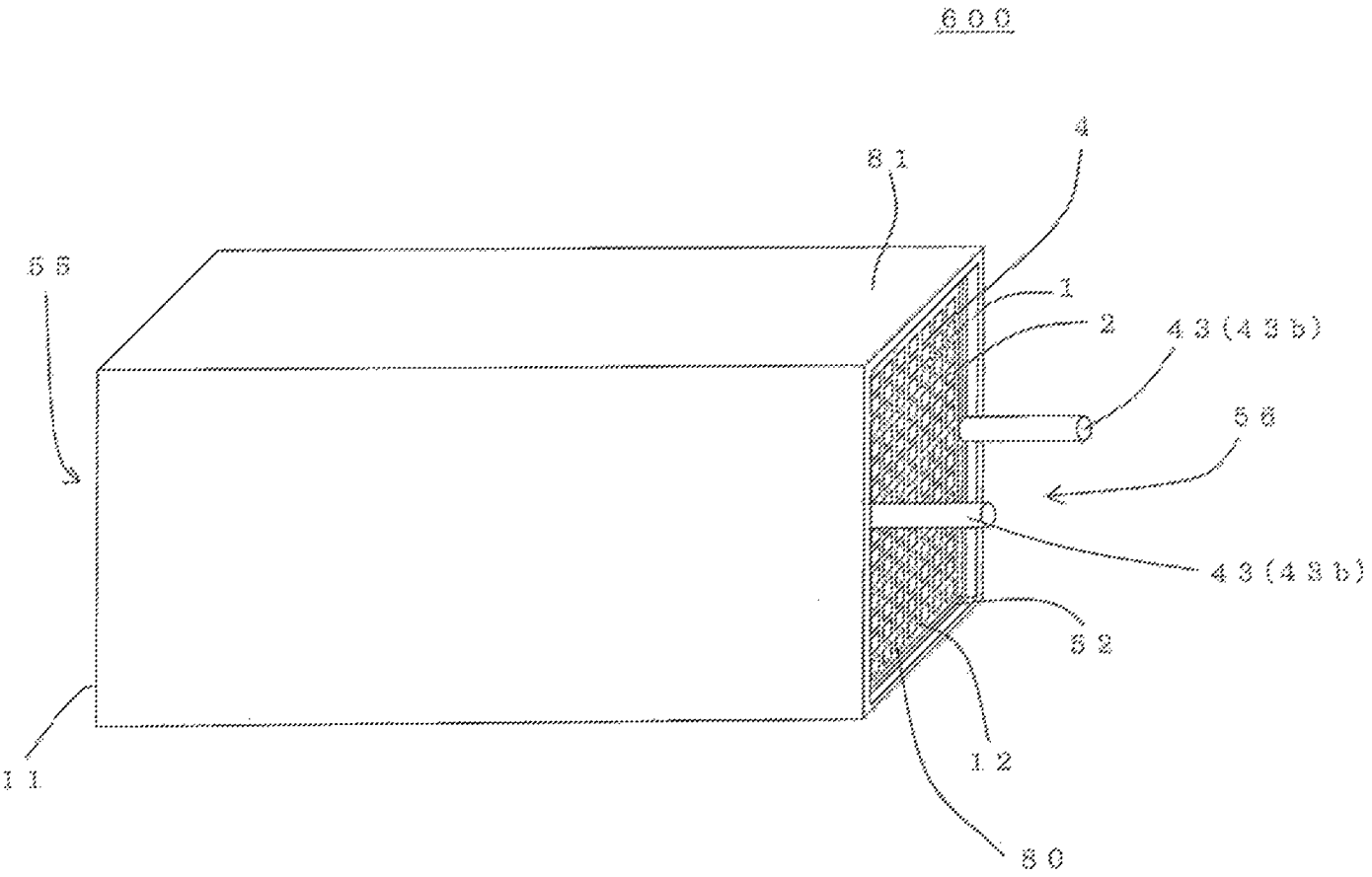
FIG. 19 is a perspective view schematically showing still another embodiment of a heater of the present invention.
Figure 20:
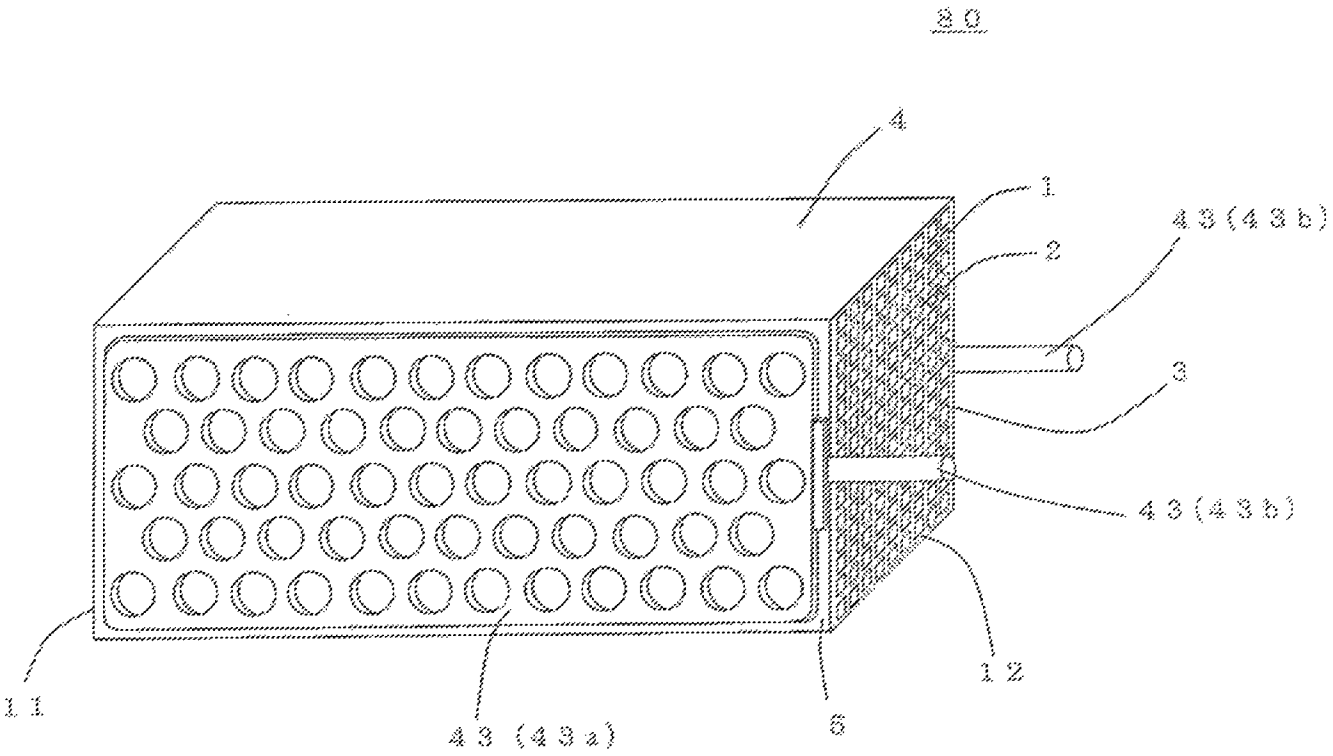
FIG. 20 is a perspective view schematically showing a heater main body of a heater shown in FIG. 19.

As still another embodiment of a heater of the present invention, there can be mentioned a heater constituted so that a part of electrode portions are extended to the outside from the inflow port side and the outflow port side of the housing. That is, though the heater 100 shown in FIG. 1 is constituted in such a manner that a pair of electrode portions 21 are extended outside from the side face of the housing 51, it may be constituted so that they are extended outside from the inflow port side or the outflow port side of the housing. As such a heater, for example, there can be mentioned the heater 600 shown in FIG. 19. FIG. 19 is a perspective view schematically showing still another embodiment of a heater of the present invention. FIG. 20 is a perspective view schematically showing the heater main body of the heater shown in FIG. 19. In FIGS. 19 and 20, regarding elements constituted similarly to elements shown in FIGS. 1 to 5, the same numerals are given, and the descriptions will be omitted. The heater 600 shown in FIGS. 19 and 20 is constituted in such a manner that a pair of electrode portions 43 are extended outside from the outflow port 56 of the housing 81. By the constitution where an electric power is supplied to the pair of electrode portions 43 from the outflow port 56 side, escape of heat from the pair of electrode portions 43 can be inhibited. This enables to heat the lubricating fluid at uniform temperature. In addition, in such a heater 600, in comparison with the constitution where an electric power is supplied to the pair of electrode portions from the top of the side face of the housing, the temperature gradient of the lubricating fluid seems to be hardly given between the top portion and the bottom portion of the housing.

As shown in FIG. 20, each of the electrode portions 43 of the heater main body 80 has an electrode substrate 43*a* disposed on the side face 5 of the honeycomb structural portion 4 and an electrode terminal portion 43*b* extended to the downstream side of the flow direction of the lubricating fluid from the electrode substrate 43. The electrode terminal portion 43*b* is constituted so as to extend to the outside from the outflow port 56 (see FIG. 19) of the housing 81 (see FIG. 19).

Figure 21:
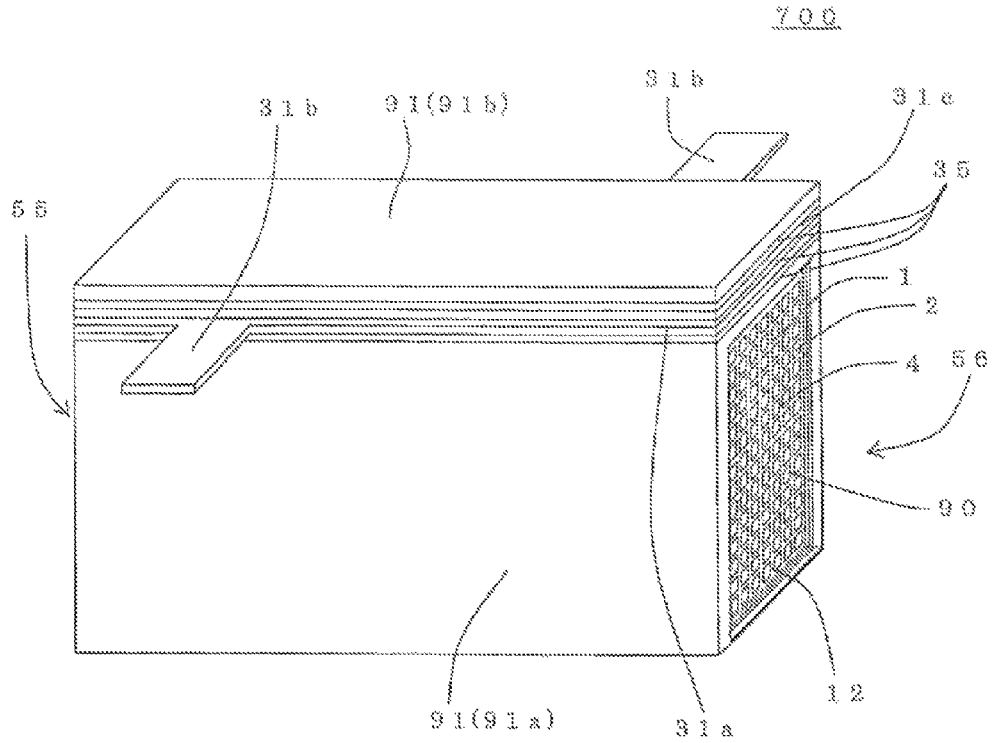
FIG. 21 is a perspective view schematically showing still another embodiment of a heater of the present invention.
Figure 22:
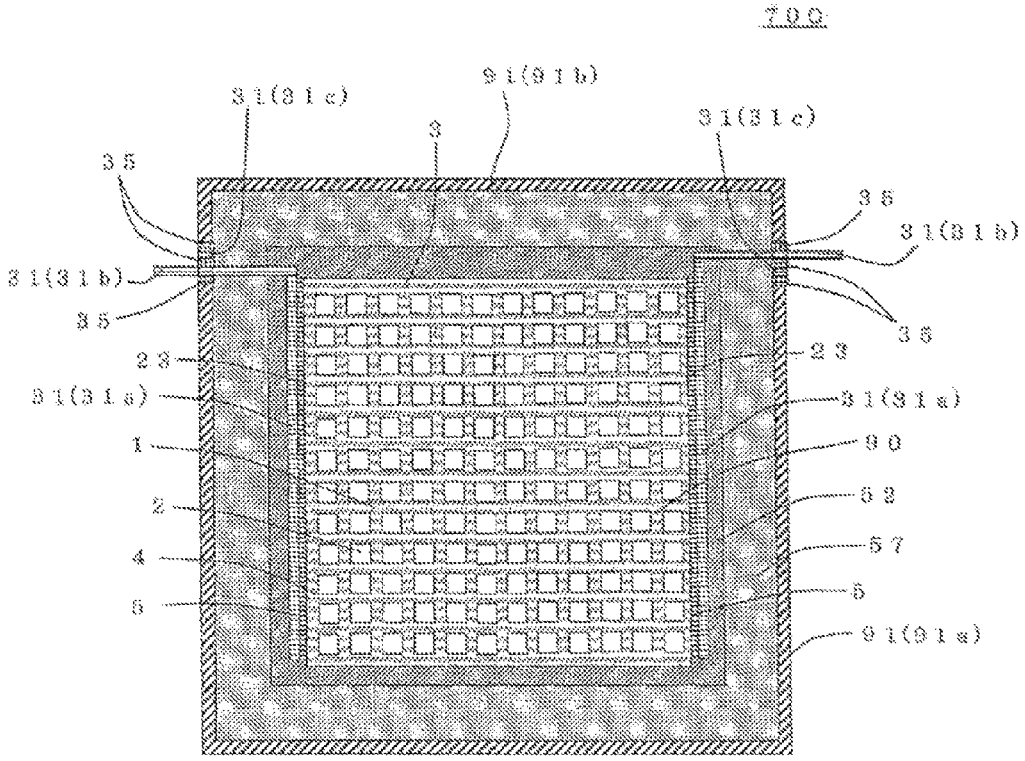
FIG. 22 is a cross-sectional view schematically showing a cross section perpendicular to the flow direction of a lubricating fluid flowing inside the heater main body of the heater shown in FIG. 21.
Figure 23:
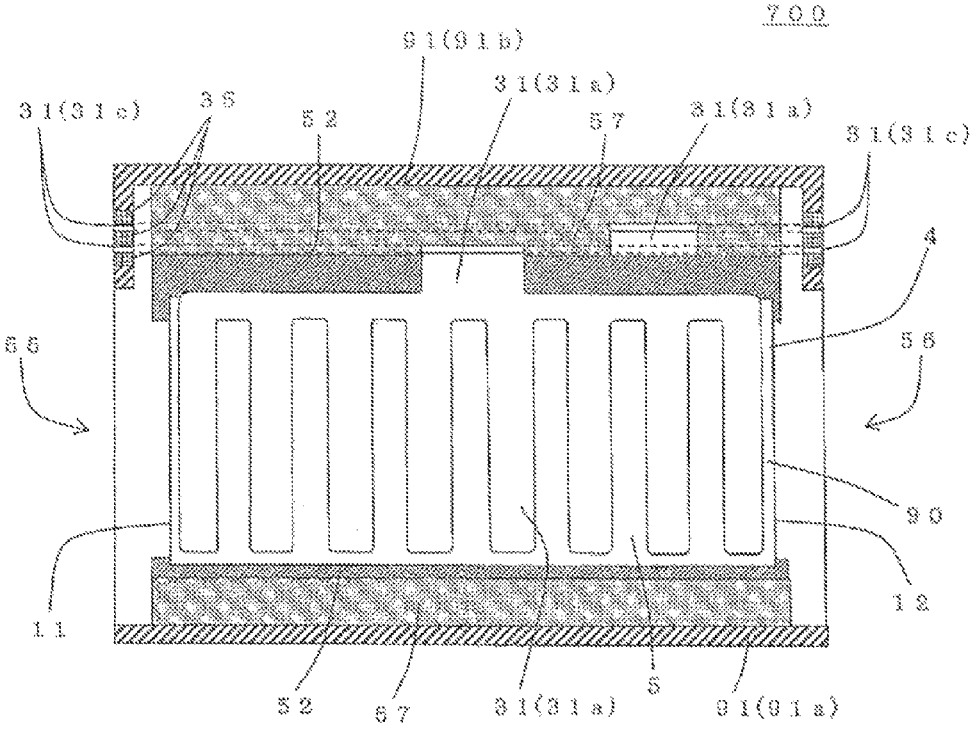
FIG. 23 is a cross-sectional view schematically showing a cross section parallel to the flow direction of a lubricating fluid flowing inside the heater main body of the heater shown in FIG. 21.
Figure 24:
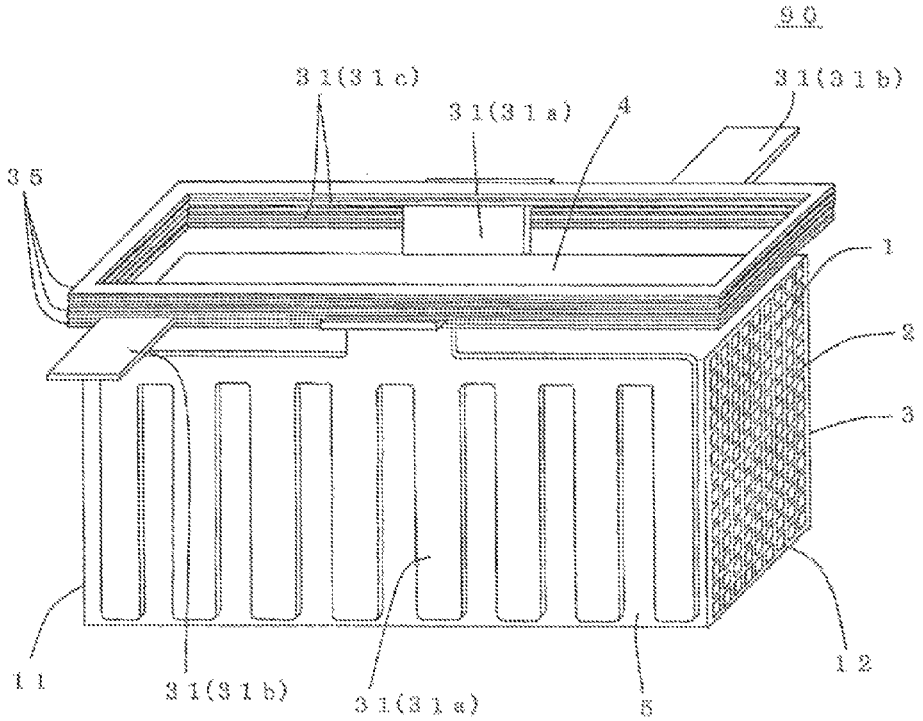
FIG. 24 is a perspective view schematically showing the heater main body of the heater shown in FIG. 21.
Figure 25:
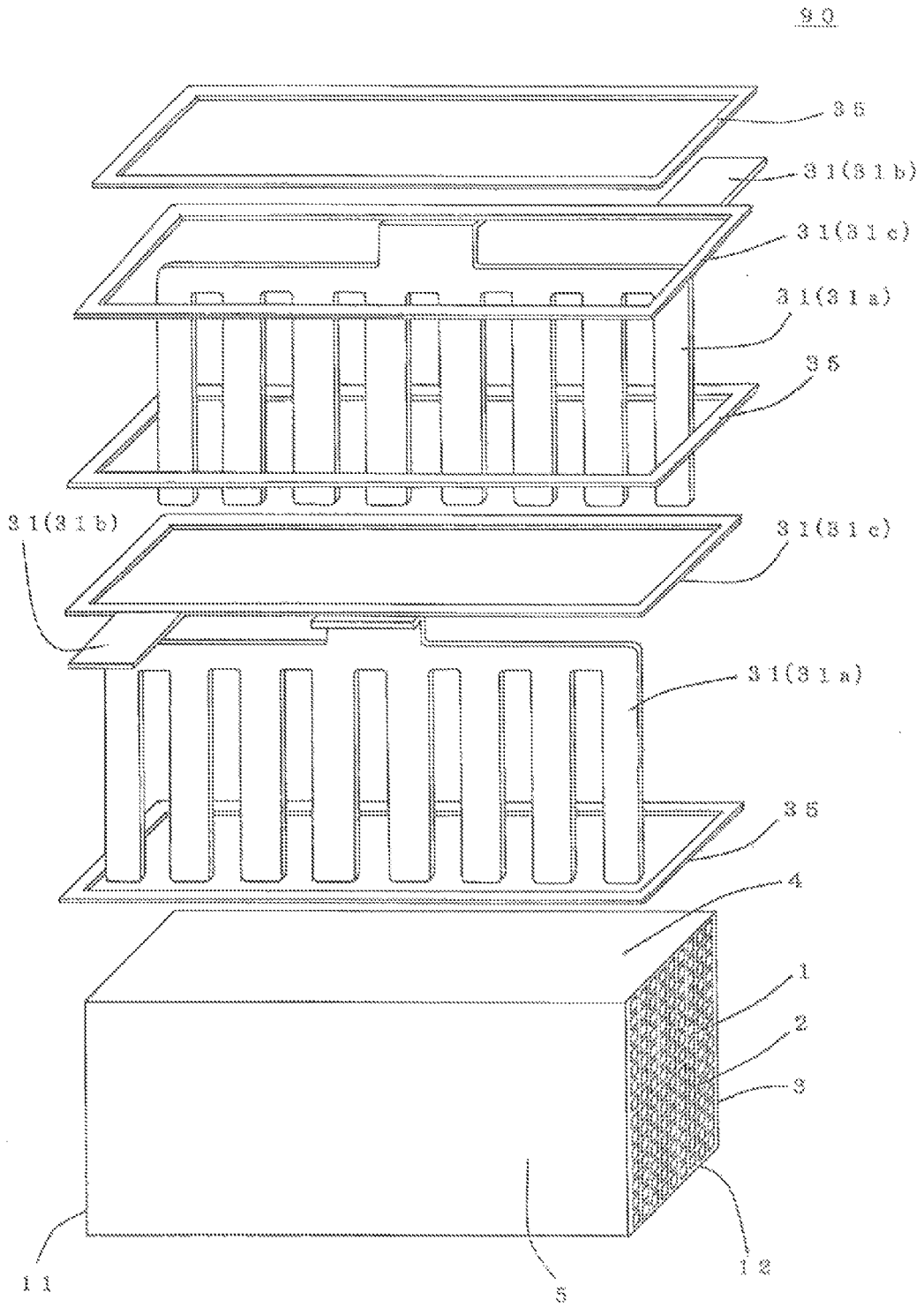
FIG. 25 is a developed perspective view schematically showing a developed state of the heater main body shown in FIG. 24.

As still another embodiment of a heater of the present invention, the heater 700 shown in FIGS. 21 to 23 can be mentioned. In the heater 700, a heater main body 90 as shown in FIGS. 24 and 25 is stored in the housing 91. Between the housing 91 and the heater main body 90 are disposed a coating material 52 and an adiabatic material 57. Here, FIG. 21 is a perspective view schematically showing still another embodiment of a heater of the present invention. FIG. 22 is a cross-sectional view schematically showing a cross section perpendicular to the flow direction of a lubricating fluid flowing inside the heater main body of the heater 700 shown in FIG. 21. FIG. 23 is a cross-sectional view schematically showing a cross section parallel to the flow direction of a lubricating fluid flowing inside the heater main body of the heater 700 shown in FIG. 21. FIG. 24 is a perspective view schematically showing the heater main body of the heater 700 shown in FIG. 21. FIG. 25 is a developed perspective view schematically showing a developed state of the heater main body 90 shown in FIG. 24.

As shown in FIGS. 21 to 25, the housing 91 in the heater 700 of the present embodiment is constituted of a housing main body 91*a* having an opening portion on one face and a lid portion 91*b* for covering the opening portion of the housing main body 91*a*. In addition, the heater main body 90 has a honeycomb structural portion 4 and a pair of electrode portions 31.

In the heater 700 of the present embodiment, each of the electrode portions 31 is constituted of an electrode substrate 31*a*, electrode terminal portion 31*b*, and electrode substrate connection portion 31*c*. The electrode substrate 31*a* is disposed on the side face 5 of the honeycomb structural portion 4 to apply a voltage to the honeycomb structural portion 4. FIGS. 24 and 25 show an example of the case where the electrode substrates 31*a* are formed into a comb shape. The electrode substrate connection portion 31*c* is a portion for connecting the electrode substrate 31*a* to the electrode terminal portion 31*b*. In the heater 700 of the present embodiment, each electrode substrate connection portion 31*c* of the pair of electrode portions 31 is sandwiched between the housing main body 91*a* and the lid portion 91*b* in the state of lamination by means of a sealing material 35 having electrical insulation properties. The electrode terminal portion 31*b* is extended from the electrode substrate connection portion 31*c* sandwiched between the housing main body 91*a* and the lid portion 91*b*.

In the heater 700 of the present embodiment, by sandwiching the electrode substrate connection portion 31*c* in the state of lamination by means of the sealing material 35 between the housing main body 91*a* and the lid portion 91*b*, the electrode portion 31 is led out from the housing 91. Therefore, the heater 700 of the present embodiment is excellent in pressure resistance. That is, this constitution can inhibit leakage of the lubricating fluid from the portions for leading out the electrode portions 31 when the lubricating fluid flows inside the heater 700.

Figure 27:
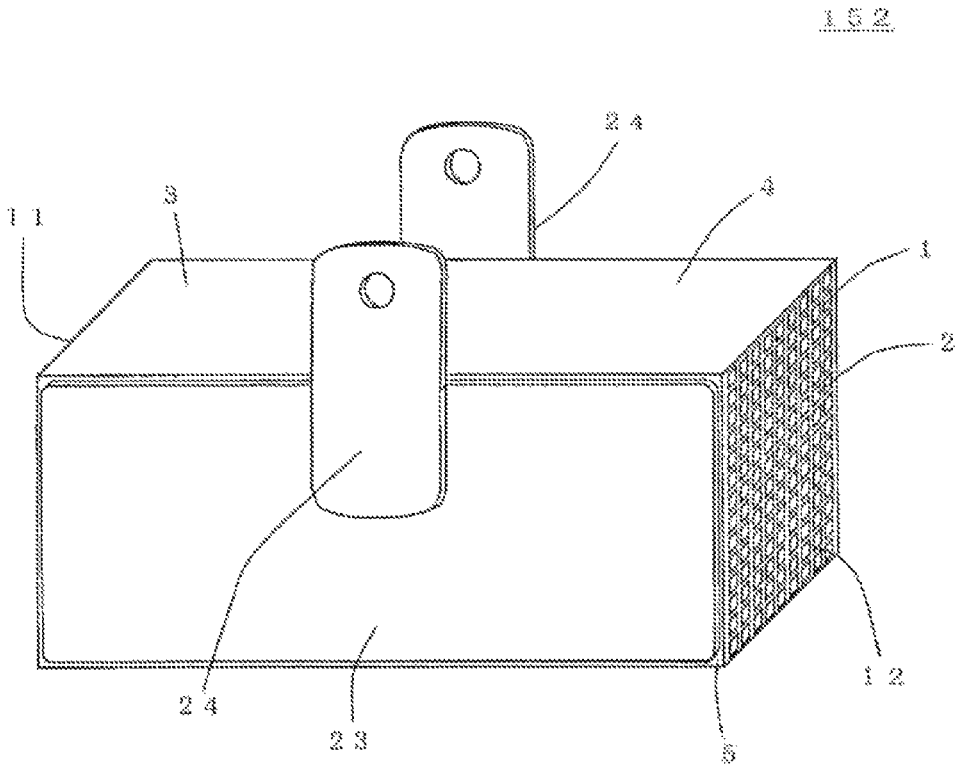
FIG. 27 is a perspective view schematically showing a heater main body used for still another embodiment of a heater of the present invention.

In addition, as another embodiment of a heater of the present invention, there can be mentioned a heater provided with the following heater main body. The heater main body 152 shown in FIG. 27 is provided with a cylindrical honeycomb structural portion 4 and a pair of electrode portions 24 bonded to side faces 5 of the honeycomb structural portion 4 by means of conductive bond portions 23. The honeycomb structural portion 4 has the partition walls 1 separating and forming a plurality of cells 2 extending from one end face 11 to the other end face 12 functioning as fluid passages of the lubricating fluid and the outer peripheral wall 3 located in the outermost periphery. The partition walls 1 are made of a material containing ceramic as the main component and generate heat by energizing. The conductive bond portions 23 are disposed on the two side faces 5 of the honeycomb structural portion 4. By means of the conductive bond portions 23, electrode portions 24 having curved corners are bonded. It is preferable that the conductive bond portions 23 contain metal and are formed by thermal spraying, cold spraying, or plating. Also, in such a heater main body 152, by being stored in the housing in the same manner as in the heater main body 50 shown in FIG. 6, the heater of the present embodiment can be obtained.

Figure 28:
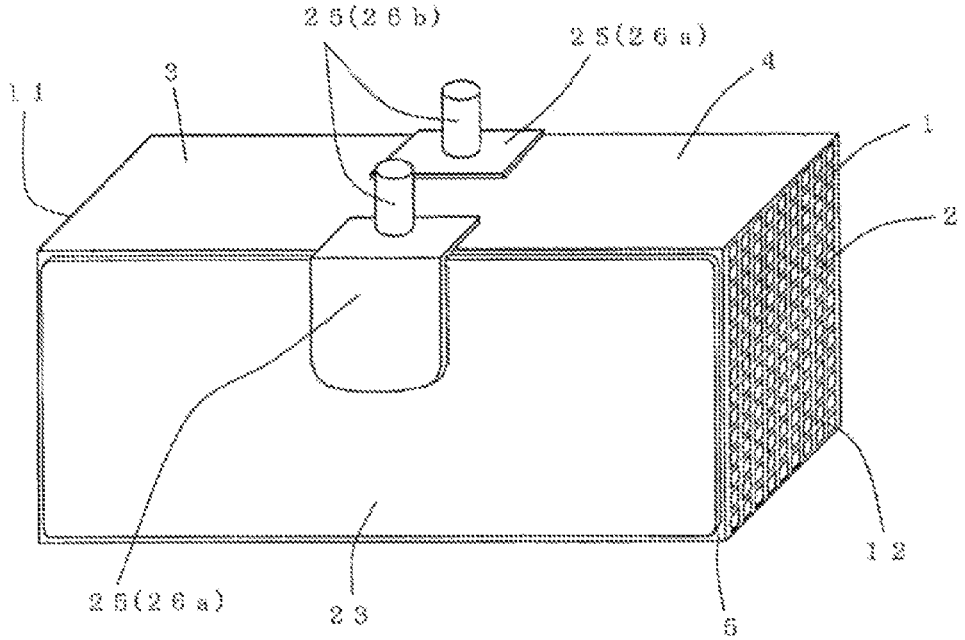
FIG. 28 is a perspective view schematically showing a heater main body used for still another embodiment of a heater of the present invention.

In addition, as another embodiment of a heater of the present invention, there can be mentioned a heater provided with a heater main body 153 shown in FIG. 28. The heater main body 153 shown in FIG. 28 is provided with a cylindrical honeycomb structural portion 4 and a pair of electrode portions 25 bonded to the side faces 5 of the honeycomb structural portion 4 by means of a conductive bond portion 23. The electrode portions 25 have electrode substrates 26*a* and rod-shaped electrode portions 26*b* disposed so as to be connected to the electrode substrate 26*a*. Also, in such a heater main body 153, by being stored in a housing in the same manner as in the heater 60 shown in FIG. 17, a heater of the present embodiment can be obtained. In the case of this heater main body 153, it is preferable that a wire from the outside power source or the like is connected to the rod-shaped electrode portions 26*b*. It is preferable that each of the electrode substrates 26*a* of the pair of electrode portions 25 is bonded to a side face 5 of the honeycomb structural portion 4 by means of a conductive bond portion 23 and that a part thereof is bent along the side face where the pair of electrodes 25 are not disposed of the honeycomb structural portion 4. Here, FIGS. 27 and 28 are perspective views schematically showing a heater main body used for still another embodiment of a heater of the present invention. In FIGS. 27 and 28, regarding elements constituted similarly to elements shown in FIGS. 6 and 17, the same numerals are given, and the descriptions will be omitted.

(3) Method for Manufacturing Heater:

Next, a method for manufacturing a heater of the present embodiment will be described. In addition, the method for manufacturing a heater of the present embodiment is not limited to the following manufacturing method.

In the first place, a description will be made regarding an example of manufacturing a honeycomb structural portion containing Si composite SiC as the main component. A SiC powder, a metal Si powder, water, organic binder, and the like are mixed together and kneaded to prepare a kneaded material. The kneaded material is formed into a honeycomb shape to obtain a honeycomb formed body. Then, by firing the honeycomb formed body in an inert gas atmosphere, a honeycomb structural portion containing Si composite SiC as the main component can be manufactured.

Next, an example of manufacturing a honeycomb structural portion containing Si-impregnated SiC as the main component will be described. In the first place, a SiC powder, a metal Si powder, water, an organic binder, and the like are mixed and kneaded to prepare a kneaded material. Then, the kneaded material is formed into a honeycomb structure to obtain a honeycomb formed body. Then, the honeycomb formed body is fired in an inert gas atmosphere to form a honeycomb structure. Then, the honeycomb structure is impregnated with Si in an inert gas atmosphere to be able to manufacture a honeycomb structural portion containing Si-impregnated SiC as the main component. Incidentally, manufacturing of the recrystallized SiC and reaction-sintered SiC is as described above.

In the aforementioned method of manufacturing a honeycomb structural portion containing Si-impregnated SiC as the main component, the kneaded material may be prepared by mixing and kneading a SiC powder, water, an organic binder, and the like. That is, it is not necessary that the raw material for the kneaded material contains a metal Si powder.

In addition, as another material for constituting the partition walls and the outer peripheral wall, there can be mentioned silicon carbide, Fe-16Cr-8Al, $SrTiO_3$ (perovskite), $Fe_2O_3$ (corundum), $SnO_3$ (rutile), ZnO wurzite) and the like. By using such a material, the specific resistance of the partition walls and the outer peripheral wall can be made 0.01 to 50 Ω·cm. The specific resistance of the silicon carbide is generally so wide as 1 to 1000 Ω·cm, and, in the case of only SiC, it is preferable to make the specific resistance in the aforementioned range. In the case of combining with Si and an Si base alloy, though it depends on the microstructure organization, it is possible to apply a specific resistance of a maximum of 1000 Ω·cm. The specific resistance of Fe-16Cr-8Al is 0.03 Ω·cm. The specific resistance of SrTiOa (perovskite) is 0.1 Ω·cm or less. The specific resistance of $Fe_2O_3$ (corundum) is about 10 Ω·cm. The specific resistance of $SnO_3$ (rutile) is 0.1 Ω·cm or less. The specific resistance of ZnO (wurzite) is 0.1 Ω·cm or less.

In addition, upon manufacturing a honeycomb structural portion, the value of the metal Si content/(Si content+SiC content) is preferably 5 to 50. The value of the metal Si content/(Si content+SiC content) is more preferably 10 to 40. This constitution enables to control the specific resistance appropriately while maintaining the strength of the partition walls and the outer peripheral wall.

In order to secure the insulation properties on the surfaces of the partition walls, for example, an oxidation membrane may be formed on the surfaces of the partition walls by a high-temperature treatment at 1200° C. for 6 hours in the ambient atmosphere.

Next, a pair of electrode portions disposed on the side faces of the honeycomb structural portion are formed. As the material for the electrode portions, there can be mentioned, for example, stainless steel, copper, nickel, aluminum, molybdenum, tungsten, rhodium, cobalt, chrome, niobium, tantalum, gold, silver, platinum, palladium, alloys of these metals, and the like. As described above, the material for the electrode portions can appropriately be selected in consideration of a balance among crack generation in ceramic due to thermal stress, interfacial peeling of the electrode, electrode portions' own heat generation, costs, and the like. In addition, the electrode portions may be formed of molybdenum, tungsten, or a composite material such as a Cu/W composite material, Cu/Mo composite material, Ag/W composite material, SiC/Al composite material, and C/Cu composite material, which have an effect of reducing thermal stress upon heat cycle because the thermal expansion coefficient is close to that of the ceramic of the honeycomb structural portion.

Next, the electrode portions formed are bonded to the side faces of the honeycomb structural portion. Thus, a heater main body used for a heater of the present embodiment is manufactured.

Next, a coating material is formed so as to cover at least a part of the heater main body. In the case of manufacturing the coating material by coating, the coating material can be formed according to the aforementioned first to fourth coating material manufacturing methods.

Next, a housing used for the heater of the present embodiment is formed. When the material for the housing is metal, a cornered housing having a size where the heater main body can be stored is manufactured by a known method. As methods for manufacturing the housing, there may be mentioned methods of, for example, hot or cold press, forging, extrusion, and welding.

When the material of the housing is resin, a cornered housing having a size where the heater main body can be stored is manufactured. As materials for manufacturing a resin housing, there can be mentioned methods of, for example, resin molding, injection forming, extrusion, hollow forming, thermal forming, and compression forming.

In addition, in the case that the material for the housing is resin, the housing can be manufactured by forming in a state of storing the heater main body therein. However, in the case of manufacturing the housing with resin, it is preferable that the coating material is not brought into direct contact with the housing. For example, it is preferable that an adiabatic material is further disposed between the coating material formed on the side face of the heater main body and the housing or that a gap is formed between the aforementioned coating material and the housing. For example, it is preferable that, after forming a coating material made of a material containing at least one of ceramic and glass on at least a part of a side face of the heater main body, an adiabatic material is further disposed outside the coating material to manufacture a housing so as to cover the adiabatic material.

As described above, in the case of separately manufacturing a cornered housing having a size where the heater main body can be stored, the heater of the present embodiment can be manufactured by storing the heater main body where a coating material has been formed so as to cover at least a part of a side face. Incidentally, in the case of disposing an adiabatic material or the like between the coating material and the housing, after storing the heater main body in the housing, an adiabatic material or the like is appropriately disposed between the coating material and the housing.

In addition, a coating material made of a material containing at least one of ceramic and glass may separately be manufactured. In such a case, after storing the heater main body in the housing, a coating material, an adiabatic material, and the like are appropriately disposed between the heater main body and the housing to manufacture the heater of the present embodiment.

Here, a specific example of a method for manufacturing the heater 402A shown in FIG. 11 will be described. In the first place, a honeycomb structural portion 4 is manufactured by the aforementioned method. Next, the electrode portions 21 are bonded to two faces disposed parallel to each other among the side faces 5 of the honeycomb structural portion 4. The electrode portions 21 can be formed of Ni, Cu, Mo, W, or Cu/W composite material. This enables to manufacture a heater main body 50 having a pair of electrode portions 21 formed on two side faces 5 of the honeycomb structural portion 4.

Next, on the outer peripheral portion of the heater main body 50 obtained above, a coating material 52 is formed according to the aforementioned first to fourth manufacturing methods.

Next, an adiabatic material 57 is further disposed so as to further cover the coating material 52 formed on the side face 5 of the honeycomb structural portion 4. As the adiabatic material 57, there can be used a ceramic fiber sheet ($Al_2O_3$—$SiO_2$ base or the like). In addition, though it is not illustrated in FIG. 11, a resin sheet may further be disposed so as to further cover the adiabatic material 57. As the resin sheet, a sheet made of silicone resin, fluorine resin, or the like can be used.

Next, the heater main body 50 having a coating material 52 formed in the outer peripheral portion thereof and an adiabatic material 57 further disposed outside thereof is disposed in a SUS housing main body. Then, a SUS lid portion is disposed on the housing main body in such a manner that a part of each of the pair of electrode portions 21 is exposed outside. The housing main body and the lid portion are connected by, for example, laser welding or the like to store the heater main body 50 in the housing 51. As the lid portion, it is preferable that the electrode leading portions 54 are provided at the position where the pair of electrode portions 21 pass through and that an O ring 53 made of fluorine resin or the like is disposed inside each of the electrode leading portions 54.

In addition, it is preferable that a coating material 52 is further disposed in a boundary portion where each of the pair of electrode portions 21 is exposed outside from each of the electrode leading portions 54. That is, it is preferable that the boundary portions where the pair of electrode portions 21 are exposed outside are sealed by the coating materials 52. This constitution enables to secure the insulation upon connecting terminals or the like for energization to the pair of electrode portions 21 in a good manner. Thus, the heater 402A shown in FIG. 11 can be manufactured.

In addition, as shown in FIG. 14, when the housing 73 is made of resin, the resin housing 73 is manufactured by a method such as resin molding, injection molding, extrusion, hollow forming, thermal forming, compression forming, and the like. Then, a heater main body 60 where a coating material 52 is formed on the outer peripheral portion and where an adiabatic material 57 is further disposed outside thereof is disposed in the resin housing 73 to manufacture the heater 405. Also, in the case of using a resin housing 73, the methods for manufacturing the heater main body 60 and the coating material 52 are the same as the manufacturing methods described above.

EXAMPLE

Hereinbelow, the present invention will be described more specifically by Examples. However, the present invention is by no means limited to these Examples.

Example 1

In the first place, a honeycomb structural portion containing Si composite SiC as the main component was manufactured. Specifically, a SiC powder, a metal Si powder, water, and organic binder were mixed together and kneaded to prepare a kneaded material. Next, the kneaded material was formed into a honeycomb shape to obtain a honeycomb formed body. Then, by firing the honeycomb formed body in an inert gas atmosphere, a honeycomb structural portion containing Si composite SiC as the main component was manufactured. The Si composite SiC honeycomb body had a porosity of 40%.

The shape of the honeycomb structural portion was cylindrical having square end faces. The length of one side of the square of the end faces was 38 mm. The length in the cell extension direction of the honeycomb structural portion was 50 mm. The thickness of the partition walls was 0.38 mm. The thickness of the outer peripheral wall was 0.38 mm. The cell density of the honeycomb structural portion was 47 cells/$cm^2$. The specific resistance of the partition walls and the outer peripheral wall was 30 Ω·cm.

Then, the honeycomb structural portion was subjected to an oxidation treatment in the atmosphere to form an oxidized membrane for insulation on the surfaces of the partition walls and the outer peripheral wall. Then, after each of a pair of faces facing each other among the four faces of the outer peripheral wall of the honeycomb structural portion was subjected to surface processing to remove the oxidized membrane, electrode portions were disposed to manufacture a heater main body. Here, as the connection method of the electrode portions, the electrode portions were connected to the outer peripheral wall of the honeycomb structural portion by using a conductive paste containing a nickel powder as a conductive connection material and a silicate solution and firing in the atmosphere. As each electrode portion, there was used one having a main body of the electrode portion disposed actually on a side face of the honeycomb structural portion and a protruding portion extending from the main body of the electrode portion. The main body of the electrode portion has a face having the same size as the side face of the honeycomb structural portion to be disposed. The protruding portion of the electrode portion becomes a terminal portion for securing the electrical connection with the power source. The material for the electrode portion was pure metal nickel (Ni). Incidentally, the electrode portion whose surface was roughened by sandblasting was used. Thus, there was manufactured a heater main body having a pair of electrode portions disposed on two side faces of the honeycomb structural portion.

Next, as shown in FIG. 5, an inorganic heat resistant adhesive containing ceramic as the main component was coated on the outer peripheral portion of the heater main body 50 obtained above. As the inorganic heat resistant adhesive, an adhesive containing $SiO_2$—$Al_2O_3$ as the main component was used. The method for coating is as follows. In the first place, an inorganic resin adhesive before coating was homogenized by mixing again at below 100 rpm with a ball mill. Then, the homogenized inorganic heat resistant adhesive was coated by brush coating. The coated inorganic heat resistant adhesive was heated at 80° C. as preheating for inhibiting crack generation and then heated at 150° C. to manufacture a coating material made of ceramic. The coating material was subjected to a ceramic pore sealing material treatment to be densified. The thickness of the coating material 52 was 0.4 mm. The method of manufacturing a coating material by coating an inorganic heat resistant adhesive is defined as "A type". In the column of "coating material manufacturing method" in Table 1, the manufacturing method of the coating material in Example 1 is shown.

Next, a housing 51 for storing the heater main body 50 therein was manufactured. The housing 51 was constituted of a housing main body 51*a* for storing the heater main body 50 therein and a lid portion 51*b* to serve as a lid for the housing main body 51*a*. The housing 51 was a cornered body having a size where a gap of about 0.5 to 1 mm was made between the heater main body 50 having a coating material thereon and the housing 51 when the heater main body 50 was stored in the housing 51. In the housing 51, the inflow port where the lubricating fluid flows in and the outflow port where the lubricating fluid flows out were formed. As the material for the housing 51, widely used stainless steel (SUS304) was employed. The thickness of the metal material constituting the housing 51 was 1.5 mm. As the lid portion 51*b*, electrode leading portions 54 were provided at the positions where a pair of electrode portions 21 were to be passed, and O rings 53 made of fluorine resin were disposed inside the electrode leading portions 54.

The heater main body 50 having the coating material 52 disposed in the outer peripheral portion thereof was arranged in the SUS housing main body 51*a*. Then, a lid portion 51*b* made of SUS304 which is the same as the material for the housing main body was disposed in such a manner that a part of each of the pair of electrode portions 21 was exposed to the housing main body 51*a*. The housing main body 51*a* and the lid portion 51*b* were connected by laser welding to store the heater main body 50 in the housing 51. Thus, a heater of Example 1 was manufactured.

Table 1 shows the material for the electrode portions, structure of the electrode portions, structure of the housing, material for the partition walls, porosity (%) of the partition walls, and specific resistance (Ω·cm) of the partition walls and the outer peripheral wall. The "flat plate type" in the column of the "structure of electrode portion" in Table 1 means an electrode portion 21 as shown in FIG. 5. That is, it means a structure where each of the electrode portions 21 is formed into a flat plate shape and where a part of each of the electrode portions 21 disposed on a side face 5 of the honeycomb structural portion 4 is led to the outside of the housing 51. In addition, the "rod type" in the column of the "structure of electrode portion" in Tables 1 to 3 means a structure where each of the electrode portions 21 is composed of an electrode substrate 22*a* disposed on a side face of the honeycomb structural portion 4 and a rod-shaped electrode portion 22*b* disposed so as to be connected to the electrode substrate 22*a* as shown in FIGS. 15 to 17.

In addition, the "structure of housing" in Tables 1 to 3 shows the structure inside the housing in the heater of each Example with the structures shown in FIGS. 5, 11, 12, 13, and 14 as Examples. That is, in the case that the "structure of housing" is FIG. 5, it shows a heater having a structure where a coating material is disposed so as to cover the outer periphery of the heater main body and where the heater main body covered with the coating material is stored in the housing in a state that a gap is provided between the coating material and the housing. When the "structure of housing" is as in FIGS. 11 and 12, it means a heater having a structure where a coating material is disposed so as to cover the heater main body and where an adiabatic material is further disposed so as to cover the coating material. Incidentally, in FIG. 11, the "structure of electrode portion" is a "flat plate type". In addition, in FIG. 12, the "structure of electrode portion" is a "rod type". When the "structure of housing" is as in FIG. 13, it shows a heater constituted so that the lubricating fluid flows also outside the outer peripheral wall of the honeycomb structural portion. When the "structure of housing" is as in FIG. 14, it shows that the housing is formed of a resin material.

An energization heating test was performed in the following method by the use of the heater of Example 1 obtained above. The conversion efficiency (%) of Example 1 obtained from the result of the energization heating test is shown in Table 1.

[Energization Heating Test]

Figure 26:
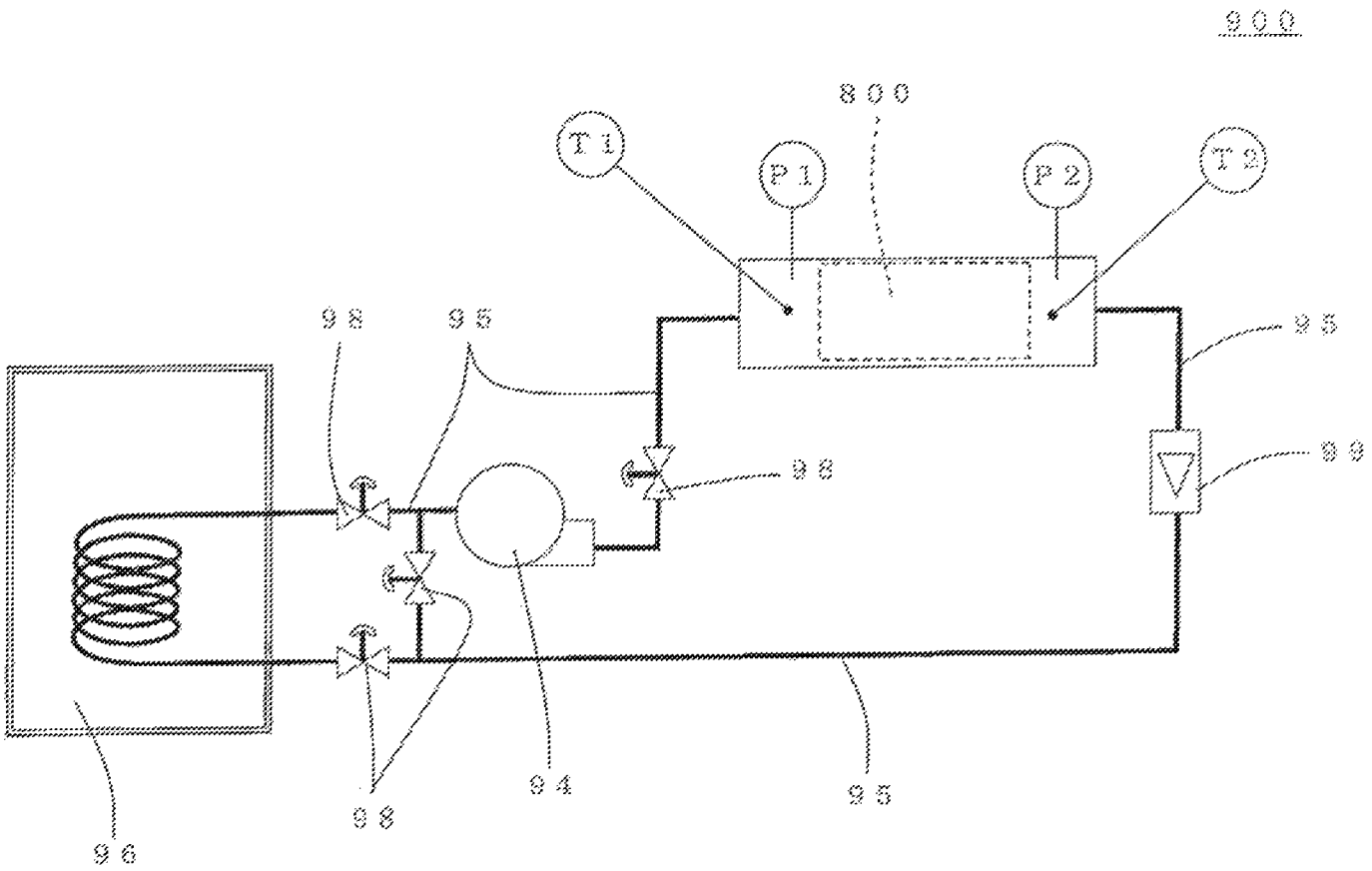
FIG. 26 is an explanatory view for explaining a test method of an energization heating test in Example.

In the first place, a heater 800 of each Example is disposed on the energization heating test apparatus 900 as shown in FIG. 26. The energization heating test apparatus 900 is provided with a pipe 95 where the lubricating fluid circulates. To the pipe 95 is connected a pump 94, and the lubricating fluid circulates in the pipe 95 by driving the pump 94. In addition, on the pipe 95 are disposed a valve 98 and a flowmeter 99. A thermocouple T1, T2 and pressure gauges P1, P2 are disposed on the inlet port side and the outlet port side of the heater 800. This enables to measure the temperature and pressure of the lubricating fluid flowing in from the inflow port of the housing of the heater 800 and the temperature and pressure of the lubricating fluid flowing out from the outflow port of the housing of the heater 800. The cooler 96 is used so as to adjust the initial temperature of the lubricating fluid. FIG. 26 is an explanatory view for explaining the test method of the energization heating test in Examples.

As described above, the heater 800 is disposed on the energization heating test apparatus 900, and the pump 94 is driven to pass the lubricating fluid through the heater 800. A voltage of a value shown in Table 1 is applied to the heater main body of the heater 800 where the lubricating fluid is passed to heat the lubricating fluid by the heater 800. While measuring the temperature of the lubricating fluid flowing in from the inflow port of the housing and the temperature of the lubricating fluid flowing out from the outflow port of the housing with the thermocouple T1, T2, the time (sec.) elapsed till the temperature of lubricating fluid flowing out from the outflow port of the housing reaches 60° C. was measured. As the lubricating fluid, commercially available engine oil (grade: OW-30, "Mobil 1 (trade name)" produced by Exxon Mobil Corporation) was used. Table 1 shows the applied voltage (V), flow rate (L/min) of lubricating fluid passed through the heater, and initial temperature (° C.) of the lubricating fluid. The initial temperature of the lubricating fluid means the temperature of the lubricating fluid before being heated by the heater.

From the temperature of the lubricating fluid and the time till the temperature reaches 60° C., the conversion efficiency (%) of the heater subjected to the energization heating test was obtained according to the following formula (1). Incidentally, the conversion efficiency here is average time upon the test. The "heat transfer amount to the lubricating fluid" in the following formula (1) is a value calculated from the following formula (2). The "input electric energy" in the following formula (1) is a value calculated from the following formula (3). Incidentally, the "temperature difference of lubricating fluid" in the formula (2) means the difference between the "temperature of the lubricating fluid flowing out from the outflow port of the housing" and the "temperature of the lubricating fluid flowing in from the inflow port of the housing" at the time that the temperature of the lubricating fluid flowing out from the outflow port of the housing reaches 60° C.

Conversion efficiency (%)=heat transfer amount to lubricating fluid/input electric energy (1)

Heat transfer amount to the lubricating fluid=flow rate of lubricating fluid×specific heat×temperature difference of lubricating fluid (2)

Input electric energy=electric power(*W*)×time (sec.) (3)

In the energization heating test, according to the value of specific resistance of the honeycomb structural portion of the heater main body of each Example, the voltage applied to the heater main body was adjusted for the test. That is, a heater main body having relatively high specific resistance was determined as a "high resistance article", and the applied voltage was set in the range of 100 to 400V. In addition, a heater main body having relatively low specific resistance was determined as a "low resistance article", and the applied voltage was set in the range of 10 to 60V.

heaters, the energization heating test was performed in the same manner as in Example 1. The conversion efficiency (%) obtained from the results of the energization heating test is shown in Table 1. Table 1 shows the applied voltage (V), flow rate of the lubricating fluid passed through the heater (L/min), and initial temperature of the lubricating fluid (° C.) in the energization heating test.

In Examples 3 to 6 where the "structure of housing" is as in FIG. 11, as the adiabatic material, a ceramic fiber sheet ($Al_2O_3$—$SiO_2$ base) having a thickness of 5 mm was used. In addition, in Example 6, as the material for the electrode portions, pure metal copper (Cu) was used. Incidentally, also in the other Example where the "structure of housing" is FIG. 11 or 12, there was used a ceramic fiber sheet ($Al_2O_3$—$SiO_2$ base) having a thickness of 5 mm as the adiabatic material in the same manner as in Examples 3 to 6.

Example 7

In Example 7, a heater was manufactured in the same method as in Example 3 except that a coating material was manufactured as follows. Here, the ceramic pore sealing material used in Example 1 was used as the coating material. As the ceramic pore sealing material, there was used a material containing tetraethyl orthosilicate (TEOS: $Si(OC_2H_5)_4$), silane coupling agent, 2 propanol, 1 butanol, and water as the main component. In the first place, after homogenization by mixing again at below 100 rpm by the use of a ball mill before being used, it was coated on the outer peripheral portion of the heater main body by brush coating. The ceramic pore sealing material coated above was fired at 80° C. as preheating for inhibiting crack generation, then fired at 150° C., and further fired at 350° C. as the main firing in the atmosphere to manufacture a coating material made of ceramic. The thickness of

TABLE 1

| | Electrode portion | | Structure | Manufacturing method of | | Porosity of partition | Specific resistance of partition wall and outer | Energization heating test | | | |
|---|---|---|---|---|---|---|---|---|---|---|---|
| | Material | Structure | of housing | coating material | Material for partition wall | wall (%) | peripheral wall (Ω · cm) | Applied voltage (V) | Flow rate of lubricating fluid (L/min) | Initial temperature of lubricating fluid (° C.) | Conversion efficiency (%) |
| Example 1 | Ni | Flat plate type | FIG. 5 | A type | Si composite SiC | 40 | 30 | 200 | 7.5 | 30 | 57 |
| Example 2 | Ni | Flat plate type | FIG. 11 | A type | Si composite SiC | 40 | 30 | 200 | 7.5 | 30 | 80 |
| Example 3 | Ni | Flat plate type | FIG. 11 | A type | Si composite SiC | 40 | 30 | 100 | 7.5 | 30 | 79 |
| Example 4 | Ni | Flat plate type | FIG. 11 | A type | Si composite SiC | 40 | 30 | 300 | 7.5 | 30 | 82 |
| Example 5 | Ni | Flat plate type | FIG. 11 | A type | Si composite SiC | 40 | 30 | 400 | 7.5 | 30 | 81 |
| Example 6 | Cu | Flat plate type | FIG. 11 | A type | Si composite SiC | 40 | 30 | 400 | 7.5 | 30 | 79 |
| Example 7 | Cu | Flat plate type | FIG. 11 | B type | Si composite SiC | 40 | 30 | 400 | 7.5 | 30 | 78 |
| Example 8 | Cu | Flat plate type | FIG. 11 | C type | Si composite SiC | 40 | 30 | 400 | 7.5 | 30 | 80 |
| Example 9 | Cu | Flat plate type | FIG. 11 | D type | Si composite SiC | 40 | 30 | 400 | 7.5 | 30 | 79 |
| Example 10 | Cu | Rod type | FIG. 12 | A type | Si composite SiC | 40 | 0.5 | 40 | 15 | 30 | 80 |
| Example 11 | Cu | Rod type | FIG. 12 | B type | Si composite SiC | 40 | 0.5 | 40 | 15 | 30 | 78 |
| Example 12 | Cu | Rod type | FIG. 12 | C type | Si composite SiC | 40 | 0.5 | 40 | 15 | 30 | 81 |
| Example 13 | Cu | Rod type | FIG. 12 | D type | Si composite SiC | 40 | 0.5 | 40 | 15 | 30 | 50 |
| Example 14 | Ni | Rod type | FIG. 12 | C type | Si composite SiC | 40 | 0.5 | 20 | 15 | 30 | 82 |
| Example 15 | Ni | Rod type | FIG. 12 | A type | Si composite SiC | 40 | 0.5 | 60 | 15 | 30 | 81 |
| Example 16 | Cu | Rod type | FIG. 12 | C type | Si composite SiC | 40 | 0.5 | 20 | 15 | 30 | 80 |
| Example 17 | Cu | Rod type | FIG. 12 | A type | Si composite SiC | 40 | 0.5 | 60 | 15 | 30 | 79 |

Examples 2 to 6

There were manufactured heaters in the same manner as in Example 1 except that the material of the electrode portions, the structure of the electrode portions, and the structure of the housing were changed as shown in Table 1. By the use of the the coating material was about 0.05 mm. Incidentally, in the case of the ceramic pore sealing material, it plugs the pores in the heater partition walls close to the outer peripheral portion with coating the outer periphery of the honeycomb heater portion. The method of manufacturing a coating material by coating an inorganic heat resistant adhesive where a ceramic pore sealing material is added is defined as "B type". In the column of the "manufacturing method of coating material" in Table 1, a manufacturing method of a coating material in Example 7 is shown.

Example 8

In Example 8, a heater was manufactured in the same manner as in Example 3 except that a coating material was manufactured as follows. In the first place, after a low melting point glass paste was homogenized by mixing again at below 100 rpm by the use of a ball mill before the use, it was coated on the outer peripheral portion of the heater main body by brush coating. As the low melting point glass paste, a paste of $SnO—P_2O_5$ was used. The low melting point glass paste coated above was fired at 150° C. as preheating for volatilizing an organic solvent and then fired at 480° C. in the atmosphere to manufacture a coating material made of low melting point glass. The thickness of the coating material was about 0.5 mm. The method of manufacturing a coating material by coating the low melting point glass is defined as "C type". In the column of the "manufacturing method of coating material" in Table 1, the manufacturing method of the coating material in Example 8 is shown.

Example 9

In Example 9, the heater was manufactured in the same manner as in Example 3 except that the coating material was manufactured as follows. In the first place, slurry containing $SiO_2$ particles was prepared, and a plate-shaped filler was added to the slurry. As the plate-shaped filler, mica was used. The slurry where the plate-shaped filler was added was coated on the outer peripheral portion of the heater main body. The slurry coated above was fired at 400 to 600° C. in the atmosphere to manufacture a glass coating material. The thickness of the coating material was about 0.4 mm. The method of manufacturing a coating material by coating the slurry containing $SiO_2$ particles is determined as "D type". In the column of the "manufacturing method of coating material" in Table 1, the manufacturing method of the coating material in Example 9 is shown.

By the use of the heater of Examples 7 to 9 obtained above, the energization heating test was performed in the same manner as in Example 1. The conversion efficiency (%) obtained from the results of the energization heating test is shown in Table 1. Table 1 shows the applied voltage (V), flow rate of the lubricating fluid passed through the heater (L/min), and initial temperature of the lubricating fluid (° C.) in the energization heating test.

Examples 10 to 17

There were manufactured heaters in the same manner as in Example 1 except that the material of the electrode portions, the structure of the electrode portions, the structure of the housing, and the manufacturing method of the coating material were changed as shown in Table 1. In Examples 10 to 17, the structure of the electrode portions was a "rod type". The rod type electrode portions had a circular columnar shape having the end faces having a diameter of 6 mm. In the heaters of Examples 10 to 17, the "structure of housing" was FIG. 12. In the heaters of Examples 10 to 17, as the adiabatic material, a ceramic fiber sheet ($Al_2O_3—SiO_2$ base) having a thickness of 5 mm was used.

By the use of the heaters of Examples 10 to 17 obtained above, the energization heating test was performed in the same manner as in Example 1. The conversion efficiency (%) obtained from the results of the energization heating test is shown in Table 1. Table 1 shows the applied voltage (V), flow rate of the lubricating fluid passed through the heater (L/min), and initial temperature of the lubricating fluid (° C.) in the energization heating test.

Examples 18 to 31

There were manufactured heaters in the same manner as in Example 1 except that the material of the electrode portions, the structure of the electrode portions, the structure of the housing, the manufacturing method of the coating material, and the material for the partition walls were changed as shown in Table 2. In the heaters of Examples 18 to 31, as the adiabatic material, a ceramic fiber sheet ($Al_2O_3—SiO_2$ base) having a thickness of 5 mm was used.

By the use of the heaters of Examples 18 to 31 obtained above, the energization heating test was performed in the same manner as in Example 1. The conversion efficiency (%) obtained from the results of the energization heating test is shown in Table 2. Table 2 shows the applied voltage (V), flow rate of the lubricating fluid passed through the heater (L/min), and initial temperature of the lubricating fluid (° C.) in the energization heating test.

TABLE 2

| | Electrode portion | | Structure | Manufacturing method of | | Porosity of partition | Specific resistance of partition wall and outer | Energization heating test | | | |
|---|---|---|---|---|---|---|---|---|---|---|---|
| | Material | Structure | of housing | coating material | Material for partition wall | wall (%) | peripheral wall (Ω · cm) | Applied voltage (V) | Flow rate of lubricating fluid (L/min) | Initial temperature of lubricating fluid (° C.) | Conversion efficiency (%) |
| Example 18 | Ni | Rod type | FIG. 12 | C type | Recrystallized SiC | 40 | 0.5 | 20 | 15 | 30 | 51 |
| Example 19 | Ni | Rod type | FIG. 12 | A type | Recrystallized SiC | 40 | 0.5 | 60 | 15 | 30 | 80 |
| Example 20 | Cu | Rod type | FIG. 12 | C type | Recrystallized SiC | 40 | 0.5 | 20 | 15 | 30 | 80 |
| Example 21 | Cu | Rod type | FIG. 12 | A type | Recrystallized SiC | 40 | 0.5 | 60 | 15 | 30 | 79 |
| Example 22 | Cu | Rod type | FIG. 12 | A type | Recrystallized SiC | 40 | 0.1 | 10 | 15 | 30 | 82 |
| Example 23 | Cu | Rod type | FIG. 12 | A type | Recrystallized SiC | 40 | 0.1 | 20 | 15 | 30 | 78 |
| Example 24 | Cu | Rod type | FIG. 12 | C type | Si-impregnated SiC | 0 | 0.05 | 10 | 15 | 30 | 79 |
| Example 25 | Cu | Rod type | FIG. 12 | A type | Si-impregnated SiC | 0 | 0.05 | 10 | 15 | 30 | 78 |
| Example 26 | Cu | Rod type | FIG. 12 | A type | Recrystallized SiC | 40 | 1 | 60 | 15 | 30 | 79 |
| Example 27 | Cu | Rod type | FIG. 12 | C type | Recrystallized SiC | 40 | 1 | 50 | 15 | 30 | 80 |
| Example 28 | Cu | Rod type | FIG. 12 | A type | Reaction-sintered | 40 | 1 | 50 | 15 | 30 | 78 |

TABLE 2-continued

| | Electrode portion | | Structure | Manufacturing method of | | Porosity of partition | Specific resistance of partition wall and outer | Energization heating test | | | |
|---|---|---|---|---|---|---|---|---|---|---|---|
| | Material | Structure | of housing | coating material | Material for partition wall | wall (%) | peripheral wall (Ω · cm) | Applied voltage (V) | Flow rate of lubricating fluid (L/min) | Initial temperature of lubricating fluid (° C.) | Conversion efficiency (%) |
| Example 29 | Cu | Rod type | FIG. 12 | C type | SiC (porous) Reaction-sintered SiC (porous) | 40 | 1 | 60 | 15 | 30 | 79 |
| Example 30 | Cu | Rod type | FIG. 12 | C type | Reaction-sintered SiC (dense) | 0 | 0.05 | 10 | 15 | 30 | 80 |
| Example 31 | Cu | Rod type | FIG. 12 | A type | Reaction-sintered SiC (dense) | 0 | 0.05 | 10 | 15 | 30 | 77 |

In Examples 18 to 23, 26, and 27, the material for the partition walls was "recrystallized SiC". The method for manufacturing the honeycomb structural portions having partition walls of the recrystallized SiC was as follows. In the first place, a raw material containing a SiC powder, an organic binder, and "water or an organic solvent" was mixed and kneaded to prepare a kneaded material. Next, the kneaded material was formed to manufacture a honeycomb formed body. Next, the honeycomb formed body obtained above was fired at predetermined temperature (1600 to 2300° C.) in a nitrogen gas atmosphere to manufacture a honeycomb structural portion.

In Examples 24 and 25, the material for the partition walls was "Si-impregnated SiC". The method for manufacturing a honeycomb structural portion having partition walls made of Si-impregnated SiC was as follows. Specifically, a SiC powder, an organic binder, and water were mixed and kneaded to prepare a kneaded material. Next, a formed body was manufactured in such a manner that the kneaded material forms a predetermined honeycomb structure shown in Table 2. Next, a metal Si mass was mounted on the formed body obtained above, and the formed body was impregnated with Si in a pressure-reduced argon (Ar) gas atmosphere. Thus, a honeycomb structural portion containing Si-impregnated SiC as the main component was manufactured.

In Examples 28 and 29, the material for the partition walls was "reaction-sintered SiC (porous)". The "reaction-sintered SiC (porous)" means a porous reaction-sintered SiC. The method for manufacturing a honeycomb structural portion having partition walls made of reaction-sintered SiC (porous) is as follows. In the first place, a silicon nitride powder, a carbonaceous substance, silicon carbide, and a graphite powder were mixed together and kneaded to prepare a kneaded material. Next, the kneaded material was formed to manufacture a honeycomb formed body. Next, the aforementioned formed body was subjected to primary firing in a non-oxidizing atmosphere to obtain a primary fired body. Next, by heating the primary fired body in the oxidizing atmosphere for decarburization, the remaining graphite was removed. Next, in the non-oxidizing atmosphere, the "decarburized primary fired body" was subjected to secondary firing at a predetermined temperature (1600 to 2500° C.) to obtain a secondary fired body. The secondary fired body obtained in such a manner served as a honeycomb structural portion.

In Examples 30 and 31, the material for the partition walls was "reaction-sintered SiC (dense)". The "reaction-sintered SiC (dense)" means a dense reaction-sintered SiC. The method for manufacturing a honeycomb structural portion having partition walls made of reaction-sintered SiC (dense) is as follows. A SiC powder and a graphite powder were mixed together and kneaded to prepare a kneaded material. Next, the kneaded material was formed to manufacture a honeycomb formed body. Next, the aforementioned formed body was impregnated with "molten silicon (Si)". By this, the carbon constituting the graphite and the silicon with which the impregnation was performed were reacted to each other to generate SiC. The structure obtained in such a manner served as the honeycomb structural portion.

Examples 32 to 45

The heaters were manufactured in the same manner as in Example 1 except that the material for the electrode portions, structure of the electrode portions, structure of the housing, the method for manufacturing the coating material, and the material for the partition walls were changed as shown in Table 3. In the heater of Examples 36 to 45, a ceramic fiber sheet ($Al_2O_3$—$SiO_2$ base) having a thickness of 5 mm was used as the adiabatic material.

By the use of the heaters of Examples 32 to 45 obtained above, the energization heating test was performed in the same manner as in Example 1. The conversion efficiency (%) obtained from the results of the energization heating test is shown in Table 3. Table 3 shows the applied voltage (V), flow rate of the lubricating fluid passed through the heater (L/min), and initial temperature of the lubricating fluid (° C.) in the energization heating test.

TABLE 3

| | Electrode portion | | Structure | Manufacturing method of | | Porosity of partition | Specific resistance of partition wall and outer | Energization heating test | | | |
|---|---|---|---|---|---|---|---|---|---|---|---|
| | Material | Structure | of housing | coating material | Material for partition wall | wall (%) | peripheral wall (Ω · cm) | Applied voltage (V) | Flow rate of lubricating fluid (L/min) | Initial temperature of lubricating fluid (° C.) | Conversion efficiency (%) |
| Example 32 | Cu | Rod type | FIG. 13 | A type | Si composite SiC | 40 | 0.5 | 40 | 15 | 30 | 84 |
| Example 33 | Ni | Rod type | FIG. 13 | C type | Si composite SiC | 40 | 0.5 | 40 | 15 | 30 | 88 |
| Example 34 | Cu | Rod type | FIG. 13 | A type | Recrystallized SiC | 40 | 0.5 | 40 | 15 | 30 | 83 |
| Example 35 | Ni | Rod type | FIG. 13 | C type | Recrystallized SiC | 40 | 0.5 | 40 | 15 | 30 | 85 |
| Example 36 | Cu | Rod type | FIG. 12 | A type | Si-impregnated SiC | 0 | 0.05 | 15 | 30 | 30 | 78 |
| Example 37 | Cu | Rod type | FIG. 12 | C type | Si-impregnated SiC | 0 | 0.05 | 15 | 30 | 30 | 77 |
| Example 38 | Cu | Rod type | FIG. 12 | A type | Reaction-sintered SiC (dense) | 0 | 0.05 | 15 | 30 | 30 | 74 |
| Example 39 | Cu | Rod type | FIG. 12 | C type | Reaction-sintered SiC (dense) | 0 | 0.05 | 15 | 30 | 30 | 75 |
| Example 40 | Mo | Rod type | FIG. 12 | A type | Si composite SiC | 40 | 0.5 | 40 | 15 | 30 | 81 |
| Example 41 | Mo | Rod type | FIG. 12 | C type | Recrystallized SiC | 40 | 0.5 | 40 | 15 | 30 | 81 |
| Example 42 | W | Rod type | FIG. 12 | A type | Si composite SiC | 40 | 0.5 | 40 | 15 | 30 | 80 |
| Example 43 | W | Rod type | FIG. 12 | C type | Recrystallized SiC | 40 | 0.5 | 40 | 15 | 30 | 81 |
| Example 44 | Cu/W | Rod type | FIG. 12 | A type | Si composite SiC | 40 | 0.5 | 40 | 15 | 30 | 80 |
| Example 45 | Cu/W | Rod type | FIG. 12 | C type | Recrystallized SiC | 40 | 0.5 | 40 | 15 | 30 | 81 |
| Example 46 | Cu | Rod type | FIG. 14 | A type | Si composite SiC | 40 | 0.5 | 40 | 15 | 30 | 91 |
| Example 47 | Cu | Rod type | FIG. 14 | C type | Recrystallized SiC | 40 | 0.5 | 40 | 15 | 30 | 92 |
| Example 48 | Cu/W | Rod type | FIG. 14 | A type | Si composite SiC | 40 | 0.5 | 40 | 15 | 30 | 92 |
| Example 49 | Cu/W | Rod type | FIG. 14 | C type | Recrystallized SiC | 40 | 0.5 | 40 | 15 | 30 | 92 |
| Example 50 | Cu | Rod type | FIG. 12 | A type | Si composite SiC | 40 | 0.5 | 40 | 15 | 0 | 79 |
| Example 51 | Cu | Rod type | FIG. 12 | C type | Recrystallized SiC | 40 | 0.5 | 40 | 15 | 0 | 80 |

In Examples 40 and 41, as the material for the electrode portions, pure metal molybdenum was used. In the column of "material for electrode portion" in Table 3, molybdenum is shown as "Mo". In Examples 42 and 43, as the material for the electrode portions, pure metal tungsten was used. In the column of "material for electrode portion" in Table 3, tungsten is shown as "W". In Examples 44 and 45, as the material for the electrode portions, copper tungsten composite material was used. As this composite material, a material having a tungsten (W) volume rate of 85% was used. In the column of "material for electrode portion" in Table 3, copper tungsten composite material is shown as "Cu/W".

Examples 46 to 49

The material for the electrode portions, structure of the electrode portions, structure of the housing, and material for the partition walls were changed as shown in Table 3, and the heater having a housing formed of resin (i.e., heater having a "housing structure" of FIG. 14) was manufactured by the following method. In the first place, there was manufactured a heater main body having a honeycomb structural portion according to the material for partition walls shown in Table 3. In the same manner as in Example 1, a coating material was coated on the outer peripheral portion of the heater main body to form a coating material. Separately from the heater main body, a housing was manufactured by using a fluorine resin. The fluorine resin used for the housing had a thickness of 5 mm. The heater main body having a coating material formed thereon was stored in the resin housing obtained above, and an adiabatic material of a ceramic fiber sheet was further disposed between the housing and the heater main body to manufacture a heater. By the use of the heater obtained above, the energization heating test was performed in the same manner as in Example 1. The conversion efficiency (%) obtained from the results of the energization heating test is shown in Table 3. Table 3 shows the applied voltage (V), flow rate of the lubricating fluid passed through the heater (L/min), and initial temperature of the lubricating fluid (° C.) in the energization heating test.

Examples 50 and 51

The material for the electrode portions, structure of the electrode portions, structure of the housing, and material for the partition walls were changed as shown in Table 3, and a heater having a structure as shown in FIG. 12 was manufactured. In the present Examples, the low temperature operation was emulated to perform the test in a state where the initial temperature of the lubricating fluid was lowered to 0° C. By the use of the heater obtained above, the energization heating test was performed in the same manner as in Example 1. The conversion efficiency (%) obtained from the results of the energization heating test is shown in Table 3. Table 3 shows the applied voltage (V), flow rate of the lubricating fluid passed through the heater (L/min), and initial temperature of the lubricating fluid (° C.) in the energization heating test.

(Results)

As shown in Table 1, the heater of Example 1 having no adiabatic material disposed in the housing had a conversion efficiency of 67%. Though the conversion efficiency was low in comparison with the heaters of Examples 2 to 51, it was found out that a sufficient adiabatic effect was exhibited due to the coating material made of ceramic as in Example 1. In addition, the coating material had excellent insulation properties and sealability. As shown in Tables 1 to 3, the conversion efficiency could further be improved by using an adiabatic material of a ceramic fiber sheet together with the coating material or by using resin for the housing. By using resin for the housing, weight saving of the heater could be realized. In Examples 50 and 51, since the initial temperature of the lubricating fluid was lowered to 0° C., the viscosity at the time of start-up became high, and the pressure loss of the lubricating fluid upon passing through the honeycomb structure became high in comparison with a heater having an initial temperature of 30° C. However, there was no operation problem, and it was good as a heater.

In addition, forming a ceramic or glass coating material on a side face of the heater main body as the heaters of Examples 1 to 51 enabled to manufacture a housing structure by a simple and low temperature process together with weight saving. In the case of using resin as the coating material, when the output became high, the resin material might be thermally damaged by local heat generation. However, in the case that a ceramic or glass coating material is formed on the side face of the heater main body as in the present invention, such problems were not caused, and it was present while functioning as the insulation layer in a good manner. In addition, it was found out that, by using the heater main body having a honeycomb-shaped honeycomb structural portion and a pair of electrode portions disposed on side faces, downsizing, early heating, and high conversion efficiency can be obtained in comparison with a conventional heater. Incidentally, the structure of the housing and disposition of the resin material and the like inside the housing are preferably determined appropriately in consideration of the aforementioned conversion efficiency and strength design, durability, and the like required for the heater.

INDUSTRIAL APPLICABILITY

The present invention can be used as a heater usable for heating lubricating fluid such as engine oil or transmission fluid.

DESCRIPTION OF REFERENCE NUMERALS

1: partition walls, 2: cell, 3: outer peripheral wall, 4: honeycomb structural portion, 5: side face, 11: one end face, 12: the other end face, 21: electrode portion, 22*a*: electrode substrate, 22*b*: electrode portion, 23: conductive bond portion, 24: electrode portion, 25: electrode portion, 26*a*: electrode substrate, 26*b*: electrode portion, 31: electrode portion, 31*a*: electrode substrate, 31*b*: electrode terminal portion, 31*c*: electrode substrate connection portion, 35: sealing material, 41: electrode portion, 42: vibration-absorbing portion, 43: electrode portion, 43*a*: electrode substrate, 43*b*: electrode terminal portion, 50, 60, 70, 80, 90: heater main body, 51, 73, 81, 91: housing, 51*a*: housing main body, 51*b*: lid portion, 52, 72: coating material, 53: O ring, 54, 74: electrode leading portion, 55: inflow port, 56: outflow port, 57: adiabatic material, 58: resin material, 91*a*: housing main body, 91*b*: lid portion, 94: pump, 95: pipe, 96: cooler, 98: valve, 99: flowmeter, 100, 200, 300, 401, 402A, 402B, 403, 404, 405, 500, 600, 700, 800: heater, 152, 153: heater main body, 900: energization heating test apparatus, P1, P2: pressure gauge, T1, T2: thermocouple

The invention claimed is:

1. A heater comprising: a heater main body, a housing storing the heater main body therein, and a coating material arranged in at least a part between the heater main body and the housing and covering at least a part of the heater main body;

wherein the coating material is a material containing at least one of ceramic and glass, the heater main body has a cylindrical honeycomb structural portion having partition walls separating and forming a plurality of cells extending from one end face to the other end face and functioning as passages for a lubricating fluid and a pair of electrode portions disposed on a side face of the honeycomb structural portion, the housing has an inflow port from which the lubricating fluid flows in and the outflow port from which the lubricating fluid having passed through the cells formed in the heater main body flows out and stores the heater main body so as to cover the side face side of the heater main body, the partition walls of the honeycomb structural portion are of a material containing ceramic as the main component, the partition walls contain as a main component one kind selected from the group consisting of SiC, metal-impregnated SiC, metal composite SiC, and metal composite $Si_3N_4$; the partition walls have a specific resistance of 0.01 to 50 Ω·cm; and the partition walls produce heat by energization to be used for heating a lubricating fluid.

2. The heater according to claim 1, wherein the coating material is disposed at least between the heater main body and the housing on the one end face side of the heater main body and between the heater main body and the housing on the other end face side of the heater main body.

3. The heater according to claim 2, wherein the coating material is a material where the material containing at least one of ceramic and glass is coated on at least a part of the surface of the heater main body.

4. The heater according to claim 1, where a part of the pair of electrode portions passes through the housing and is extended to the outside of the housing, and the coating material is disposed at least between the pair of electrode portions and the housing in the portion where the pair of electrode portions pass through the housing.

5. The heater according to claim 2, where a part of the pair of electrode portions passes through the housing and is extended to the outside of the housing, and the coating material is disposed at least between the pair of electrode portions and the housing in the portion where the pair of electrode portions pass through the housing.

6. The heater according to claim 3, where a part of the pair of electrode portions passes through the housing and is extended to the outside of the housing, and the coating material is disposed at least between the pair of electrode portions and the housing in the portion where the pair of electrode portions pass through the housing.

7. The heater according to claim 1, where the coating material is disposed between the heater main body and the housing so as to cover at least the entire region of the pair of electrode portions disposed on the heater main body.

8. The heater according to claim 2, where the coating material is disposed between the heater main body and the housing so as to cover at least the entire region of the pair of electrode portions disposed on the heater main body.

9. The heater according to claim 3, where the coating material is disposed between the heater main body and the housing so as to cover at least the entire region of the pair of electrode portions disposed on the heater main body.

10. The heater according to claim 4, where the coating material is disposed between the heater main body and the housing so as to cover at least the entire region of the pair of electrode portions disposed on the heater main body.

11. The heater according to claim 5, where the coating material is disposed between the heater main body and the housing so as to cover at least the entire region of the pair of electrode portions disposed on the heater main body.

12. The heater according to claim 6, where the coating material is disposed between the heater main body and the housing so as to cover at least the entire region of the pair of electrode portions disposed on the heater main body.

13. The heater according to claim 1, wherein each of the pair of electrode portions is composed of an electrode substrate disposed on the side face of the honeycomb structural portion and a rod-shaped electrode portion disposed so as to be connected to the electrode substrate.

14. The heater according to claim 1, wherein the material for the housing is metal or resin.

15. The heater according to claim 1, wherein an adiabatic material is disposed between the heater main body and the housing inside the housing.

16. The heater according to claim 1, wherein the specific resistance of the coating material is $10^6$ Ω·cm or more.

* * * * *